US011845643B2

(12) United States Patent
Wing et al.

(10) Patent No.: US 11,845,643 B2
(45) Date of Patent: Dec. 19, 2023

(54) BEVERAGE DISPENSING

(71) Applicant: Hydration Labs, Inc., Boston, MA (US)

(72) Inventors: Michael Wing, Framingham, MA (US); Yvan De Boeck, Medford, MA (US); Sean Grundy, Boston, MA (US); Elizabeth Becton, Charlestown, MA (US); Frank Lee, Cambridge, MA (US)

(73) Assignee: Hydration Labs, Inc., Boston, MA (US)

( * ) Notice: Subject to any disclaimer, the term of this patent is extended or adjusted under 35 U.S.C. 154(b) by 0 days.

(21) Appl. No.: 15/971,780

(22) Filed: May 4, 2018

(65) Prior Publication Data

US 2018/0251358 A1 Sep. 6, 2018

Related U.S. Application Data

(62) Division of application No. 15/280,293, filed on Sep. 29, 2016, now abandoned.

(Continued)

(51) Int. Cl.
*B67D 1/00* (2006.01)
*B67D 1/07* (2006.01)

(Continued)

(52) U.S. Cl.
CPC ..... *B67D 1/0022* (2013.01); *B67D 1/004* (2013.01); *B67D 1/005* (2013.01); *B67D 1/0027* (2013.01);

(Continued)

(58) Field of Classification Search
CPC .. B67D 1/1204; B67D 1/1213; B67D 1/1229; B67D 1/1231; B67D 1/004; B67D 1/005;

(Continued)

(56) References Cited

U.S. PATENT DOCUMENTS 3,256,802 A 6/1966 Karr
3,397,871 A 8/1968 Hasselberg (Continued)

FOREIGN PATENT DOCUMENTS

CN 101855657 10/2010
CN 102791613 11/2012

(Continued)

OTHER PUBLICATIONS

Transaction History for U.S. Appl. No. 15/280,293, downloaded Aug. 27, 2018, pp. 1.
Transaction History for U.S. Appl. No. 15/971,880, downloaded Aug. 27, 2018, pp. 1.
Transaction History for U.S. Appl. No. 15/971,897, downloaded Aug. 27, 2018, pp. 1.

(Continued)

*Primary Examiner* — Paul R Durand
*Assistant Examiner* — Robert K Nichols, II
(74) *Attorney, Agent, or Firm* — Morris, Manning & Martin, LLP; Daniel E. Sineway, Esq.; Adam J. Thompson, Esq.

(57) ABSTRACT

Among other things, beverages are dispensed from one or more beverage dispensers based on selections made by users. Information about the dispensing of the beverages is sent to a central server where it is used to manage a variety of functions including replacement of depleted supplies of components. Various features of the beverage dispensers enable the beverages that are dispensed to be uniform and appealing to users.

20 Claims, 33 Drawing Sheets

Related U.S. Application Data

Figure 1:
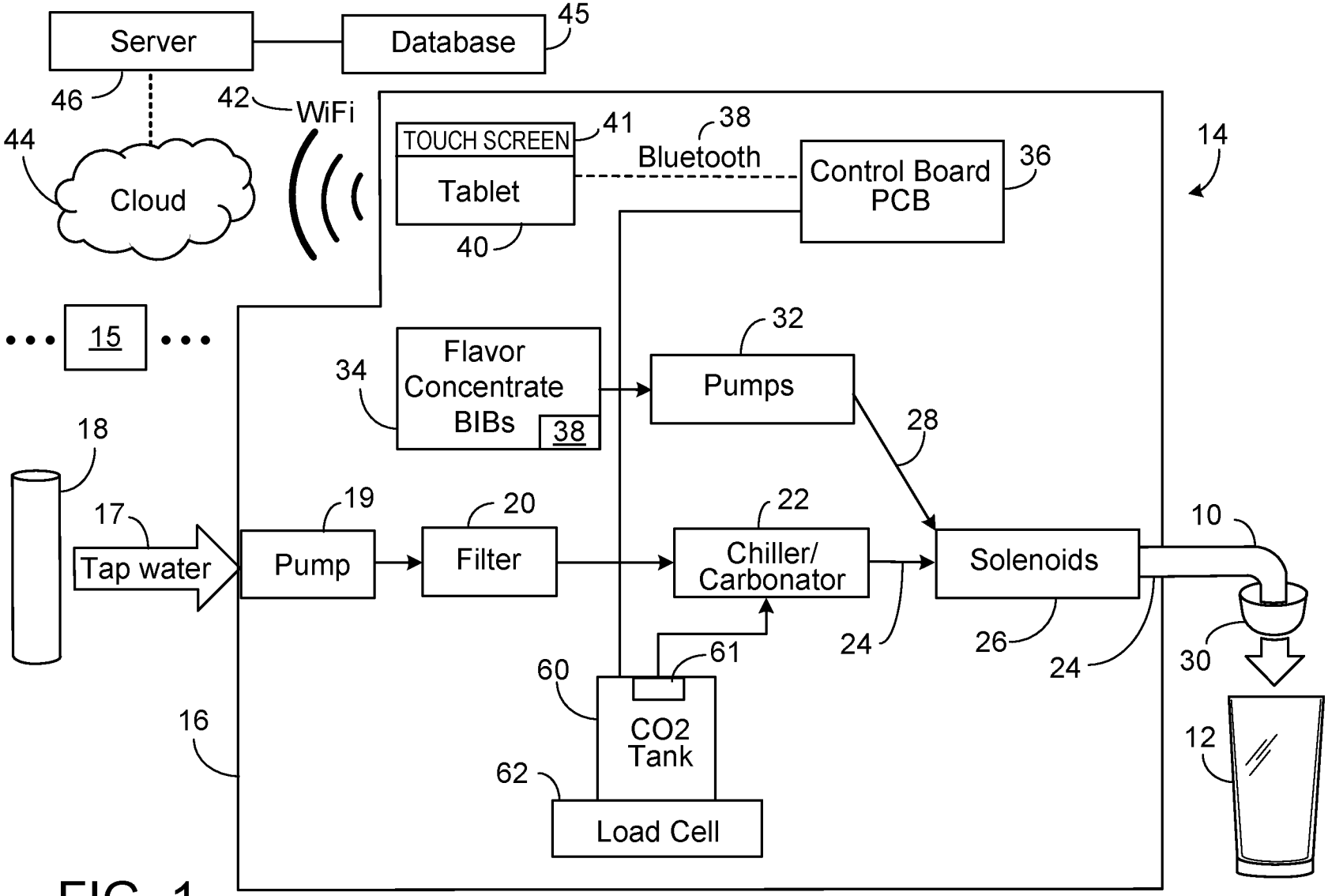

(60) Provisional application No. 62/387,298, filed on Dec. 23, 2015, provisional application No. 62/387,124, filed on Dec. 23, 2015, provisional application No. 62/387,227, filed on Dec. 23, 2015, provisional application No. 62/235,240, filed on Sep. 30, 2015.

(51) Int. Cl.
*B67D 1/08* (2006.01)
*B67D 1/10* (2006.01)
*B67D 1/12* (2006.01)

(52) U.S. Cl.
CPC ..... *B67D 1/0028* (2013.01); *B67D 1/0031* (2013.01); *B67D 1/0032* (2013.01); *B67D 1/0036* (2013.01); *B67D 1/0037* (2013.01); *B67D 1/0038* (2013.01); *B67D 1/0039* (2013.01); *B67D 1/0051* (2013.01); *B67D 1/0075* (2013.01); *B67D 1/0076* (2013.01); *B67D 1/07* (2013.01); *B67D 1/0875* (2013.01); *B67D 1/0884* (2013.01); *B67D 1/0888* (2013.01); *B67D 1/108* (2013.01); *B67D 1/1204* (2013.01); *B67D 1/1213* (2013.01); *B67D 1/1229* (2013.01); *B67D 1/1231* (2013.01); *B67D 2001/0093* (2013.01); *B67D 2210/0001* (2013.01); *B67D 2210/0006* (2013.01); *B67D 2210/00047* (2013.01); *B67D 2210/00089* (2013.01); *B67D 2210/00091* (2013.01)

(58) Field of Classification Search
CPC .. B67D 1/0051; B67D 1/0075; B67D 1/0076; B67D 1/07; B67D 1/0875; B67D 1/0884; B67D 1/0888; B67D 1/10; B67D 1/0022; B67D 1/0027; B67D 1/0028; B67D 1/0031; B67D 1/00
USPC ..... 222/129.4, 145.7, 144.5
See application file for complete search history.

(56) References Cited

U.S. PATENT DOCUMENTS 3,777,937 A * 12/1973 Buck ..... B67D 1/0036 222/641
4,128,190 A * 12/1978 Gruber ..... B67D 1/005 137/607
4,392,588 A 7/1983 Scalera
4,955,507 A 9/1990 Kirschner et al.
4,979,639 A 12/1990 Hoover et al.
5,129,434 A * 7/1992 Whigham ..... B67D 1/0037 141/362
5,193,746 A 3/1993 Iwamura et al.
5,279,446 A 1/1994 Cook et al.
5,427,682 A 6/1995 Vogel et al.
5,491,617 A 2/1996 Currie
5,510,060 A 4/1996 Knoll
5,526,959 A 6/1996 Green
5,839,291 A 11/1998 Chang
5,845,824 A * 12/1998 Weimer ..... B67D 1/1236 222/641
5,881,911 A 3/1999 Burdette et al.
5,930,771 A 7/1999 Stapp
5,988,441 A 11/1999 Weinaug et al.
5,992,685 A 11/1999 Credle, Jr.
6,199,720 B1 3/2001 Rudick et al.
6,230,150 B1 5/2001 Walker et al.
6,234,354 B1 5/2001 Phillips et al.
6,302,299 B1 10/2001 Baker et al.
6,364,159 B1 4/2002 Newman et al.
6,425,226 B1 7/2002 Kirschner
6,431,950 B1 * 8/2002 Mayes ..... B24B 37/005 222/145.1
6,504,481 B2 1/2003 Teller
6,547,100 B2 4/2003 Phillips et al.
6,556,889 B2 4/2003 Rudick et al.
6,616,037 B2 9/2003 Grimm et al.
6,807,460 B2 10/2004 Black et al.
6,962,270 B1 * 11/2005 Barker ..... G05D 11/132 222/129.4
7,020,680 B2 3/2006 Defosse
7,218,991 B2 5/2007 Walker et al.
7,445,133 B2 11/2008 Ludovissie et al.
7,499,762 B2 3/2009 Khorramshahi
7,553,076 B2 6/2009 An
7,573,395 B2 8/2009 Morrison et al.
7,577,496 B2 8/2009 Walker et al.
7,587,333 B1 9/2009 Walker et al.
7,627,496 B2 12/2009 Walker et al.
7,726,562 B2 6/2010 Walker et al.
7,739,181 B2 6/2010 Breitenbach et al.
7,757,896 B2 7/2010 Carpenter et al.
7,826,923 B2 11/2010 Walker et al.
7,865,265 B2 1/2011 Walker et al.
7,894,936 B2 2/2011 Walker et al.
7,912,580 B2 3/2011 Walker et al.
7,912,581 B2 3/2011 Walker et al.
7,913,879 B2 3/2011 Carpenter et al.
7,972,639 B2 7/2011 Guerrero et al.
8,001,795 B2 8/2011 Pfister et al.
8,068,933 B2 11/2011 Walker et al.
8,079,495 B2 12/2011 Bethuy et al.
8,140,185 B2 3/2012 Simmons et al.
8,162,176 B2 4/2012 Rudick
8,162,181 B2 4/2012 Carpenter et al.
8,191,779 B2 6/2012 Illingworth et al.
8,234,207 B2 7/2012 Breitenbach et al.
8,328,050 B2 12/2012 Ziesel
8,458,312 B2 6/2013 Raghunathan et al.
8,590,746 B2 11/2013 Bethuy et al.
8,596,529 B1 12/2013 Kolls
8,631,974 B2 1/2014 Piatnik et al.
8,642,051 B2 2/2014 Stillman
8,666,874 B2 3/2014 Breitenbach et al.
8,744,618 B2 6/2014 Peters et al.
8,751,037 B2 6/2014 Peters et al.
9,399,570 B2 7/2016 van Haperen et al.
2003/0012864 A1 1/2003 Gerber
2003/0121937 A1 * 7/2003 Black ..... B67D 1/06 222/129.1
2004/0118291 A1 6/2004 Carhuff
2005/0121466 A1 6/2005 Sher et al.
2005/0133531 A1 * 6/2005 Crisp ..... B67D 1/0021 222/129.1
2005/0276035 A1 12/2005 Currie
2006/0097008 A1 5/2006 Emmendoerfer et al.
2007/0267441 A1 11/2007 Van Opstal et al.
2008/0202148 A1 * 8/2008 Gagliano ..... B67D 1/0406 62/392
2009/0065570 A1 * 3/2009 Peters ..... B67D 1/0041 235/378
2010/0213212 A1 8/2010 Custodis et al.
2011/0049187 A1 3/2011 Boekhoorn et al.
2011/0181417 A1 * 7/2011 Haskayne ..... B67D 1/0021 340/572.1
2011/0192495 A1 8/2011 Deo et al.
2011/0315711 A1 * 12/2011 Hecht ..... A47J 31/52 222/129.1
2012/0104021 A1 5/2012 Cur et al.
2012/0104028 A1 * 5/2012 Bortoletto ..... F25D 23/126 222/129.3
2012/0114814 A1 5/2012 Bippert
2012/0325845 A1 12/2012 Newman et al.
2012/0325846 A1 12/2012 Reddy et al.
2013/0106690 A1 * 5/2013 Lim ..... G07F 13/065 345/156
2013/0233888 A1 9/2013 Kim et al.
2013/0309361 A1 11/2013 Kyong et al.

(56) References Cited

U.S. PATENT DOCUMENTS

| | | | | |
|---|---|---|---|---|
| 2014/0097549 | A1* | 4/2014 | Hoare | B01F 15/00253 261/30 |
| 2014/0107835 | A1* | 4/2014 | Biasi | B67D 1/0036 700/231 |
| 2014/0239521 | A1* | 8/2014 | Ergican | B67D 1/0058 261/115 |
| 2014/0352805 | A1 | 12/2014 | Kuebeck | |
| 2015/0102062 | A1 | 4/2015 | Mosimann et al. | |
| 2015/0191341 | A1 | 7/2015 | Martindale et al. | |
| 2015/0232320 | A1 | 8/2015 | Wait et al. | |
| 2015/0239724 | A1 | 8/2015 | Cronise | |
| 2016/0009539 | A1 | 1/2016 | Jersey et al. | |
| 2016/0130131 | A1 | 5/2016 | Hitzelberger et al. | |
| 2016/0255991 | A1* | 9/2016 | Givens, Jr. | A47J 31/407 |
| 2017/0043992 | A1* | 2/2017 | Green | B67D 1/0036 |
| 2017/0088410 | A1 | 3/2017 | Wing et al. | |
| 2017/0233234 | A1 | 8/2017 | Hecht et al. | |
| 2017/0241701 | A1 | 8/2017 | Lee et al. | |
| 2018/0132507 | A1* | 5/2018 | Siegel | A47J 31/40 |
| 2018/0251359 | A1 | 9/2018 | Wing et al. | |
| 2018/0251360 | A1 | 9/2018 | Wing et al. | |
| 2018/0251361 | A1 | 9/2018 | Wing et al. | |
| 2019/0231119 | A1 | 8/2019 | Kennedy et al. | |

FOREIGN PATENT DOCUMENTS

| | | |
|---|---|---|
| EP | 0873966 | 10/1998 |
| WO | WO 2009/032686 A1 | 3/2009 |
| WO | WO 2012/161936 A1 | 11/2012 |
| WO | WO2015/022692 | 2/2015 |
| WO | WO2017/059027 | 4/2017 |

OTHER PUBLICATIONS

Transaction History for U.S. Appl. No. 15/971,890, downloaded Aug. 27, 2018, pp. 1.

Transaction History for U.S. Appl. No. 16/047,254, downloaded Aug. 27, 2018, pp. 1.

Application from U.S. Appl. No. 16/047,254, dated Jul. 27, 2018, pp. 1-56.

Pending U.S. Appl. No. 15/280,293, filed Sep. 29, 2016, Robert K. Nichols, II.

Notification of International Search Report and Written Opinion in corresponding PCT Application No. PCT/US16/54370 dated Mar. 27, 2017, pp. 1-15.

Application from corresponding U.S. Appl. No. 15/280,293 dated Sep. 29, 2016, pp. 1-58.

Transaction History for corresponding U.S. Appl. No. 15/280,293 downloaded Apr. 25, 2018, p. 1.

U.S. Appl. No. 15/280,293, filed Sep. 29, 2016.

Pending U.S. Appl. No. 15/971,880, filed May 4, 2018.

Pending U.S. Appl. No. 15/971,897, filed May 4, 2018.

Pending U.S. Appl. No. 15/971,890, filed May 4, 2018.

Pending U.S. Appl. No. 16/047,254, filed Jul. 27, 2018.

International Preliminary Report on Patentability for International Application No. PCT/US2016/054370, dated Apr. 12, 2018.

Partial Supplementary European Search Report for European Application No. 16852569.9, dated Feb. 27, 2019.

Extended European Search Report for European Application No. 16852569.9, dated Jun. 4, 2019.

Examination Report dated Nov. 2, 2020 for United Kingdom patent application No. GB1804610.2.

* cited by examiner

Send your questions to service@bevi.co.
Please include pictures.

BEVERAGE DISPENSING

This application is entitled to the benefit of the filing dates of U.S. patent application Ser. No. 15/280,293, filed Sep. 29, 2016; 62/235,240, filed Sep. 30, 2016; 62/387,227, filed Dec. 23, 2015; 62/387,124, filed Dec. 23, 2015; and 62/387,298, filed Dec. 23, 2015, all of which are incorporated by reference here in their entireties.

BACKGROUND

This description relates to beverage dispensing.

Point-of-use water filtration and beverage mixing systems are more cost-effective methods of providing drinks than bottled beverages, because they reduce the volume of liquid that needs to be shipped. A standard 1-gallon container of concentrate, when mixed with tap water at the point of use, can produce between 6 and 26 gallons of a finished beverage product. Point-of-use and point-of-sale water filtration systems have vastly improved in the past decade because of more effective applications of activated carbon, reverse osmosis, and ultraviolet light technologies. As a result, the consistency of water taste and quality continues to improve, while filters have to be replaced less often.

A key to business success in managing point-of-use and point-of-sale systems is to minimize the frequency of visits to a machine. Point-of-use and point-of-sale beverage systems generally lack an ability to communicate information remotely. Typically, companies that manage soda fountains and water fountains rely on in-person visits to check inventory, change temperature settings, change flavor and carbonation settings, etc. Moreover, beverage machines lack the ability for users to easily customize beverages.

The systems and techniques that we describe below provide, among other things, for managing beverage dispensing machines that automate, and enable remote updating of, the settings that currently require manual visits. For maximum cost efficiency, the systems and techniques that we describe enable remotely capturing data on machines (such as traits of the incoming water source), and remotely updating the machine settings to optimize the beverage quality based on the water traits. The systems and techniques that we describe enable the machine to provide consumers with the ability to modify dispensing options and to customize their beverages, yet provide uniform beverage dispensing functionality and service among any beverage dispensing devices.

One of the classic complaints at soda fountains is cross-contamination of beverages, i.e., tasting whatever beverage had previously been dispensed. In traditional soda fountains with 6-8 separate nozzles, water generally shares a line with the lightest-colored drink (e.g., lemon soda).

Key elements of the taste and quality of a soda or other flavored drink are (1) the ratio of concentrate to water (strength), and (2) the percentage of dissolved $CO_2$ in the beverage (level of carbonation, which is directly related to water temperature). In a soda fountain, these ratios are set using valves and pumps that determine how much $CO_2$ and concentrates are released into the water. Typically, these pumps and valves are set manually.

Many soda fountains struggle with quality and consistency because the quantity of soda and $CO_2$ that gets released remains constant so that the ultimate ratio of the drink varies depending on the volume and temperature of water on a given day. In most buildings, the temperature, flow rate, and pressure of water is constantly changing throughout the day—depending on factors like the ambient/air temperature, what other appliances are drawing water, etc. Because concentrate and $CO_2$ settings are static, and do not vary based on the temperature, flow rate, and pressure of water, the drinks produced in a traditional soda machine vary widely in quality.

In some implementations, the systems and techniques that we describe below use sensors to collect real-time data on incoming water. By recording the temperature and flow rate, pump/valve settings can be changed to adjust for changes in the condition of incoming water. For example, $CO_2$ doesn't dissolve into water as easily at high temperatures, so when incoming water temperatures are higher, the system releases more $CO_2$ into the water and increases the temperature of the chiller.

In the systems and techniques that we describe below, settings may also be based on user feedback; for example, if a customer service team is told that flavors taste too strong/weak, adjustments may be made over the Internet in under a minute, as opposed to sending a technician onsite.

By comparison, other sophisticated vending machines like the Coca-Cola Freestyle and the Pepsi Spire, which may track inventory, maintain static settings. The focus of such machines is pulling data for logistics purposes and customer analysis, rather than adapting to data. Such systems generally require that staff be on hand to provide hands-on support. Such systems cannot increase or decrease flavor or $CO_2$ strength remotely. The unique remote management abilities of the systems and techniques that we describe below mean that the dispensers can operate with low costs and remain profitable.

SUMMARY

In general, in an aspect, the signal is received from a manually operated switch indicating a carbonation level of a beverage to be dispensed. In response to the signal, a digital pressure regulator associated with a supply of $CO_2$ or a ratio of still water and carbonated water flowing to a dispensing orifice, or both, is controlled to dispense the beverage at the indicated carbonation level.

Implementations can include one or a combination of two or more of the following features. The manually operated switch includes a portion of a touch screen. The signal from the manually operated switch is indicative of a carbonation level on an arbitrary scale, and the method includes mapping the carbonation level from the arbitrary scale to a parameter representing a pressure at the digital pressure regulator or two relative degrees of valve openings for flows of the still water and the carbonated water. The mapping changes to reflect information about previous beverages dispensed, including. The mapping changes to reflect updated information about preferences of consumers of dispensed beverages.

In general, in an aspect, a signal is received from a manually operated switch indicating a strength of a flavor of a beverage to be dispensed. In response to the signal, operation of a peristaltic pump is controlled to withdraw from a concentrated supply of an additive associated with the flavor, the additive being withdrawn at a rate to achieve the indicated strength relative to a rate of flow of a base liquid of the beverage.

Implementations can include one or a combination of two or more of the following features. The manually operated switch includes a portion of a touch screen. The signal from the manually operated switch is indicative of a flavor strength on an arbitrary scale, and the method includes mapping the flavor strength from the arbitrary scale to a parameter representing a speed of operation of the peristaltic pump. The mapping changes to reflect information about previous beverages dispensed. The mapping changes to reflect updated information about preferences of consumers of dispensed beverages.

In general, in an aspect, a signal is received from a manually operated switch indicative of an operation of the switch associated with a dispensing of a beverage. Characteristics of the signal from the manually operated switch are analyzed to determine if the switch was not actually operated manually. If it is determined that the switch was not been manually operated, the beverage is at least temporarily not dispensed.

Implementations can include one or a combination of two or more of the following features. The manually operated switch includes a portion of the touchscreen. The touchscreen includes a sensitive, soft touch touchscreen. The characteristics of the signal that are analyzed include at least one of timing, force, location, repetition, and duration.

In general, in an aspect, a first signal is received from a manually operated switch indicative of an applicable level of a first characteristic of beverages to be dispensed. The storage is updated to reflect the applicable level of the first characteristic as indicated by the received signal. A second signal is received from any one of two or more manually operated selection switches that correspond to selections of a second, different characteristic of beverages to be dispensed. Until the applicable level is again updated, any receipt of the second signal from any of the manually operated selection switches is responded to by dispensing a beverage that has the applicable level of the first characteristic and the corresponding second, different characteristic.

Implementations can include one or a combination of two or more of the following features. The first characteristic includes carbonation. The second characteristic includes a flavor and the two or more manually operated selection switches correspond to different flavors. The method of claim in which at least one of the manually operated switches were manually operated selection switches includes a portion of a touch screen. The method of claim including. receiving a subsequent first signal from the manually operated switch indicative of a different applicable level of the first characteristic of beverages to be dispensed, updating the storage device the applicable level of the first characteristic as indicated by the received subsequent first signal, until the applicable level is again updated, respond to the receipt of the second signal from any of the manually operated by dispensing a beverage that has the applicable level of the first characteristic and the corresponding second, different characteristic.

In general, in an aspect, a main passage of a beverage dispenser has (a) an inlet end where a base liquid for a beverage is to be received from a base liquid tube of the beverage dispenser and (b) an outlet end where the base liquid is to be dispensed through air towards a consumption container. The base liquid flows along a dispensing path from the inlet to the consumption container. Two or more outlets of additive tubes of the beverage dispenser open at different locations to eject different additives selectively and separately into the dispensing path to mix with the base liquid at a location that is outside of the base liquid tube and outside the additive tubes to form a beverage in the consumption container.

Implementations can include one or a combination of two or more of the following features. The main passage has a central axis aligned with the dispensing path and the outlets of the additive tubes have axes that are oriented to intersect the central axis of the main passage. The main passage has a central axis aligned with the dispensing path and the outlets of the additive tubes have axes that are oriented other than parallel to the central axis. The main passage has a central axis aligned with the dispensing path and the outlets of the additive tubes have axes that are oriented other than perpendicular to the central axis, The main passage has a central axis aligned with the dispensing path and the outlets of the additive tubes have axes that intersect the central axis at an angle of 45°. A control device is used to cause flow of the base liquid for the beverage to begin and causes flow of one or more additives from the outlets of the additive tubes to begin only after the base liquid has begun to flow along the dispensing path. A control device causes flow from any of the outlets of the additive tubes to stop and causes flow of the base liquid for the beverage to stop only after the ejecting of the additives has stopped. The pressure devices cause the additives to be ejected in pressurized streams across the dispensing path. The outlets are arranged around a circle centered on a central axis of the dispensing path. A light source is oriented to illuminate at least part of the base liquid as it moves along the dispensing path. A characteristic of light from the light source corresponds to a characteristic of the beverage. The characteristic of the light is at least one of color, intensity, direction, and timing, and the characteristic of the beverage is at least one of flavor, temperature, and level of carbonation.

In general, in an aspect, there are locations in a beverage dispenser for housing replaceable containers of concentrates of additives to be added to base liquids in dispensing beverages. Devices enable a determination of a type of each replacement container of concentrate that is newly housed in one of the locations of the beverage dispenser. Each type of replacement container is associated with a default weight. A wireless communicator reports information indicative of the default weight of each replacement container to a central server. Devices measure parameters related to the dispensing of beverages that include additives. The wireless communicator reports information indicative of the dispensing of beverages to the central server.

Implementations can include one or a combination of two or more of the following features. The devices measure parameters that include the amount of time during which each of the beverages was dispensed. The devices measure parameters that represent the operation of pumps that pump additives into dispensed beverages. The devices measure parameters that represent duty cycles of the pumps. The information reported to the central server is sufficient for determining a current weight of each of the replacement containers after each beverage has been dispensed.

In general, in an aspect, tubes in a beverage dispenser conduct base liquids to a dispensing orifice as part of the dispensing of beverages into consumption containers. There are tubes to conduct additives from containers of the additives for mixing with the base liquids as part of the dispensing of the beverages into the consumption containers. Peristaltic pumps pump controlled amounts of additives through the tubes as part of the dispensing of the beverages into the consumption containers.

Implementations can include one or a combination of two or more of the following features. A controller controls operation of the peristaltic pumps to dispense precise amounts of the additives. The controller controls the speeds of the peristaltic pumps based on predetermined relationships between speeds and amounts pumped.

In general, in an aspect, a beverage dispensing includes manual switches that correspond to respective characteristics of beverages to be dispensed. A controller disables each of the manual switches if supplies of components to be included in dispensed beverages corresponding to the manual switch are insufficient.

The characteristics of the beverages include one of carbonation level or flavor. Each of the manual switches includes a portion of a touch screen. The controller disables each of the manual switches in response to information representing the sufficiency of the supplies of the components. The information is received from a central server.

In general, in an aspect, there is a filter at each of a number of beverage dispensers to filter water from a public water source prior to using the water in dispensing beverages. Each of the filters has a time for replacement as it becomes clogged with non-water components that it filters from the water of the public water source. A detector at each of the dispensers determines when a beverage is dispensed. A process determines the replacement time for each of the filters in each of the dispensers based on the dispensing of beverages detected at the dispensers and on a factor related to a location of the dispenser to which the filter belongs. A communicator signals that a replacement time has been reached.

Implementations can include one or a combination of two or more of the following features. The factor related to the location for a given dispenser is based on replacement times for other dispensers that receive water from the same public water source. The signal is communicated to a party that is responsible to service the given dispenser.

In general, in an aspect, a sensor measures time periods required for dispensing beverages from each of the beverage dispensers. A process estimates an expected volume of a beverage dispensed from each of the beverage dispensers. A process detects increases in the time periods required in each of the beverage dispensers to dispense a beverage beginning after a replacement water filter has been installed in the dispenser. A process determines when the time period exceeds a predetermined threshold for a given beverage dispenser, that the replacement time has been reached. A regulator regulates the water pressure at an exit of each of the filters. A monitor detects changes in water pressure at the exit of each of the filters. A process determines that the replacement time has been reached based on the changes detected by the monitor.

In general, in an aspect, beverage dispenser apparatus includes a device to detect a weight of a depletable supply of CO2 in a beverage dispenser. A communicator reports the weight to a central server.

Implementations can include one or a combination of two or more of the following features. The supply includes a tank of CO2 and the device includes a digital scale on which the CO2 tank rests.

In general, in an aspect, a beverage dispenser apparatus including a chilling tank to contain a chilled fluid, a circulating tube to withdraw the chilled fluid from the tank and return it to the tank, the circulating tube being in proximity to a component tube that is to carry a component to be included in beverages to be dispensed.

Implementations can include one or a combination of two or more of the following features. The component tube carries CO2. The component tube carries the flavor concentrate. The circulating tube is in contact with the component tube. The circulating tube is in contact with and in parallel with the component tube along a length of the component tube. The circulating tube or another circulating tube is in contact with another component tube that is to carry another component to be included in beverages to be dispensed.

In general, in an aspect, a beverage dispenser apparatus includes a central server that receives and maintains information received from beverage dispensers by wireless communication. The information includes the identities, locations, states, and responsible parties for the dispensers. A Web server serves information to the responsible parties through web browsers, the served information including at least a portion of the information maintained by the central server. An access control process enables each of the responsible parties to have access through web browsers only to the served information for dispensers for which they are responsible.

In general, in an aspect, a beverage dispensing system includes a plurality of concentrate supplies that are provided for selection by a user. The concentrate supplies are provided by supply lines to a collection conduit. The collection conduit is coupled to a water source line and an output dispenser such that the water source line flushes the collection conduit when water is dispensed through the collection conduit.

Implementations can include one or a combination of two or more of the following features. The concentrate includes any of a flavor, vitamins, electrolytes, caffeine, memory supplements, sweetness, and herbs or spices. The beverage dispensing system includes a nozzle that provides water via a first annular path, and concentrate via a path that is positioned within the first annular path. The beverage dispensing system includes peristaltic pumps for providing concentrate from the concentrate supplies.

In general, in an aspect, a beverage is provided at a beverage dispensing system by steps that include: providing water via a first path to a dispensing station; providing a concentrate via a second path to a dispensing station; and providing water as a flush along the second path to flush out remaining concentrate.

Implementations can include one or a combination of two or more of the following features. The first path at the dispensing station leads to an annular opening in a nozzle. The second path at the dispensing station leads to an opening that is central to the annular opening. The flush path includes a flush valve that is only activated when a concentrate is selected. The flush valve is activated responsive to a user releasing a selection icon. Carbonated water is provided along the first path to the dispensing station.

In general, in an aspect, and interface system for a beverage dispensing system includes: a) a selection system by which a user may select a beverage to be provided in one of a plurality of options; and b) a dispensing system for providing the beverage in accordance with the selected options.

Implementations can include one or a combination of two or more of the following features. The options include adding an amount of a concentrate and adding an amount of CO2. The selection system includes a touchscreen interface. The touchscreen interface includes images of bubbles that appear on the touchscreen interface. A selected option applies to all flavors provided by the beverage dispensing system. A selection concentrate option applies to a single concentrate only. A selected option includes setting a temperature of a beverage. A selected option includes setting a temperature of all beverages. The selection system includes a touchscreen input device that shows graphics in shades of red to blue. The options include the addition of any of vitamins, electrolytes, caffeine, memory supplements, sweetness, and herbs or spices. The selection system includes a touchscreen input device that provides for input through circular motion, slide motion, dial motion or on/off toggle switch motion.

In general, in an aspect, a selected beverage is caused to be dispensed by steps that include: selecting from a plurality of options, a beverage, including a beverage concentrate and carbonation; and selecting an amount of the beverage concentrate.

Implementations can include one or a combination of two or more of the following features. The method includes the step of selecting an amount of carbonation. The method includes the step of changing all carbonation for all options independent of selecting a concentrate. The method includes the step of changing a temperature of a beverage to be dispensed. The method includes the step of displaying different colors on a beverage dispensing unit responsive to a selected temperature. The method includes the step of selecting any of vitamins, electrolytes, caffeine supplements, memory supplements, sweetness and herbs/spices. The step of selecting an amount of a concentrate includes the step of moving a finger in an arc motion. The step of selecting an amount of a concentrate includes the step of moving a finger in a circular motion. A determination is made whether a selected combination of concentrate, sweetness and carbonation is permitted.

In general, in an aspect, a beverage inventory status system includes: a) a storage component configured to store first information pertaining to a plurality of beverage components present in a beverage dispensing device; and second information pertaining to a plurality of beverage dispensing devices; and b) a processor configured to transmit at least a portion of the first information to one or more electronic devices associated with the second information, the transmitted portions enabling an inventory management agent associated with the beverage dispensing device, via the agent's electronic device, to the inventory status of at least one beverage dispensing device.

Implementations can include one or a combination of two or more of the following features. The first information includes, for each beverage component, at least one characteristic selected from the group consisting of: component weight, component volume, and component freshness. The one or more electronic devices include a handheld electronic device. The one or more electronic devices are present in a beverage dispensing device. The processor transmits at least a portion of the first information via a wireless communication network. The status system includes a means for identification of a beverage dispensing device in need of service. The status system includes a means for replenishment of at least one beverage component.

In general, in an aspect, a system for automated beverage dispensing device management includes at least two beverage dispensing devices each including a storage component configured to store first information pertaining to a plurality of beverage components present in the beverage dispensing device in wireless communication with a processor configured to transmit at least a portion of the first information to at least one electronic device, the transmitted portions enabling an inventory management agent associated with the beverage dispensing device, via the agent's electronic device, to manage at least one beverage component in at least one beverage dispensing device.

Implementations can include one or a combination of two or more of the following features. The first information includes, for each beverage component, at least one characteristic selected from the group consisting of: component weight, component volume, and component freshness.

In general, in an aspect, a beverage dispensing unit management system includes a central processor in communication with a plurality of beverage dispensing units, each beverage dispensing unit including a local processor and a plurality of sensors, each of which provides sensor output data regarding the status of the beverage dispensing unit, wherein the sensor output data is provided to the local processor and to the central processor for each of the plurality of beverage dispensing units, and wherein the central processor is adapted to provide control signals to each beverage dispensing unit that control dispensing devices within each respective beverage dispensing unit.

Implementations can include one or a combination of two or more of the following features. The central processor provides control signals to each beverage dispensing unit that control dispensing devices within each respective beverage dispensing unit such that each beverage dispensing device may provide uniform dispensed beverages among the plurality of beverage dispensing units irrespective of input water temperature at each of the beverage dispensing units. The sensor output data includes data representative of any of weight, pressure, temperature, flow volume and flow rate of any of materials within the respective beverage dispensing unit. The sensor output data includes data representative of weight of a CO2 cartridge. The sensor output data includes data representative of water pressure. The sensor output data includes data representative of peristaltic pump pressure. The sensor output data includes data representative of inlet water temperature. The sensor output data includes data representative of flow volume as determined by monitoring flow rate over a known period of time. The sensor output data is provided to the central processor at regular intervals. The central processor is configured to adjust controls within the beverage dispensing unit of any of temperature, flow rate and flow time of materials within the beverage dispensing unit. Each beverage dispensing unit includes an input device that permits a user to adjust any of temperature, flow rate and flow time of materials with the respective beverage dispensing unit. Any adjustment of temperature, flow rate and flow time of materials within the respective beverage dispensing unit, is recorded and data regarding such adjustment is provided to the central processor.

In general, in an aspect, a beverage dispensing unit management system includes a central processor in communication with a plurality of beverage dispensing units, each beverage dispensing unit including a local processor and a plurality of sensors, each of which provides sensor output data regarding the status of the beverage dispensing unit, wherein the sensor output data is provided to the local processor for each of the plurality of beverage dispensing units, and wherein each beverage dispensing unit permits users to enter dispensing request information to each beverage dispensing unit.

Implementations can include one or a combination of two or more of the following features. The dispensing request information overrides previously programmed dispensing control commands. The dispensing request information involves a requested relative amount of a concentrate. The requested relative amount of a concentrate is input to a respective beverage dispensing unit by a user rotating a finger on a touch screen in one of clockwise or counterclockwise directions. The dispensing request information is provided to the central processor for each beverage dispensing unit.

In general, in an aspect, a beverage dispensing unit management system includes a central processor in communication with a plurality of beverage dispensing units, each beverage dispensing unit including a local processor and a plurality of sensors, each of which provides sensor output data regarding the status of the beverage dispensing unit, wherein the sensor output data is provided to the local processor for each of the plurality of beverage dispensing units and for each beverage dispensed at each beverage dispensing unit together with location data regarding each beverage dispensing unit such that each beverage dispensing unit may provide to a user information regarding other nearby beverage dispensing units.

Implementations can include one or a combination of two or more of the following features. The information regarding other nearby beverage dispensing units is provided responsive to a request by the user for a concentrate that is depleted at the beverage dispensing unit. Each beverage dispensing unit provides any of flavor concentrates, vitamin concentrates and nutrient concentrates. Each beverage dispensing unit permits a user to adjust an amount of carbonation. The beverage dispensing unit management system provides that operational adjustments may be made to each beverage dispensing unit remotely. The operational adjustments include adjusting any of water temperature, water pressure, amount of carbonation and amount of a concentrate. The operational adjustments including adjusting control signals to peristaltic pumps at a beverage dispensing unit responsive to feedback from another beverage dispensing unit. The beverage dispensing unit adjusts a duty cycle of a control signal for the peristaltic pumps.

Other aspects, implementations, features, and advantages, and combinations of them, can be expressed as methods, apparatus, systems, components, means and steps for performing the function, program products, software, business methods, and in other ways.

Other aspects, features, implementations, and advantages will become apparent from the following description, and from the claims.

DESCRIPTION

FIGS. 1 through 6, 13, 23, 29, 31, and 32 are block diagrams.

FIGS. 7, 8, 27, and 28 are fluidics diagrams.

Figure 9:
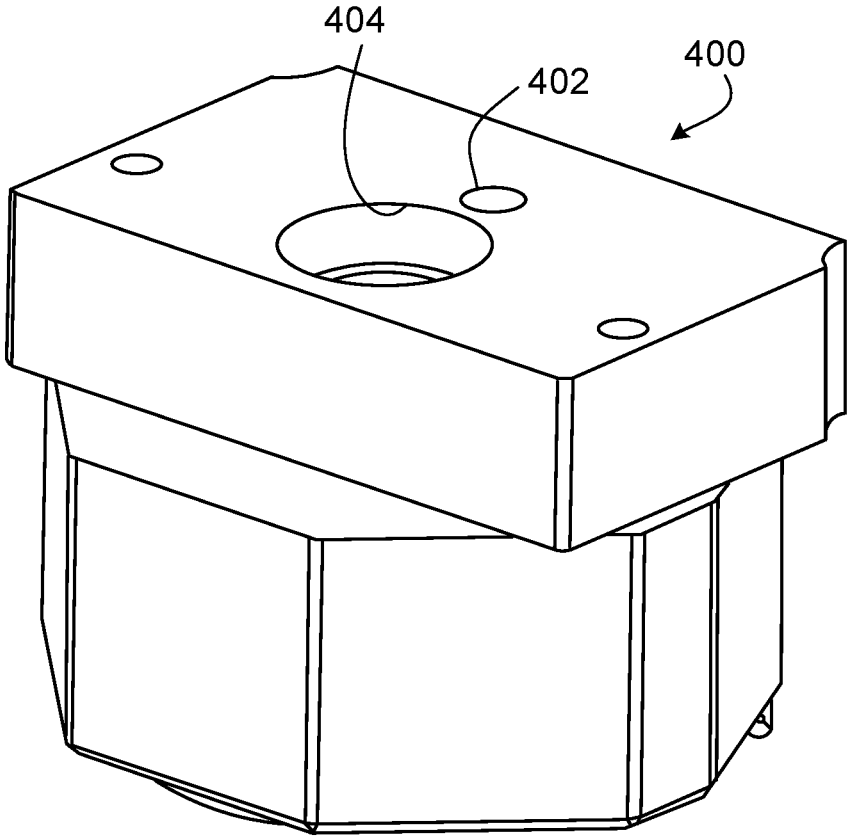
Figure 10:
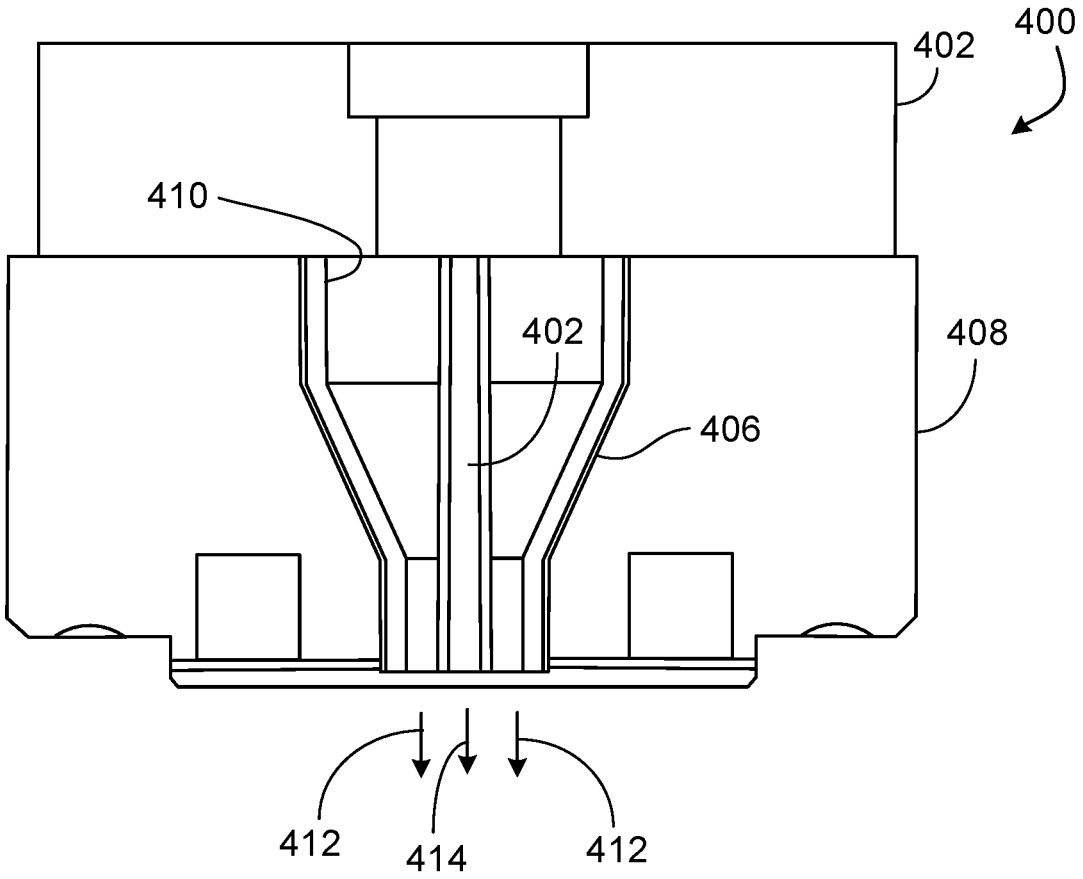
Figure 11:
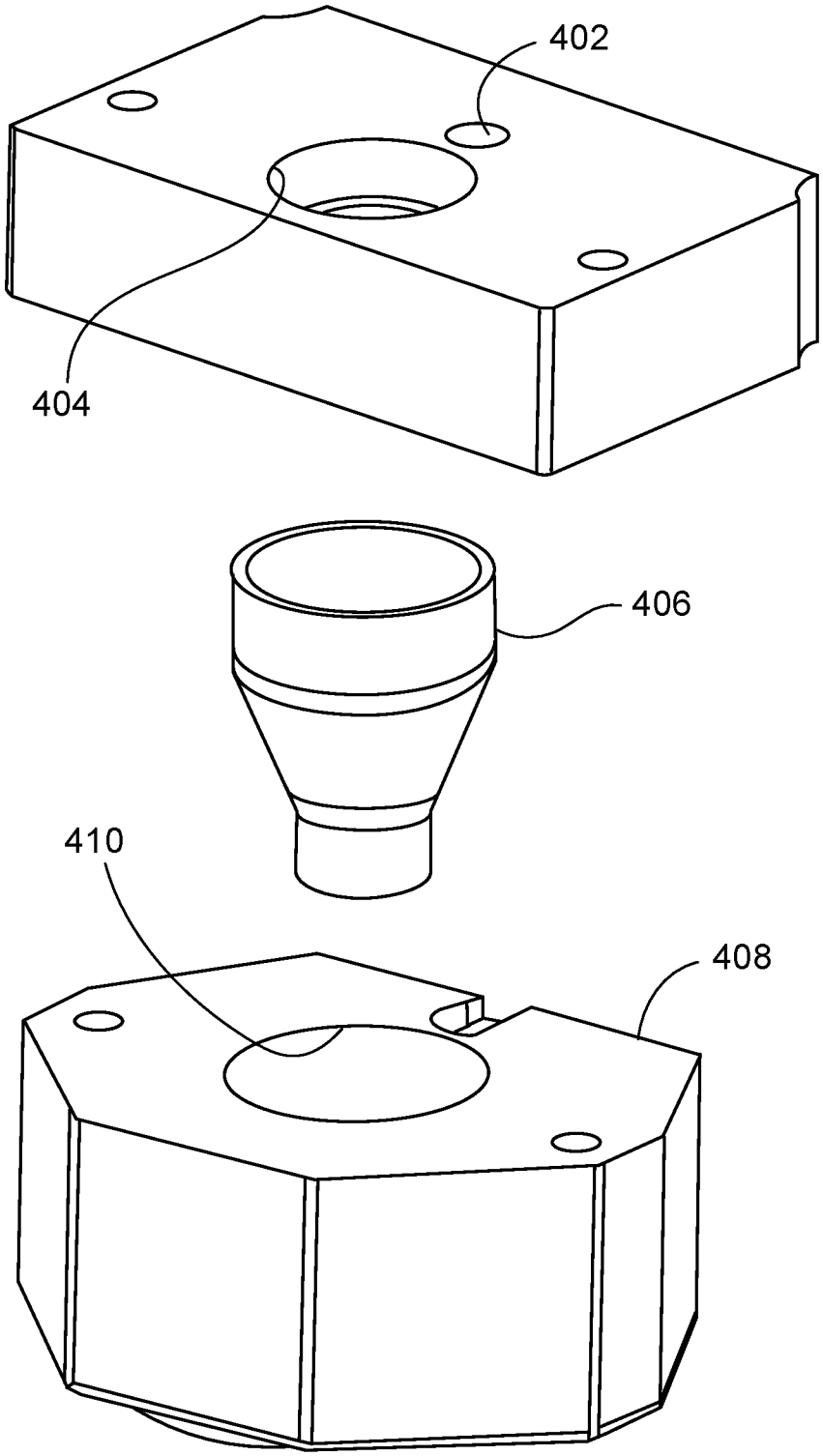

FIGS. 9, 10, and 11 are perspective, side sectional and exploded perspective views of a nozzle assembly.

Figure 12:
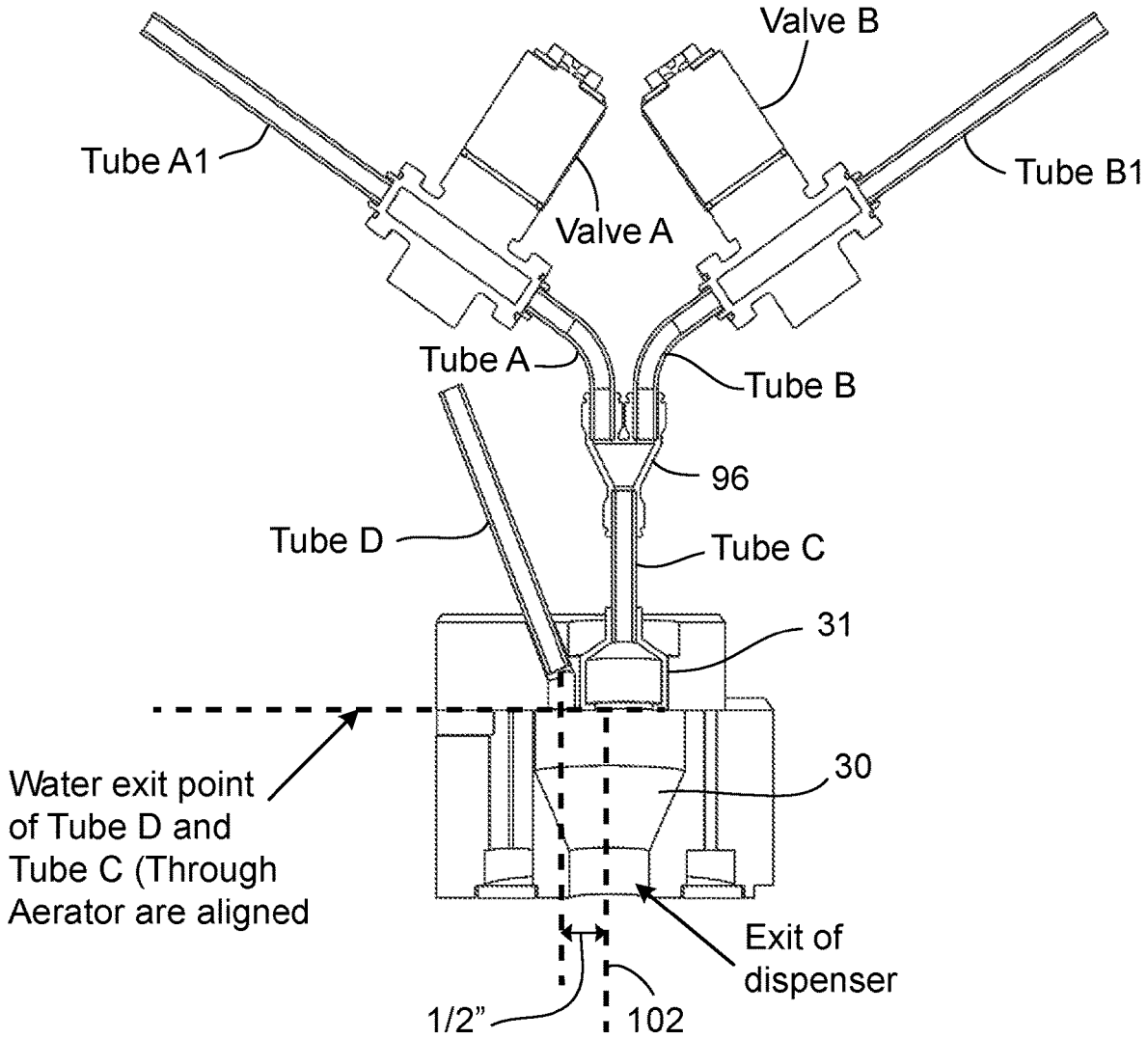
Figure 14:
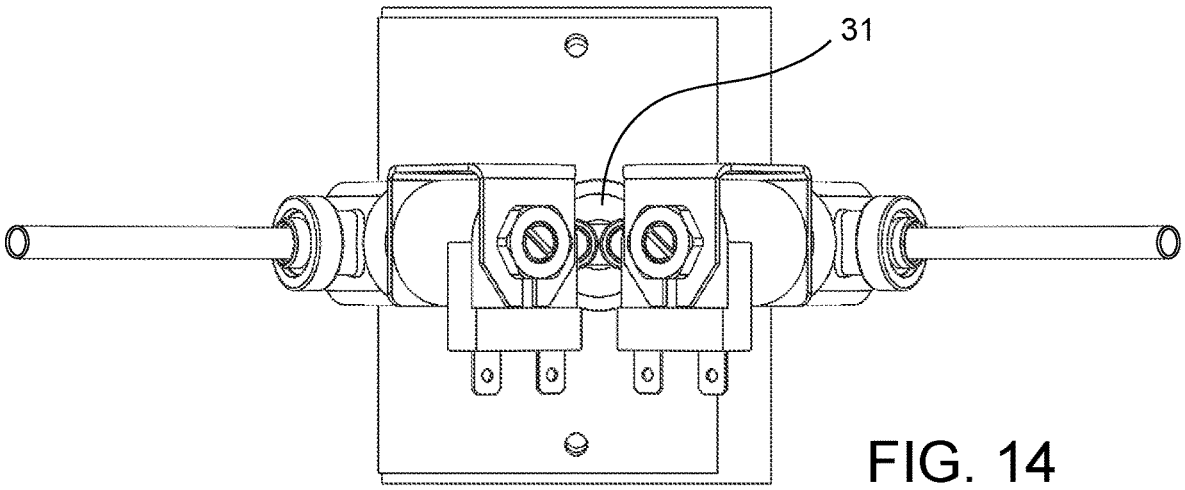
Figure 15:
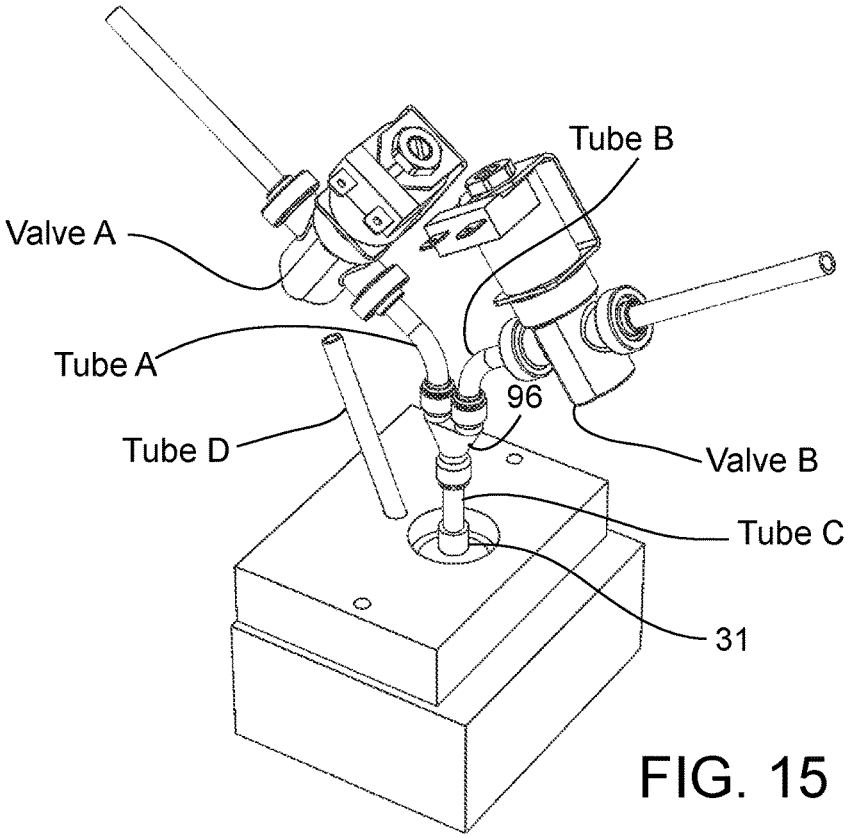

FIGS. 12, 14, and 15 are a side view, partially in section, a top view, and a perspective view of a nozzle and inlet tube assembly.

FIGS. 16, 17, 26, 34, and 35 are user interface displays.

FIGS. 18, 19, 20, 21, 22, 24, 30, and 33 are side perspective, bottom, sectional side, enlarged bottom, enlarged sectional side, and bottom perspective views of a nozzle assemble and light ring.

Figure 25A:
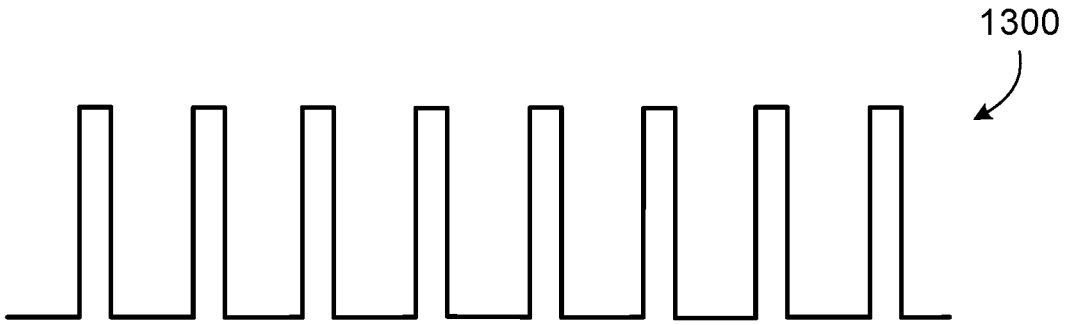
Figure 25B:
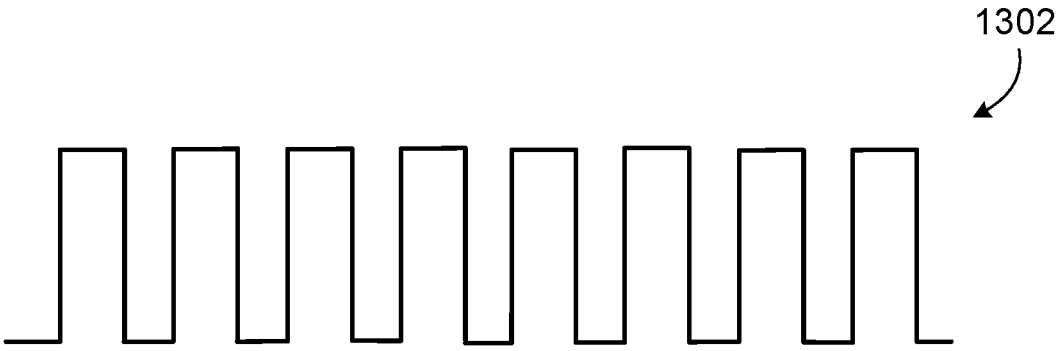
Figure 25C:
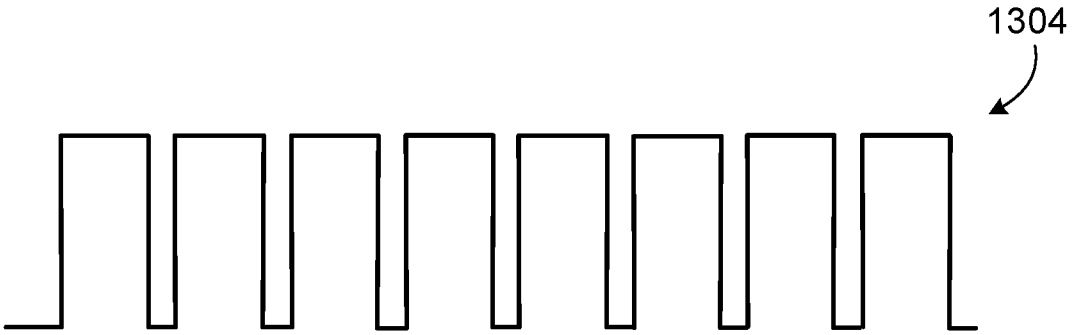

FIGS. 25A, 25B, and 25C are timing diagrams.

Here we describe systems and techniques related to dispensing beverages from beverage dispensers.

We use the term "beverage" broadly to include, for example, any liquid that can safely be ingested by a human being. Beverages include all kinds of drinks, such as water, soft drinks, flavored water, vitamin water, alcoholic drinks, drinks based on still water or carbonated water, and hot or cold drinks, to name a few.

We use the term "dispense" broadly to include, for example, any release of a volume of liquid from a nozzle or other "dispensing orifice" into a "consumption container" such as a glass, a cup, or a bottle, to name a few.

We use the term "beverage dispenser" broadly to include, for example, any device or machine that can be used for dispensing beverages, regardless of who owns the beverage dispenser, where it is located, who uses it, what kind of beverage is being dispensed, the context in which the beverage is dispensed, or who pays for the device or machine or for the beverages being dispensed.

In some examples of beverages that are to be dispensed using the systems and techniques that we describe, the beverage is nothing more than a "base liquid" such as still water or carbonated water or alcohol. In some instances, the beverages to be dispensed are a mixture or solution of such a base liquid and one or more other components, such as flavors, dyes, vitamins, or other additives.

We use the term "mixed beverage" broadly to include, for example, any beverage that is a mixture or solution of one or more base liquids with one or more additives, such as soft drinks, flavored water, alcoholic drinks, vitamin water, or caffeinated drinks, to name a few.

We use the term "additives" broadly to include, for example, any sweetened or unsweetened flavoring, dye, preservative, mixing agent, stabilizer, herb, vitamin, nutrient, or other element that can be safely ingested by a human being.

In some cases, the additives are stored within the beverage dispenser in a concentrated form (called a concentrate) and diluted within the beverage dispenser during the process of dispensing a beverage. The undiluted concentrates are typically liquid or viscous liquids or powders but could take other forms.

We use the term "concentrate" broadly, to include, for example, any concentrated form of an additive, such as viscous solutions of water with other ingredients such as pasteurized fruit, vegetables, and sugar, to name a few. To create a good-tasting drink for human consumption, concentrates typically are designed to be mixed with water or another base liquid at ratios of 1:1 or higher (for example, up to a dilution of one part concentrate to 20 parts water or to up to 200 parts of water or even more). Consumed alone, without additional water added, concentrates may taste too thick, too strong, or too sweet.

Typical beverage dispensers include a housing that contains supplies of base liquids and additives, a user interface (through which a user can learn information about beverages before, during, or after they are dispensed and can control the dispensing of the beverages), a dispensing orifice, valves, pumps, and other mechanical, fluid flow, and electrical equipment, and microprocessors and data storage. When a beverage is dispensed the beverage dispenser delivers the base liquid and the additives in, e.g., diluted or undiluted form, to the dispensing orifice and into a cup or other container for consumption.

We use the term "consumption container" broadly to include, for example any device that can receive and hold a dispensed beverage for use, such as a bottle, cup, mug, bag, glass, or bucket, to name a few.

We use the term "dispensing orifice" broadly to include, for example, any device that serves as an interface between the flow and processing of a beverage and its components within a beverage dispenser and the flow of the beverage and its components through the external environment and into the consumption container.

Our discussion includes discrete descriptions of a variety of features, systems, and techniques associated with beverage dispensing. Although we provide distinct descriptions of particular features, systems, and techniques, combinations of two or more of those features, systems, and techniques can be used in a broad variety of implementations associated with beverage dispensing.

As shown in FIG. 1, in some implementations, a volume of a base liquid or a mixed beverage 10 is dispensed into a glass or other consumption container 12 from a beverage dispenser 14. (Although we use the example of water frequently in our discussion, the base liquid could be other than water.) In the particular example shown in FIG. 1, the base liquid is tap water 16 that is drawn as needed from a conventional water main 18 in a building where the beverage dispenser is located. Any source of potable water could be used.

The water is passed from the water main through various components of the beverage dispenser by water pressure supplied from the water main or by a pump 18 or a combination of the two. The water passes through a filter 20 (after which the water temperature or pressure or both can be detected at an inlet detection device) and into a chiller/carbonator 22. From there the water passes into a liquid flow path 24 along which solenoid-operated valves 26 control the delivery of the concentrates. The water also is delivered at a higher flow rate towards a dispensing nozzle 30 (an example of a dispensing orifice) and (together with the concentrate) into a consumption container 12. The mixing of the concentrates and the higher flow rate water can occur in various ways and at various locations prior to, at or downstream of the dispensing orifice.

The additives 28 are delivered to the solenoid valves 26 for dilution by pumps 32 from bag-in-box (BIB) supplies 34 of, for example, concentrates. The operation of the pumps 32 and the solenoid valves 26 are controlled by control signals 37 sent from a microprocessor-based control board 36. The control board receives information from various components in the beverage dispenser and sends control signals to various components to cause an intended dispensing of a beverage.

Each of the concentrate BIBS has an associated flow sensor 38 that may sense and report to the control board the volume of flow along the corresponding flow path. In some embodiments, the volume of flow may be determined by knowing the flow rate at which the concentrate is dispensed and multiplying that rate by the time that a pump that is associated with a particular concentrate remains in the on (dispensing) position. As a result, the system can enable the user to select options that will provide a personalized beverage yet also will ensure consistency among all beverage dispensers providing beverages.

The control board 36 also communicates through a Bluetooth 38 interface with a microprocessor-based tablet 40 in order to coordinate their activities. (In some implementations, there could be a single microprocessor-based device that would substitute for the combination of the tablet and the control board.) The tablet 40 includes a touch sensitive display surface 41 for providing a user interface to a user and a Wi-Fi communication capability 42 for communication through the cloud 44 to a central server 46 among other capabilities. The touch sensitive display surface enables display of useful information to a user and receipt of instructions and selections from the user. A central database 45 is managed by the central server and used to provide a wide range of functions for the beverage dispensing system.

In some examples, the base liquid is carbonated water that is formed by mixing carbon dioxide from the CO2 tank 60 with water held in or flowing through the chiller/carbonator 22. The CO2 tank 60 rests on a load cell 62 that provides information to the control board for purposes of determining when reduction in the weight of the tank indicates that the tank needs to be replaced.

Many of the components shown in FIG. 1 are held within a sheet steel cabinet 16 that is shaped, sized, and decorated appropriately on the outside for consumer use.

Figure 2:
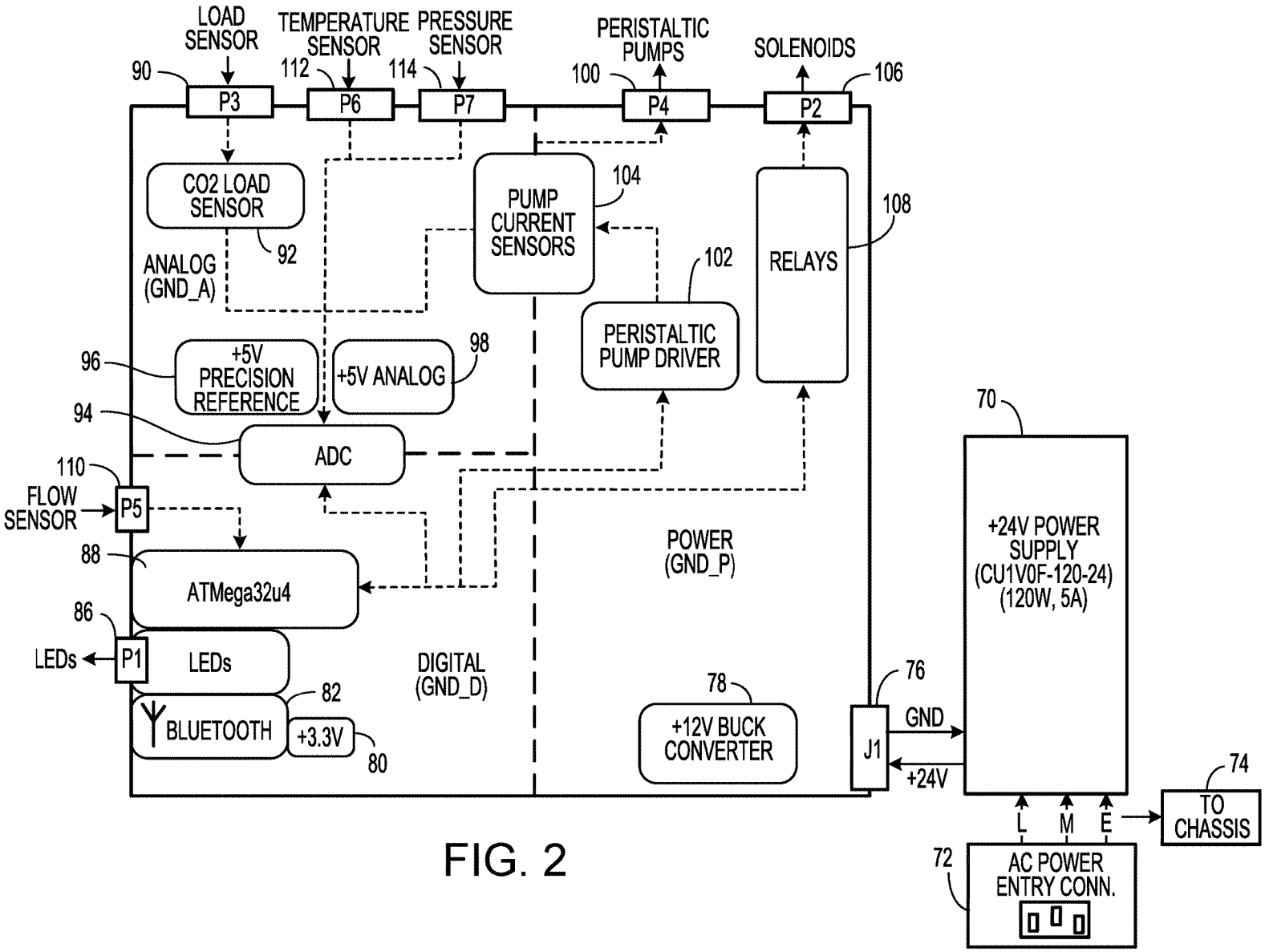

As shown in FIG. 2, in some implementations, the electrical power and control signaling devices and connections include a power supply 70, such as a 24-volt power supply (CUI, VOF-120-24, 120 W, 5 A) that is coupled to an AC power entry connector 72 (with ground being coupled to the chassis 74). The power supply 70 is connected to the beverage dispenser by a connector 76 and supplies power through a 12 v buck converter 78 to the beverage dispenser. A 3.3 volt supply 80 is also provided to a Bluetooth wireless device 82 and LED drivers 84 communicate through a connector 86 with LEDs. An ATMeg a32u4 microcontroller device 88 provides the local processor functionality and is an example of the control board 36.

A load sensor 92 is provided in connection with the CO2 supply through a coupling 90, and the output of the load sensor 92 is provided to the local processor through an analog to digital converter 94. A 5-volt precision reference 96 is also provided as well as a 5-volt analog signal 98 to ensure accuracy. Peristaltic pumps are also connected through a connector 100 to peristaltic pump drivers 102 and pump current sensors 104. Similarly, relays are connected with connectors 106 to relay drivers 108 that effect the dispensing of the concentrates. The system includes a flow sensor 110 that is coupled to the ATMeg a32u4 microcontroller device (the controller board of FIG. 1), a temperature sensor 112, and a pressure sensor 114 that are coupled to the ADC 94.

Figure 3:
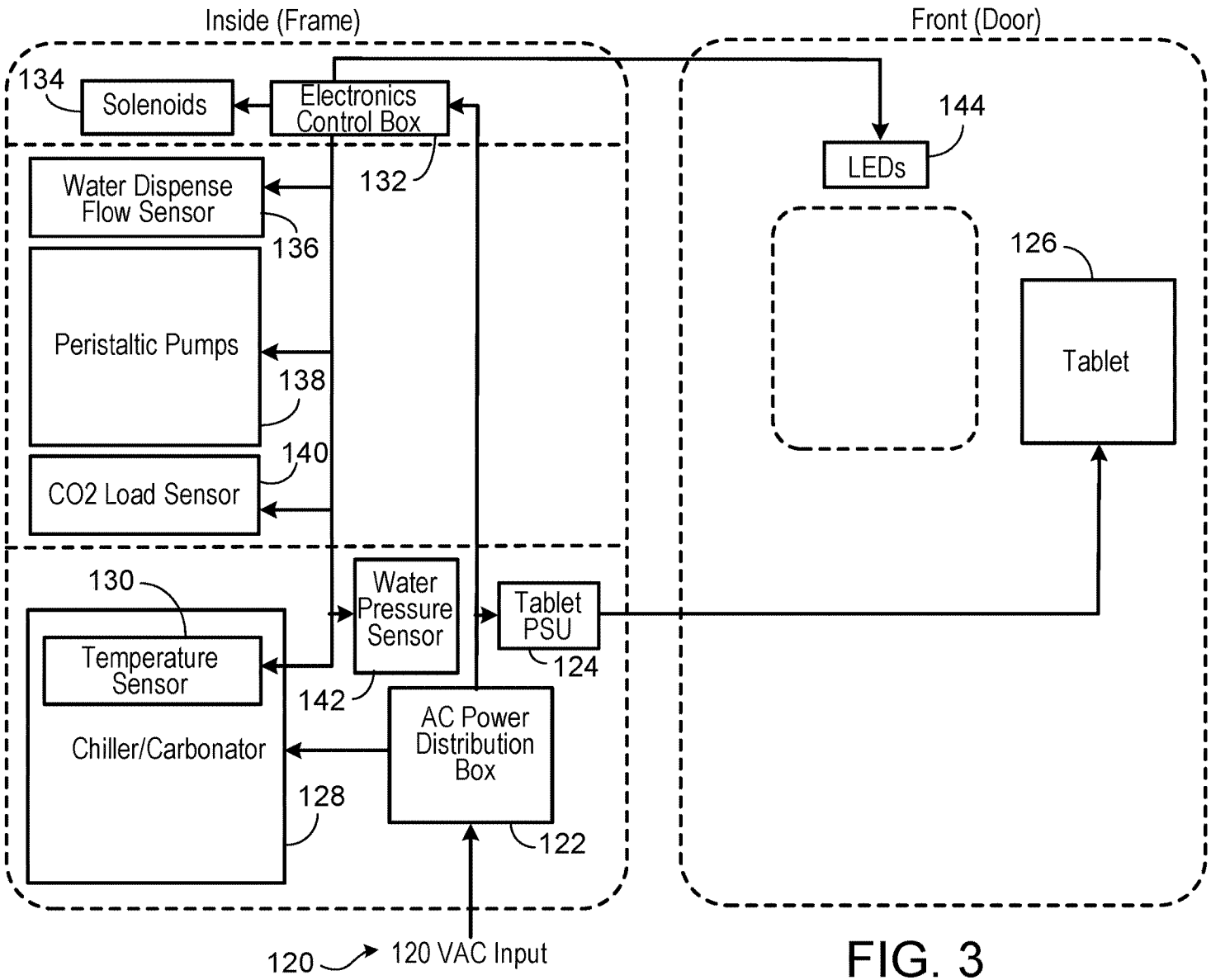

In some implementations, as show in FIG. 3, a power supply 120 such as a 120 VAC power supply is coupled to an AC power distribution box 122. The AC power distribution box 122 is connected to a tablet power supply unit 124 that is coupled to the tablet 126 (40 in FIG. 1). The AC power distribution box 122 is coupled to a chiller/carbonator 128 (22 in FIG. 1) that includes a temperature sensor 130 and is coupled to an electronics control box 132 (the control board of FIG. 1). The electronics control box 132 drives solenoids 134 (26 in FIG. 1) that control fluid flow and is coupled to a water dispense flow sensor 136 and to peristaltic pumps 138 (22 in FIG. 1) that control flow of the concentrates. The electronic control box 132 is also coupled to a CO2 load sensor 140 (62 in FIG. 1) a water pressure sensor 142, and LEDs 144 on a door of the beverage dispenser.

Figure 4:
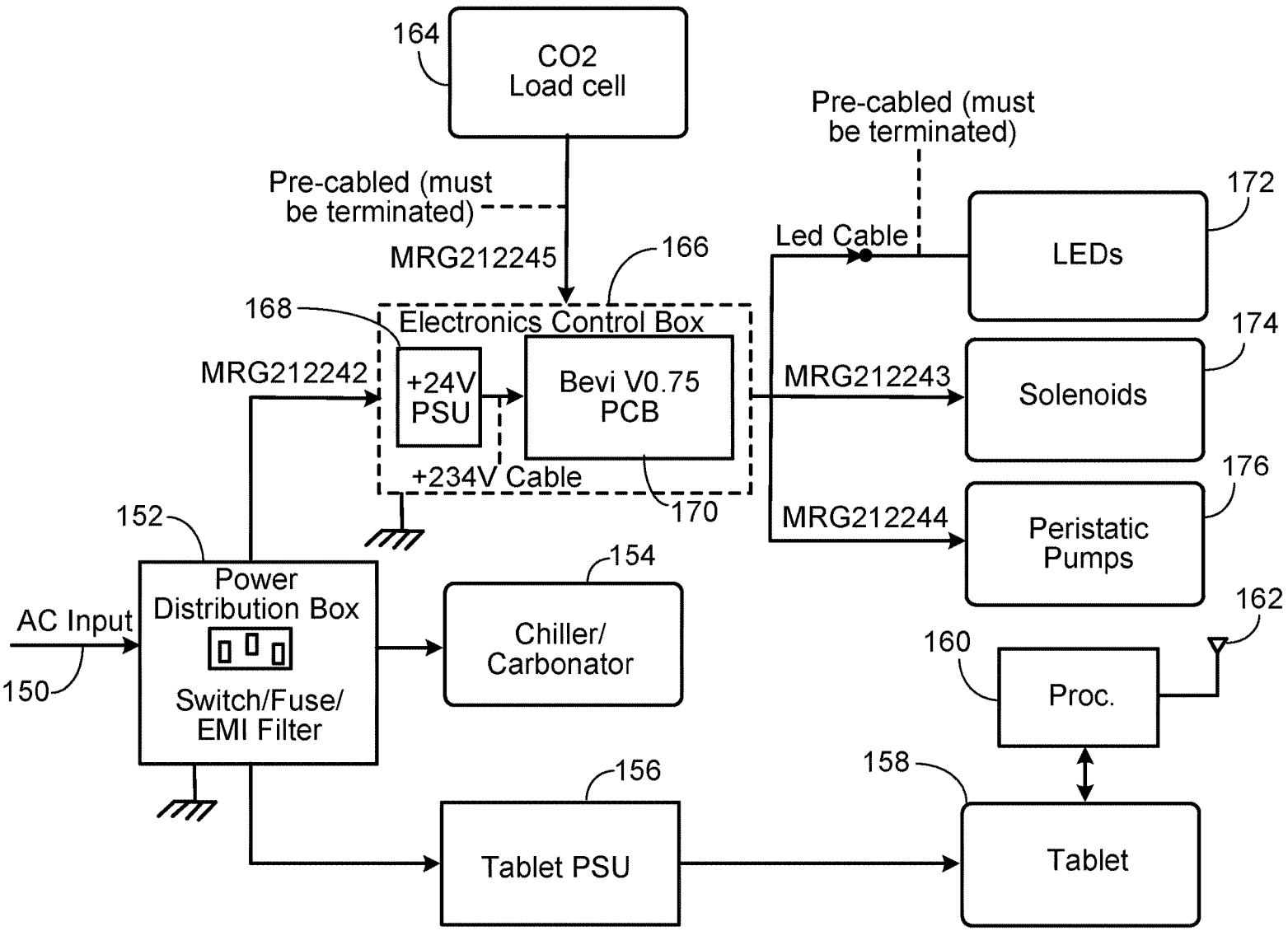

As shown in FIG. 4, in some examples, an electrical and electronics system for the beverage dispenser includes an AC input 150 (120 in FIG. 3) that is provided to a power distribution box 152 (122 in FIG. 3) that includes a switch, a fuse, an EMI, and a filter. Electrical power from the power distribution box 152 is provided to a chiller/carbonator 154 (128 in FIG. 3) and to a tablet processing unit 156 (124 in FIG. 3) that is in communication with a tablet 158 (126 in FIG. 3) and a unit processor 160 that includes an antenna 162 for wireless communication.

The power distribution unit 152 is also coupled to an electronics control box 166 (132 in FIG. 3) that is coupled to a CO2 load cell 164 (140 in FIG. 3). The electronics control box 166 includes a 24-volt power supply 168 (70 in FIG. 2) and a unit controller board 170 (36 in FIG. 1). The unit controller board is coupled to LEDs 172, as well as solenoids 174 (134 in FIG. 3) and peristaltic pumps 176 (138 in FIG. 3) to run the beverage dispenser.

Only one beverage dispenser is shown in detail in FIG. 1, but a wide variety and potentially a very large number of other beverage dispensers 15 can participate in the system.

These other beverage dispensers can be located in the same building or location as the beverage dispenser 14 or can be located in (and clustered at) a broad range of other locations. Each of the beverage dispensers 14 and 15 can have the ability to communicate by Wi-Fi or other wireless communication protocol through the cloud to the central server 46. The beverage dispensers also can be capable of communicating with one another through wireless or wired communication protocols to exchange information associated with beverage dispensing.

Although only one server 46 is shown in FIG. 1, additional servers can be provided to share the work of the server and different servers can be configured to perform respectively different tasks associated with the system and techniques that we describe here.

Figure 5:
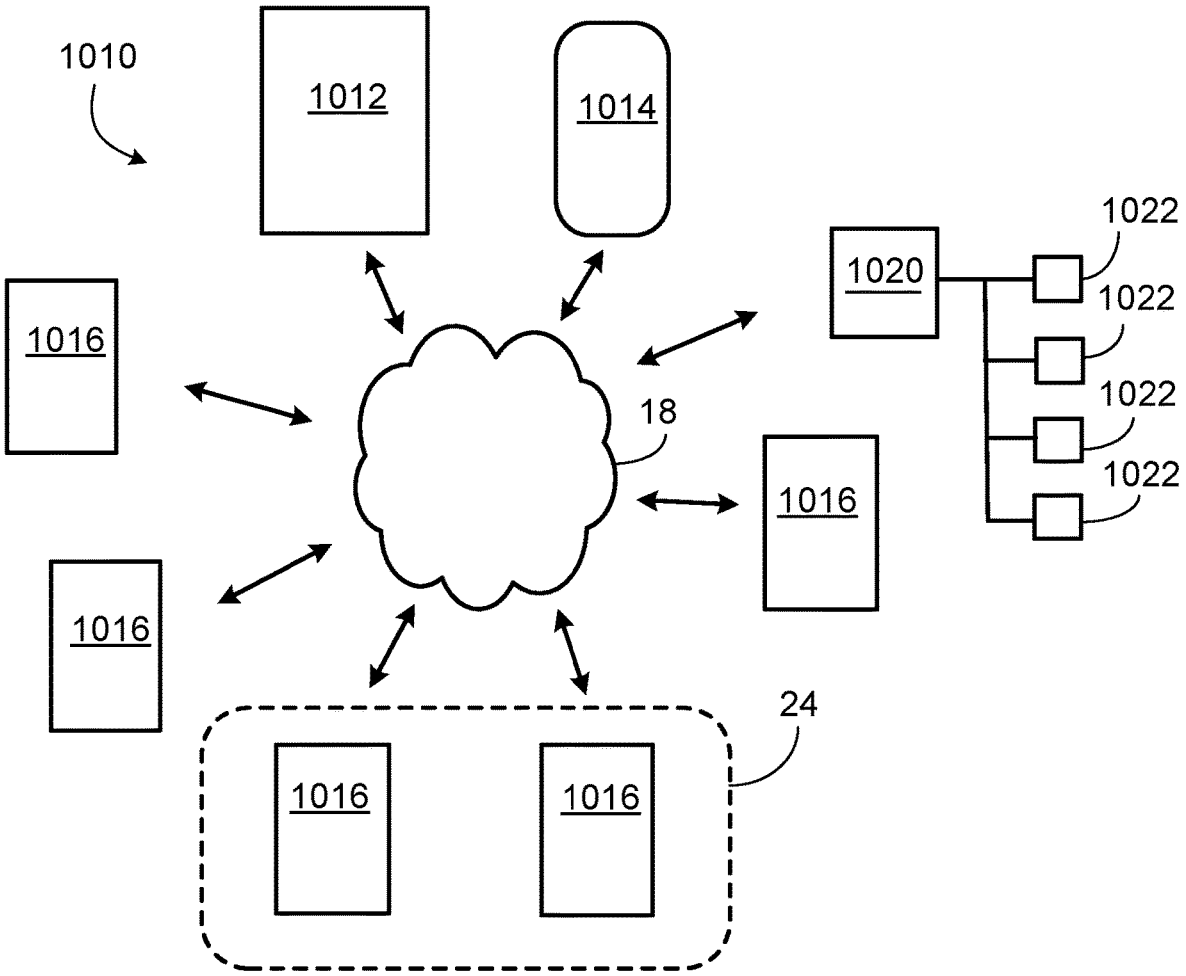

As shown in FIG. 5, in some implementations, a beverage dispensing system 1010 includes a central processor 1012 (46 in FIG. 1) and a data storage device 1014 (the central database of FIG. 1) that are in communication with beverage dispensers 1016 (14 and 15 in FIG. 1) through a network 1018 such as the Internet (44 in FIG. 1). The system 1010 also includes a supply management system 1020 that manages service providers 1022 that, among other things, maintain replenishment stocks for the beverage dispensers 1016.

In some cases, each beverage dispenser 1016 is calibrated from the central processor by activating calibration commands and checking associated sensor data. Each of the beverage dispensing units may be calibrated to provide uniform combinations of offered beverages, and in certain embodiments, this may involve adjusting certain settings within a beverage dispenser to provide consistent beverage products notwithstanding variations in inlet water temperature and/or pressure.

Figure 6:
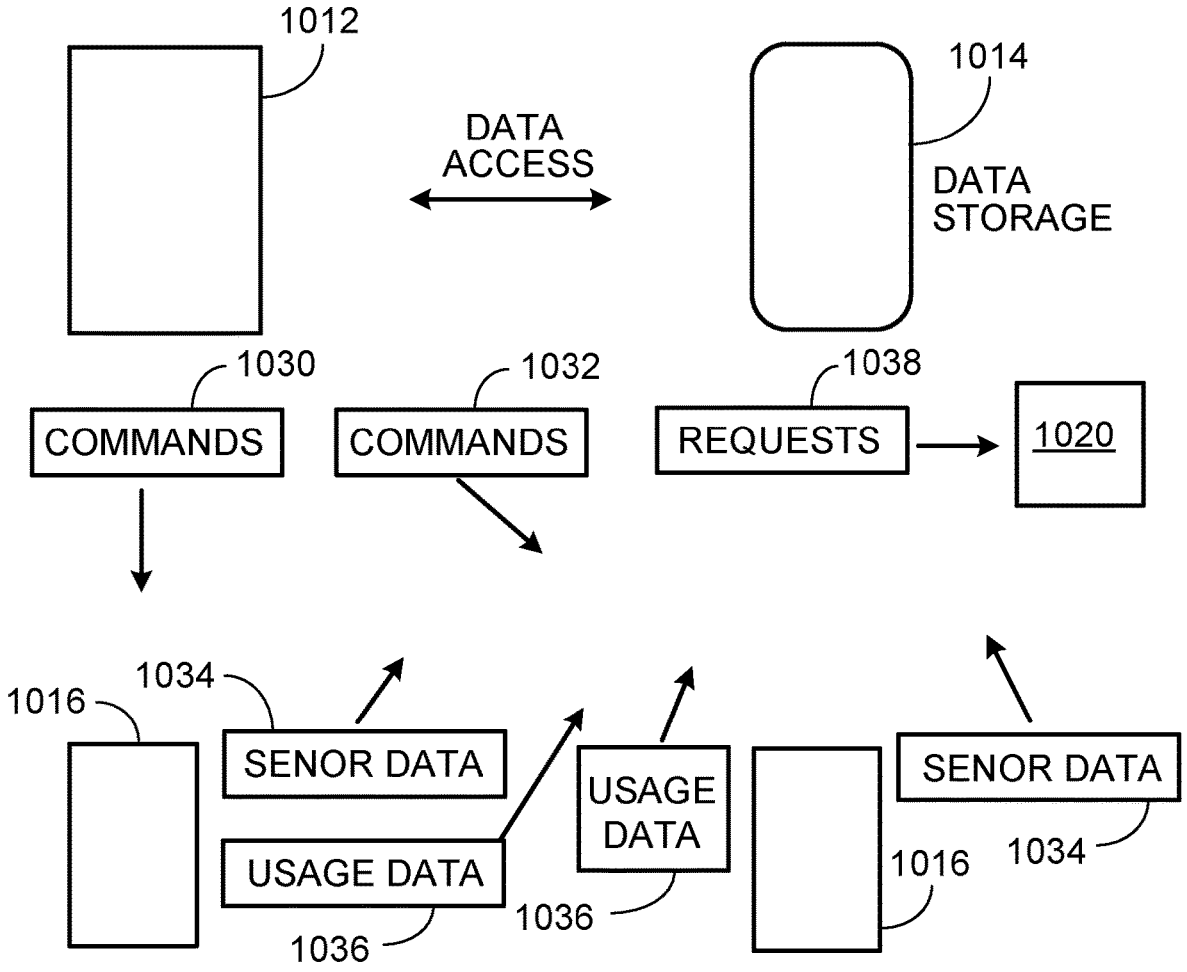

As shown in FIG. 6, in some implementations, in the flow of data and controls, each beverage dispenser 1016 includes a local computer (e.g., see 36 or 40 or both in FIG. 1) that operates the dispenser and is capable of receiving override commands 1030, 1032 from the central processor 1012. For each dispenser 1016, the local computer pushes sensor data 34 and usage data 36 for the dispenser to the data storage device 1014. The central processor may also provide stock requests to the supply management system 1020, or in certain embodiments, the stock requests may come directly from each unit 1016 that has a stocking need.

Each local processor may therefore, provide any of weight, pressure, temperature, flow rate and flow time information, the status of any batteries in the dispenser, and usage data, among other things. Such information is pushed on a regular basis, e.g., every five seconds, to the central processor 1012 and the data storage device 1014. In some implementations, the system may monitor sensor data to detect anomalies that may be indicative of imminent failures or fault conditions. In accordance with some implementations, the system may detect when a concentrate supply is depleted. The local processor may communicate with the central processor to determine whether another beverage dispenser that is nearby or within the same building may have the requested concentrate. FIG. 6 for example, shows two units 1016 that are within the same building or complex 1024. Because each dispenser is in communication with the central processor, the central processor includes information regarding the supplies and locations of each of the units.

The system therefore provides a continuous stream of data that is collected on every dispenser, and the system provides the ability to automatically use that data to improve the performance of each of the dispensers. The system is also able to collect data regarding the types of beverages that are most popular or not and correlate this data with a variety of parameters including time of day, location, and usage of other beverages.

Figure 7:
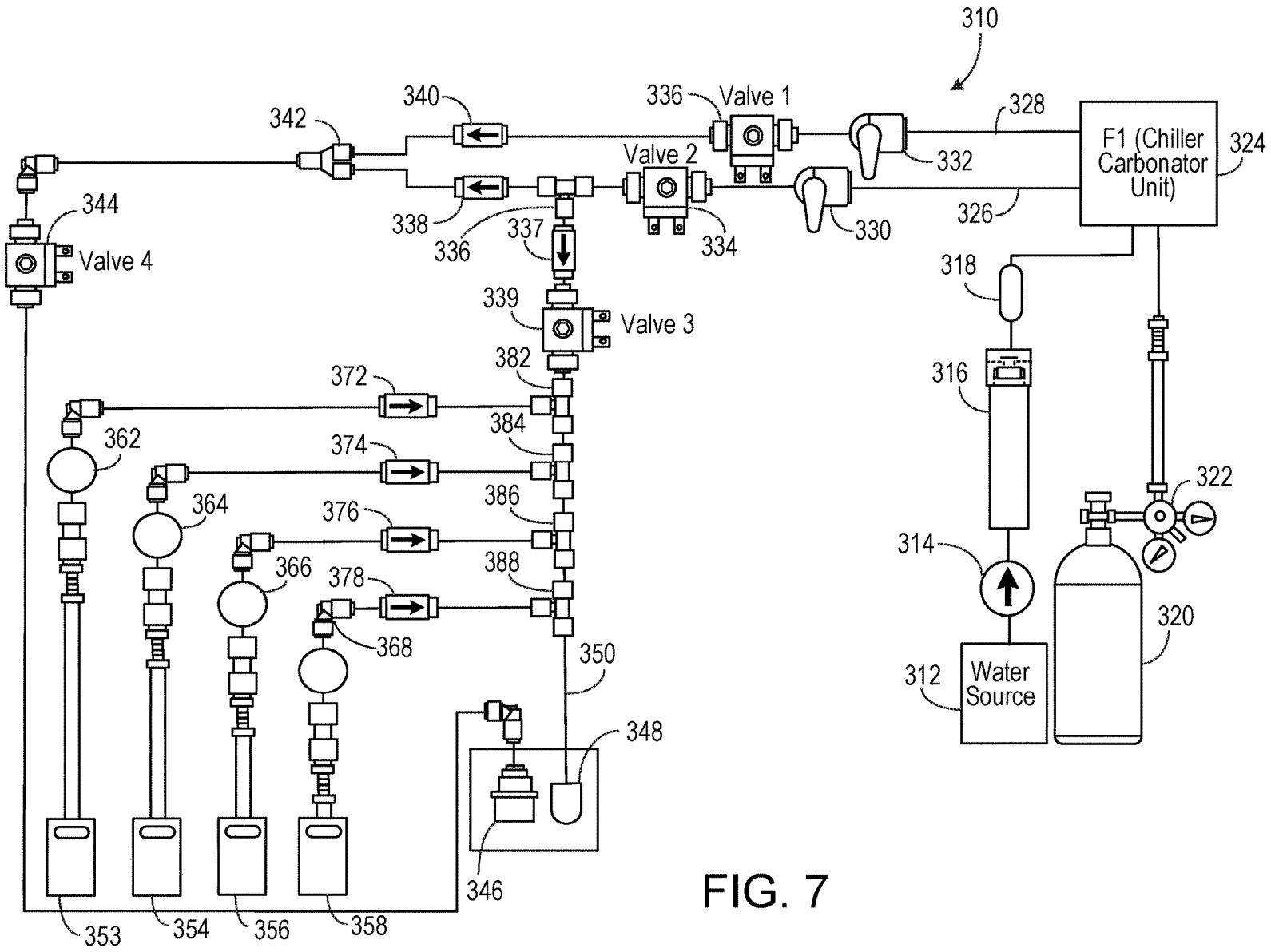

As shown in FIG. 7, in some implementations, the fluidic system 310 of a beverage dispenser includes a coupling to a water supply 312 (18 in FIG. 1) and a fluid flow path from the water supply through a check (one-way) valve 314, a filter 316 (20 in FIG. 1), and a pump 318 (18 in FIG. 1) to a chiller/carbonator unit 324 (22 in FIG. 1). The chiller carbonator unit also includes a CO2 tank 320 (60 in FIG. 1) and a pressure valve 322. The chiller carbonator unit 324 provides two outputs, a source of still water 326 and a source of carbonated water 328. The carbonated water line includes a shutoff valve 332 and a control valve 336 (valve 1). The still water line includes a shutoff valve 330 and a control valve 334 (valve 2). A T-coupling unit provides the still water to a check valve 337 in a flush path that includes a valve 339 (valve 3), as well as to another check valve 338 in the main supply path. The carbonated water is provided through a check valve 340 to a combining unit 342 that delivers either the carbonated water or the still water to a valve 334 (valve 4).

Concentrate in storage containers of BIBs 352, 354, 356, 358 (34 in FIG. 1) is provided to pumps 362, 364, 366, 368 (32 in FIG. 1), e.g., peristaltic pumps, through check valves 372, 374, 376, 378 to combining elements 382, 384, 386, 388 (26 in FIG. 1) where dilution of the concentrates occurs and then to a flavor output 348 (30 in FIG. 1) by way of a flavor output path 350. The valve 3 as shown at 339 is provided to control the flow of a flush that cleans the output line 350 of any residual concentrate following a dispensing of a beverage.

Figure 8:
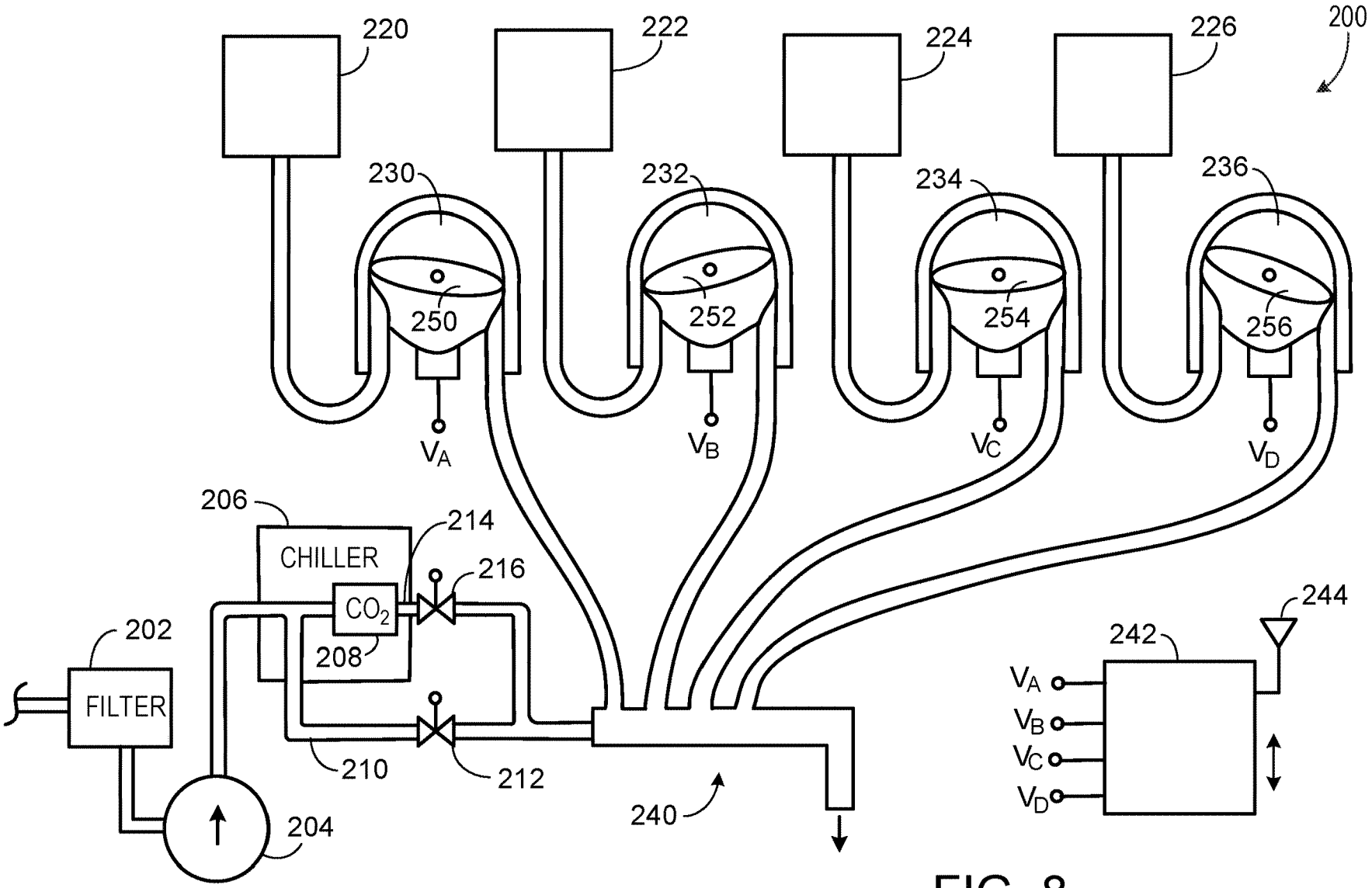

As shown in FIG. 8, in some cases, a beverage dispenser 200 includes a filter 202 (20 in FIG. 1) through which inlet water is drawn and pumped by a pump 204 (18 in FIG. 1). The water is then delivered to a chiller/carbonator 206 (22 in FIG. 1) that includes a CO2 tank 208 (60 in FIG. 1) within a chiller 206. A first path 210 leads from the chiller to a valve 212, and a second path 214 leads through the CO2 tank 208 to a second valve 216. The valve 216 controls the flow of carbonated water from the CO2 tank 208 and chiller 206, and the valve 212 controls the flow of non-carbonated water from the chiller 206.

Supplies of concentrates 220, 222, 224 and 226 (34 in FIG. 1) are also provided. Each concentrate is provided by a peristaltic pump 230, 232, 234 and 236 (32 in FIG. 1) to a mixing station 240. Each peristaltic pump 230, 232, 234, 236 is controlled by an electric signal VA, VB, VC and VD as shown, and each signal is provided by a controller 242 (36 in FIG. 1) that is connected to the central server through a wireless connection 244 (42 in FIG. 1). The voltage controls the movement of the swipe paddle 250, 252, 254, 256 of each peristaltic pump, which meters out the desired amount of concentrate at the output of each pump, and all of this information is monitored and maintained by the central controller (46 in FIG. 1).

The nozzle or other dispensing orifice can have a wide variety of configurations, sizes, materials, and locations in the beverage dispenser.

In some implementations, the nozzle stops cross-contamination between successively dispensed beverages. Water, CO2, and concentrates can be mixed at the point they enter the nozzle. There are no long fluid lines that continue seeping a flavored or carbonated beverage into the nozzle following a dispense cycle. Instead, in some implementations, as a flavored beverage is being dispensed, only a small tube (about 2 inches long) is filled with a flavored beverage.

Before a beverage finishes being dispensed, a burst of water is released to clear out that tube, ensuring that 100% of the flavor ends up in the user's drink, rather than remaining in the line to contaminate the next dispensed beverage. The flush time is adapted (remotely from the central server) to the flow rate at every site, ensuring high quality at every location. Additionally, the shape of the nozzle helps avoid any concentrate build-up.

In some implementations, mixing of the additives (e.g., diluted or undiluted concentrates) with the base liquids can occur upstream of the nozzle so that the beverage is already mixed when it reaches the nozzle. In some cases, the mixing can occur within the nozzle. In some examples, mixing can occur in a combination of upstream of the nozzle and in the nozzle. Other approaches to mixing can involve one or a combination of mixing downstream of the nozzle as the liquid and additives are moving from the nozzle to the consumption container or in the consumption container itself.

As shown in FIGS. 9, 10, and 11, in some embodiments, the diluted or undiluted concentrate liquid as well as the water (with or without CO2) are combined at a dispense head 400 (e.g., a dispensing orifice). The dispense head 400 includes a flavor passage 402 (e.g., including a tube that passes into the center of the water passage path as shown in FIG. 10). The dispense head 400 also includes a water passage 404 that permits water to enter and exit a water funnel 410 and be released as shown at 412. The flavor path exits (as shown at 414) in the center of the water path. It is desirable in some embodiments to maintain the carbonated water and the flavor concentrate separated as long as possible in the dispense process.

As shown in additional detail in FIGS. 12, 13, 14, 15, and 28, in some implementations, the nozzle 30 receives the base liquid through a single tube C that is approximately 2 inches long and has its lower end positioned at an aerator 31 (55/64 inch outside diameter, 2.2 gallons per minute) that is upstream of the upper end of the nozzle. Tube C has a 0.25" outer diameter and a 0.17" inner diameter. At its upper end, tube C connects to a "T" connector 96. Tube C serves as an output tube carrying the base liquid from valves A and B to the nozzle, where it is dispensed.

For this purpose, the "T" connector 96 has two tubes A and B leading into it. Tubes A and B are ¼" outer-diameter plastic tubes, with inner diameters of 0.17", and they are both less than 1" long. Tubes A and B are the only two input tubes into the "T" connector. Tube A carries still water to tube C. Tube B carries carbonated water to tube C. Tube C carries either still or carbonated water to the nozzle.

Tube A connects to solenoid valve A that has only two positions: open or closed. Each valve is either fully open or fully closed, depending on the signal that its solenoid receives from the control board 36. Tube B connects to the other, identical solenoid valve B. Valves A and B each have a solenoid-operated actuator that opens or closes the valves based on commands from the control board. Valves A and B are each connected to an input tube A1 and B1, respectively. Tubes A1 and B1 are plastic tubes having ¼" outer-diameter and 0.17" inner diameter, and they are each 3' long.

Tube A1 carries still water from a cold water tank (tank A) to valve A. Tube B1 carries carbonated water from a separate cold water tank (tank B) to valve B. Both tank A and tank B maintain water at a temperature of approximately 38 degrees Fahrenheit. The cold temperature is maintained by a heat exchanger that chills water using coils filled with a liquid refrigerant.

Tank B also has a ⅜" outer-diameter (with a ¼" inner diameter) plastic tube leading into it from the 10-lb. pressurized metal CO2 container 60 (FIG. 1). The CO2 container rests on a digital scale (e.g., the load cell 62). The CO2 tank pushes pressurized carbon dioxide into the tank B, where the CO2 mixes with cold water and dissolves. The volume of CO2 dissolved and retained in the water stored in Tank B depends upon the temperature of the water (the colder the water, the higher the carbonation), the surface area of water in contact with CO2 gas, and the pressure at which the gas is pushed into the tank (the higher the pressure, the higher the carbonation). The pressure of the CO2 gas is controlled by a regulator 61 (FIG. 1) on the output valve of the CO2 tank, which can be an analog or digital regulator. The regulator 61 receives control signals from the control board 36. The regulator's pressure can also be set by hand.

In some implementations a digital pressure regulator sets CO2 pressure between 0 and 110 PSI. The default setting for the pressure regulator can be 70 PSI. This is a closed loop system; the regulator's pressure setting is captured by the control board 36 to close the loop. At a default setting of, say, 70 PSI, the target level for the volume of CO2 dissolved per volume of water is 3.0, which is a medium-high level in comparison with most sodas and carbonated waters (3 liters of CO2 at 1 atmosphere of pressure dissolved in 1 liter of water).

During beverage dispensing, when valve A opens, still water passes from tube A1 (through valve A) to tube A. Water in tube A then passes directly into tube C, and then out of the machine through the nozzle, dispensing still water. When valves A closes, water stops being dispensed almost instantaneously. Water remains in tube C, since there is no longer sufficient water pressure to push water out of tube C.

During beverage dispensing, when valve B opens, carbonated water passes from tube B1 (through valve B) to tube B. The carbonated water in tube B then passes directly into tube C, and then through the nozzle, dispensing carbonated water or a mixed beverage in which the base liquid is carbonated water. When valve B closes, carbonated water stops dispensing almost instantaneously.

Figure 13:
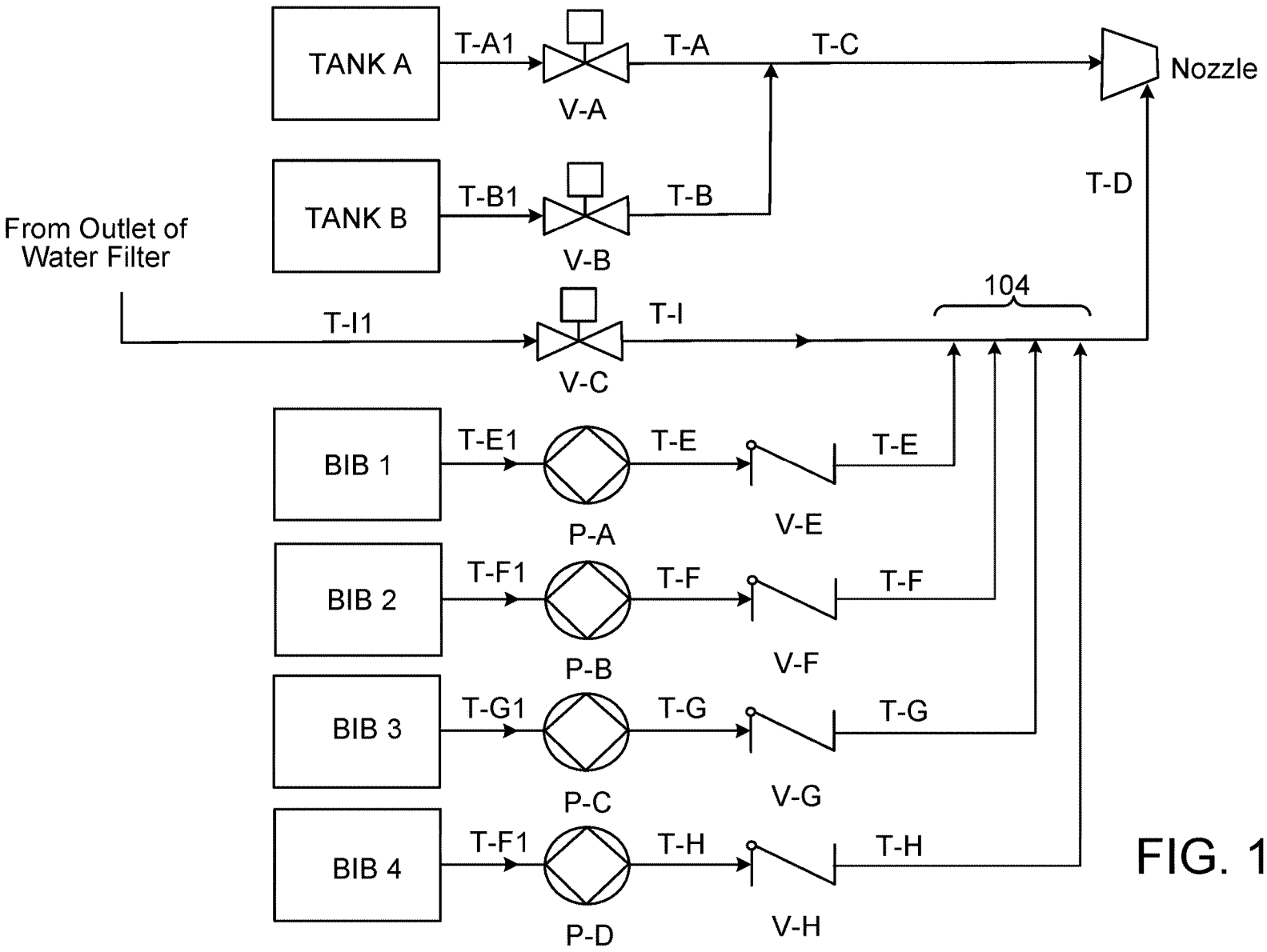

In the examples illustrated in FIGS. 12 and 13, parallel (in a flow path sense) to tube C is a single ¼" outer-diameter plastic tube D, approximately 16 inches long. The lower end of plastic tube D is positioned within ½" laterally of the centerline 102 of the nozzle. The upstream end of tube D connects to a manifold 104 that connects to the downstream ends of five separate ¼" tubes (tubes E, F, G, H, and I). Tubes E, F, G, and H are each 3' long and have their upstream ends connected to the outlets of, respectively, peristaltic pumps A, B, C, D, which are used to precisely meter controlled amounts of concentrate to be mixed with water to be dispensed from the nozzle.

The peristaltic pumps can be standard peristaltic pumps that can deliver liquid at their output sides in amounts that can be controlled to within, say, 1.95 milliliters per activation. An activation comprises one swipe of the wiper so that larger volumes can be dispensed. The inlet sides of pumps A, B, C, and D are connected to tubes E1, F1, G1, and H1 which are connected to respective BIBs. The connections of the tubes to the concentrate containers in the BIBs are made through standard quick-release connectors.

In line with each of the respective tubes E, F, G, and H are check valves (valves E, F, G, and H), which prevent backflow of concentrate from tubes E, F, G, and H into tubes E, F, G, and H. The upstream end of tube I is connected to the outlet of a solenoid valve C which has two positions: open or closed. The inlet side of valve C is connected to tube I1, which is connected to a "T" on the water line at the exit of the water filter 20 (FIG. 1). The manifold 104 is arranged to have the downstream ends of tubes E, F, G, and H couple through "$T_S$" into tube D. The tubes E, F, G, and H connected to check valves E, F, G, and H and then connect to the "$T_S$" of tube D. The downstream end of tube I connects to the series of four "T" fittings on tube D. The upstream end of tube I is connected to the outlet of valve C, such that water from tube I will flow through the length of tube D to which tubes E, F, G, and H are "T"-connected. The downstream end of tube D is aligned with the end of tube C in the manner mentioned earlier, where they both are connected to the nozzle 30. In this way, mixing of the concentrated additives with the base liquid occurs in the nozzle, in the stream flowing from the nozzle into the container, or within the container, or some combination of those.

In some examples, when a mixed beverage is dispensed, the user has the option (by touching appropriate icons on the touch sensitive display of the tablet 40) to add any one of four flavor additives (corresponding to the four different BIBs) to the base liquid. The user's choice governs which of pumps A, B, C, or D will deliver concentrate through tube E, F, G, or H (and also through check valve E, F, G, or H) into tube D, where it is dispensed in parallel with the base liquid from tube C into the nozzle and out of the beverage dispenser.

When the user selected beverage has been dispensed and after the corresponding pump A, B, C, or D stops delivering fluid from the corresponding BIB, valve C opens and delivers a small volume of flushing water through tube D (for example, 10 milliliters), to assure that no concentrate from any of the tubes E, F, G, and H remains in tube D. The length of time during which valve C is open for this purpose can be programmed in the software running in control board 36. The period of time could be, for example, 200-1000 milliseconds.

In the implementations that we have been describing, only a single concentrate can be chosen for inclusion in the mixed beverage to be dispensed at a given time. In some cases, the simplicity of enabling only a single concentrate to be used at a given time provides a desirable user experience by preventing a mixture of concentrates that would yield an unpalatable mixed beverage and by reducing the number of options from which the user must choose. Nevertheless, in some implementations, the user may be given the option to mix concentrates rather than being limited to choosing a single concentrate.

In general, not only the flavor but also other beverage characteristics of the beverage that is dispensed from the beverage dispenser are determined, at least in part, by instructions or selections provided by a user through the user interface of tablet 40.

We use the term "beverage characteristics" broadly to include, for example, any qualities exhibited by the beverage, such as its volume, base liquid, additives and combinations of additives, strength of dilution of additives, temperature, and level of carbonation, to name a few. In other words, the dispensed beverage can be customized in a wide variety of ways.

In some implementations, through the user interface of the touch screen 41 of the display of the tablet, a user can cause a beverage to be dispensed that has a desired combination of a subset of (or all of) such characteristics.

Figure 16:
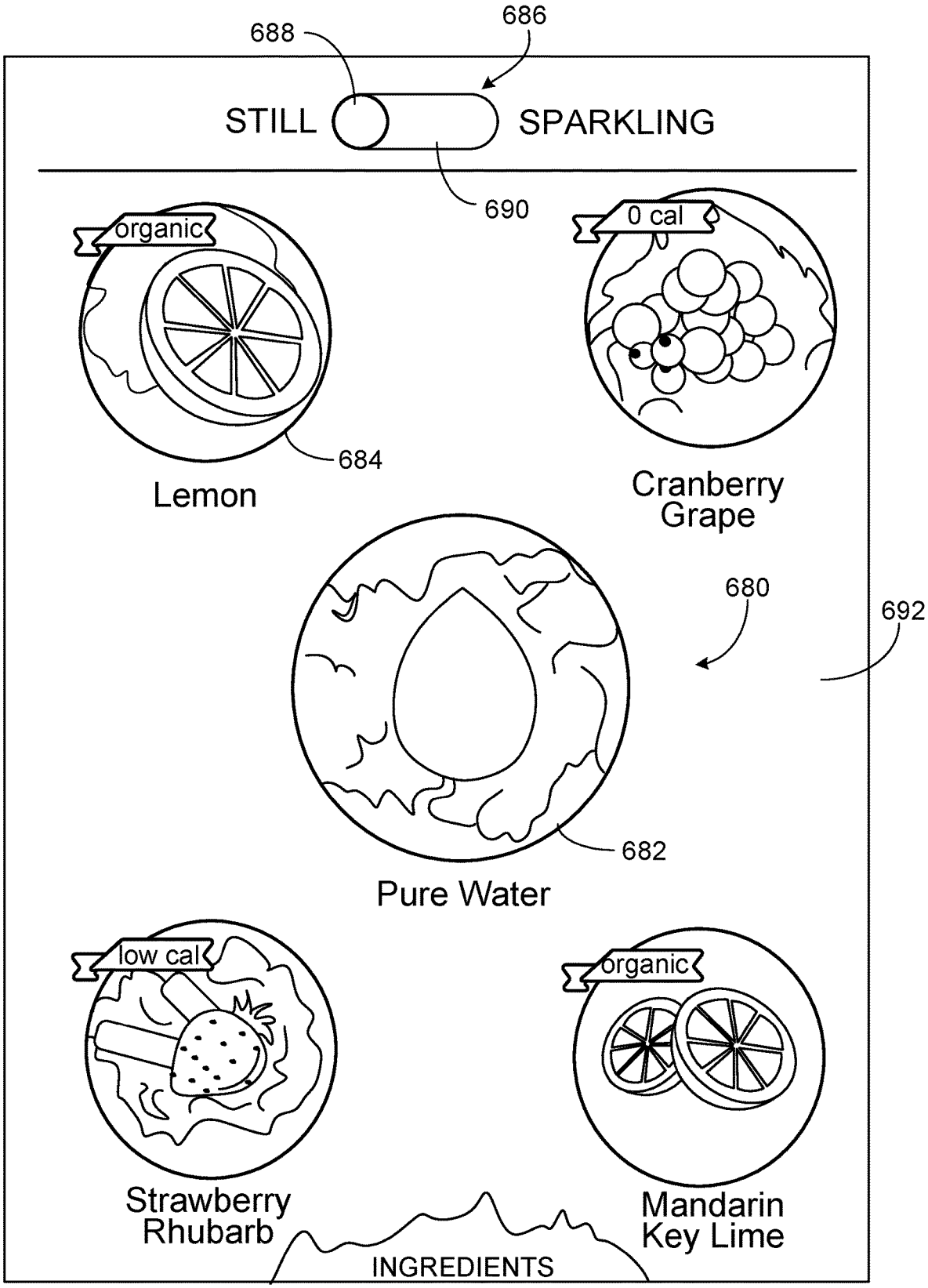

For example, as shown in FIG. 16, in some implementations the touchscreen displays a set of icons 680 representing various beverage options, such as plain water 682, lemon-flavored water 684, or cucumber-flavored water (not shown). At the top of the touchscreen, there is a toggle or switch symbol 686, in which a small circle 688 appears at one side or the other of an ellipse 690. There is a word on each side of the toggle symbol. On the left side of the toggle, there is the word "still"; on the right side, "carbonated." When a user taps either the left side of the toggle or the word "still," the screen displays a solid white background 692 (indicative of still water), behind the icons on the display. When a user taps the right side of the toggle or the word "carbonated," the screen displays a solid blue background, and images of bubbles (not shown) rise from the bottom of the touchscreen (indicative of carbonated water). A wide variety of other visual signals could be provided to suggest to the user the nature of the setting that has been chosen; and this approach could apply to a variety of beverage characteristics in addition to carbonation.

The two backgrounds, white and blue (or possibly other display characteristics), represent two operational modes of the machine:

1) When the touchscreen background is white, the beverage dispenser is in "still" mode. As long as the beverage dispenser is in "still" mode, when a user touches an icon representing a beverage flavor option on the touchscreen for more than, say, 0.25 seconds, that flavor of still water is dispensed under control of the control board 36. No CO2 is in the water. For example, if a user holds a finger on the icon representing plain water (in this case the icon looks like a simple drop of water, with the words "Pure Water" underneath it), then plain, still water begins to be dispensed from the nozzle. The water continues to be dispensed as long as the user continues to hold her finger on the icon. The water stops being dispensed when the user removes her finger. If alternatively a user holds a finger on the icon 84 representing lemon water (in this case the icon has an image of a lemon, with the word "Lemon" underneath it), then lemon-flavored, still water is dispensed from the nozzle 30. The lemon-flavored water stops being dispensed when the user removes her finger.
2) When the touchscreen background is blue, the beverage dispenser is in "carbonated" mode. In "carbonated" mode, when a user touches an icon representing plain carbonated water or any flavored water (that is, a mixed beverage) on the touchscreen for more than, say, 0.25 seconds, that flavor of carbonated water is dispensed under control of the control board 36. In this case, the mixed beverage includes water that contains dissolved CO2. For example, if a user holds a finger on the plain water icon described above, then pure carbonated water begins to dispensed from the nozzle 30. If alternatively a user holds a finger on the same icon 684 described above representing lemon water, then lemon-flavored carbonated water begins to be dispensed from the nozzle 30.

The machine will remain in either still mode or carbonated mode until someone (either the user mentioned above or a subsequent user) changes the toggle. Since each mode is visually represented by a colored background (white or blue), users familiar with the machine can visually identify whether a non-carbonated or carbonated beverage will be dispensed when they select an icon representing a beverage flavor. Maintaining the dispenser in one or the other mode until changed by the user simplifies the operation of the user interface. By using different visual cues for the different beverage characteristics (in this case, still or carbonated) the user is always aware of the current mode.

When the touchscreen is in "still" mode, and a user touches the icon representing water, valve A opens and non-carbonated water is dispensed through the nozzle. When the touchscreen is in "carbonated" mode, and the user touches the same icon that represents water, valve B opens, so carbonated water is dispensed through the nozzle.

In some embodiments of the touchscreen interface, instead of a binary carbonation choice of carbonated water or still water, the displayed control can be treated as a slider have positions that represent a scale of four (or fewer or more) potential carbonation levels, each representing a different measure of volumes of CO2 dissolved in water (1 volume=1 liter of CO2 at 1 atmosphere of pressure dissolved in 1 liter of water). The volumes of CO2 that correspond to four carbonation settings could be as follows (although a wide variety of other volume values and number of different carbonation levels could be used): Still: 0 volumes CO2; Light: 1.5 volumes; Medium: 2.5 volumes; Heavy: 3.5 volumes.

In some embodiments, for example, the scale can have as many as 41 (or even more) potential levels of carbonation, in which the lowest level represents completely still water (0.0 volumes), and the levels are separated by volume differentials of 0.1 volumes.

In cases in which there is more than one possible level of carbonation, the slider moves along a scale as controlled by a finger on the surface of the touch display. When a user puts a finger on the slider and moves it all the way to the right of the scale, the machine is set to dispense water at its highest possible carbonation level of, for example, 4.0 volumes. When a user puts a finger on the slider and moves it all the way to the left of the scale, the machine is set to dispense still water with no CO2 added to it. When the user sets the slider at a position in the middle of the scale, the machine is set to dispense water at a carbonation level corresponding to one of the 41 (or other number of) positions of the slider on the scale.

Thus, in some examples, interactions with a touchscreen interface can cause changes to (1) the imagery on the interface, (2) the beverage options available to a user, and (3) physical processes within dispensers. The interface includes a variety of concentrate options, as well as a virtual slider switch for changing the amount of a concentrate being selected, where sliding from the left (mild) to the right (strong) changes the requested concentration level, for example, by changing the signal to the peristaltic pumps. A single touch can change a variety of beverage options from still to carbonated (without changing the recipes of those flavors in any way except for adding or removing CO2), or vice versa. A display change on the touch screen may be employed to indicate that all the options have been made either carbonated or still (e.g., bubbles appearing all over the screen). The imagery may change in gradients based on the user's selection (e.g., a lot of bubbles means heavy carbonation, a few bubbles means light carbonation, etc.).

In some embodiments, a single touch may be used to set the flavor strength of all beverages dispensed by the dispenser. An associated display change can be made on the entire touch screen, e.g. a color shift from light (representing a light flavor) to dark (representing a strong flavor). The color shift can occur in various gradients based on the user's desired flavor strength. The user's touch also triggers a software change that alters pump settings, so that when any beverage option is selected, it is dispensed at a lighter or stronger flavor.

Figure 26:
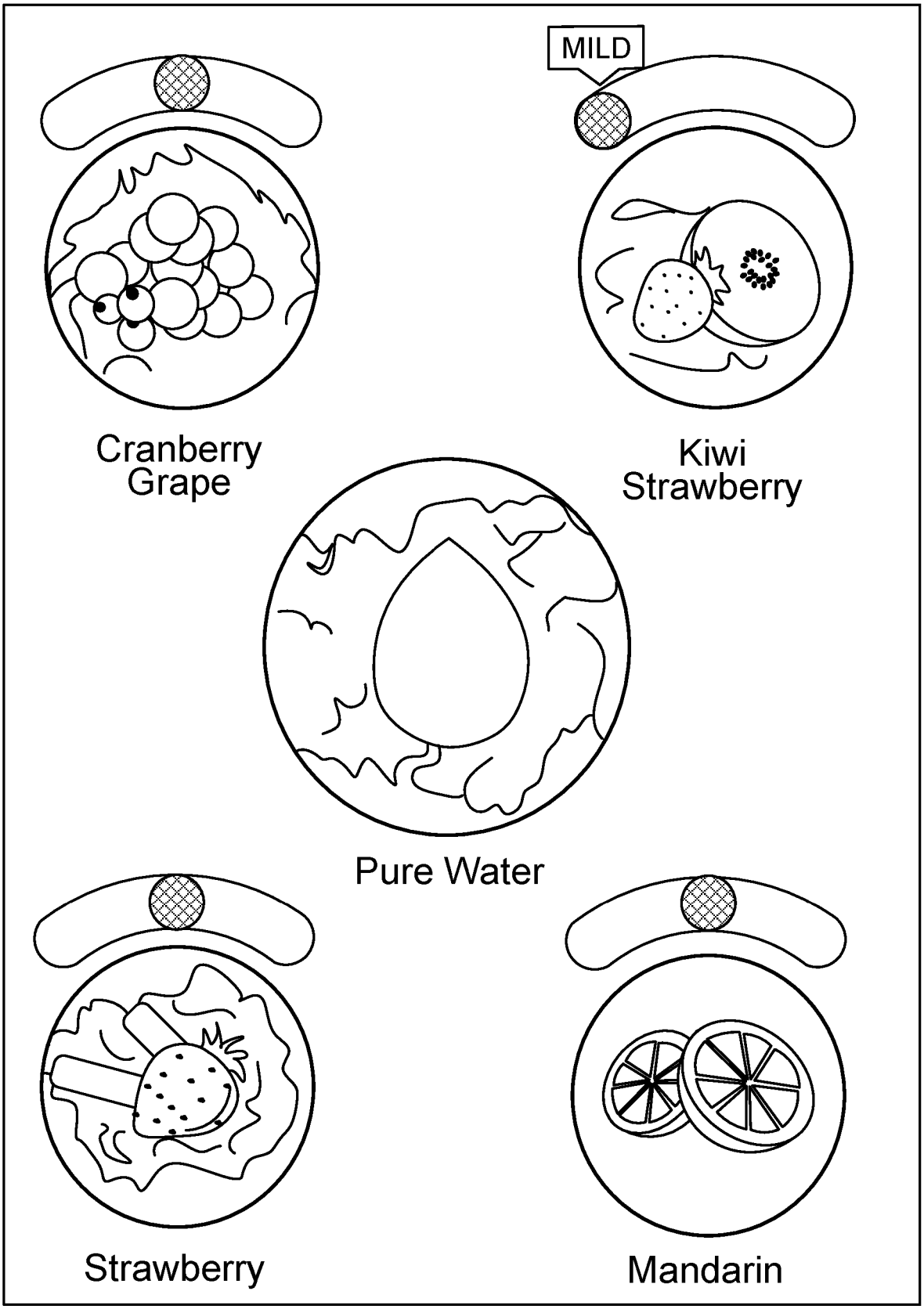

In some implementations, as shown in FIG. 26, the single touch can set only the flavor strength of a single beverage to be dispensed by the dispenser. For such examples, the display changes for a particular beverage icon on the touch screen, e.g. a color shift from light (representing a light flavor) to dark (representing a strong flavor) for only that beverage flavor. The color shift can occur in various gradients based on the user's desired flavor strength. In certain embodiments, this includes a software change that alters a single pump setting, so that when a particular beverage option is selected, it is dispensed at a lighter or stronger flavor.

In some cases, a single touch can set the temperature of all beverages in the machine, which incorporates: a display change on the entire touch screen, e.g. a color shift from blue (representing a cold temperature) to red (representing a hot temperature). The color shift can occur in various gradients based on the user's selection (e.g. pink means slightly warm, red means hot, etc.); as well as a software change that alters whether water is dispensed from a "cold" valve, a "hot" valve, or both, so that when any beverage option is selected, it is dispensed at the desired temperature.

In some instances, a single touch sets the temperature of a single beverage in the machine. The single touch causes a display change for only a particular beverage icon on the touch screen, e.g., a color shift from blue (representing a cold temperature) to red (representing a hot temperature). The color shift can occur in various gradients based on the user's selection (e.g. pink means slightly warm, red means hot, etc.); and a software change alters a single pump setting, so that when a particular beverage option is selected, it is dispensed at a lighter or stronger flavor.

In some embodiments similar approaches can be used for other beverage characteristic, in addition to CO2 level, temperature, and flavor level. For example, a single user touch could alter the adding/removing of vitamins; the adding/removing of electrolytes; the adding/removing of a caffeine supplement; the adding/removing of a memory supplement; the increasing/decreasing of sweetness; and the adding/removing various herbs or spices; or combinations of any two or more of those characteristics and others.

In some embodiments, the following physical interactions by the user with the touchscreen could apply to every beverage trait: 1) a clockwise or counterclockwise motion, without taking the finger off the touchscreen, 2) a left or right finger motion, without taking the finger off the touchscreen, 3) a single touch to a dial, or 4) a single touch to an on/off switch, or combinations of them. For all of the above, simply moving the finger near the touch screen, rather than actually physically touching it, may also be sufficient.

In some implementations, the user interface of the beverage dispenser therefore includes a Request CO2 button and a Not Request CO2 button. The user interface also can include concentrate selection buttons, for selecting, for example, any of sweetened or unsweetened flavor, herb, vitamin or other nutrient, in powder or liquid form. In certain embodiments, the user interface may also include an amount selector interface 68 that permits any of CO2 or concentrate amounts to be adjusted, e.g., rotating a finger clockwise may increase an amount, while rotating a finger counter-clockwise may decrease an amount. In some cases, the interface may permit a user to move a slider to request a relative amount of either a concentrate and/or an amount of CO2. The controller board 36 responds to the selected level of carbonation by controlling the appropriate valves within the system. For example, when the highest carbonation setting is selected, the control board 36 opens only valve B and carbonated water is dispensed at the maximum volume of dissolved CO2 per liter of water (in this case 4.0 volumes).

When the lowest carbonation level is selected (i.e., no carbonation), only valve A opens and still water is dispensed.

In some implementations, a dispensing cycle begins when a user touches one of the flavor icons to dispense one of the four flavored water options. Upon the user touching the icon, first valve A or B opens to start water flowing. Then, after a programmable period of time, ranging from 5-50 milliseconds, pump A, B, C or D will pump concentrate ultimately causing it to intersect with the water stream as it exits the nozzle out of the dispenser. Pumping of water is begun first to prevent the concentrate from splashing onto an external surface of the dispenser. Generally only one concentrate can be dispensed at a time, which is determined by which icon is selected on the control panel. However it is possible to program the machine such that more than one concentrate could be dispensed simultaneously. Once the concentrate is mixed with water in the nozzle or downstream of the nozzle, the beverage being dispensed is considered a flavored still or carbonated beverage. When the user releases any of the flavored water icons at the end of a dispense cycle for flavored water from the dispenser, pump A, B, C, or D will stop immediately, followed by a programmable delayed closing of valve A or B, which can range from 5 milliseconds to 50 milliseconds. The delayed closing helps to taper the flow rate from the dispensing orifice to the consumption container at the end of the dispense cycle.

When a dispensing cycle begins as the user begins to touch the icon, the commands to cause the dispensing are not sent immediately to the hardware. A delay of, e.g., 300 milliseconds is applied to prevent so-called ghost dispensing. When the user selects a beverage (e.g., pushes an icon on a touchscreen) for less than 300 milliseconds, no commands will be set and nothing will be dispensed. When a user stops the dispense request (e.g., by lifting a finger off of the icon on the touchscreen), commands are sent immediately to stop the dispensing, but due to the decoupled architecture and the event-loop in the firmware, the system may take up to 60 milliseconds for the hardware to recognize the stop dispense instruction from the user interface. Once that instruction is recognized, the flush sequence will begin if needed.

In the case of a dispense cycle for still water, when a user selects the still water icon, after the delay of 300 milliseconds, valve 1 and valve 4 are turned on simultaneously. The pumps for the concentrates all remain off. When the user releases the selection, all valves turn off simultaneously after the delay of at most about 60 milliseconds. No flush sequence is required for this process as only still water was dispensed.

In the example of a dispense cycle for carbonated water, after the delay of 300 milliseconds, valve 2 and valve 4 are turned on simultaneously. The pumps for the concentrates all remain off. When the user releases the selection, all valves turn off simultaneously after the delay of at most about 60 milliseconds. A flush sequence of about 500 milliseconds then flushes the flavor line with still water.

In the instance of a dispense cycle for flavored non-carbonated water, after the delay of 300 milliseconds, the pump associated with the selected concentrate is turned on to fill the associated pump line. After an additional delay of, say, 60 milliseconds, valve 1 and valve 4 are turned on simultaneously. Once a user releases the selection command, the valve 3 opens and the pump is turned off. After a flush period of, for example, 500 milliseconds, the valves 1, 3 and 4 are turned off simultaneously.

For a dispense cycle for flavored carbonated water, after the delay of 300 milliseconds, the pump associated with the selected concentrate is turned on to fill the associated pump line. After a further delay of 60 milliseconds, valve 2 and valve 4 are turned on simultaneously. Once a user releases the selection command, the valve 1 and valve 3 are opened, valve 2 is turned off, and the pump is turned off. After a flush period of, for example, 1000 milliseconds, which flushes both the favor line and the main water line from valve 4, all of valves 1, 3 and 4 are turned off simultaneously.

In some implementations, then, both the flavor line and the CO2 line may be flushed at the end of each dispense cycle, even though the system does not know for how long a user will request a dispense cycle.

In addition to hardware, software is involved, because the duration of the flush that clears the line of concentrate can be varied based on properties sensed at a given place and time (e.g., based on water pressure).

When a carbonation level that is in between the minimum and maximum possible levels is selected, control board 36 causes valve A and valve B to open and close repeatedly at a rate and in a sequence specified in a local database held in a data storage device that is present in the dispenser and is accessible to the control board 36. This causes combining of volumes of the carbonated and non-carbonated water streams from tube A1 and tube B1 in a desired ratio in tube C. The higher the carbonation level, the more valve B is caused to be open; the lower the carbonation level, the more valve A is caused to be open.

For example, if a light level of carbonation has been selected (e.g. corresponding to 1.0 volumes of CO2) using the slider, when a user puts a finger on the water icon on the interface, valve B opens. While valve B remains open, valve A alternates rapidly between its open and closed states, alternating states every, say, 0.2 seconds. When the user removes his finger from the icon on the touchscreen, valve B closes, followed almost instantly (0.1 second) by valve A.

For another example, if the user selects a medium level of carbonation (e.g., corresponding to 2.0 volumes of CO2) and touches the water icon, valve A and valve B are caused to be open simultaneously. When the user removes his finger from the icon, control board 36 causes valve B to close followed rapidly (0.1 second delay, for example) by the closing of valve A.

In some implementations, the ratio of still water to carbonated water is controlled not by the relative amounts of time that valve A and valve B are caused to be open, but by the degree or extent to which the two valves are open. The controller board effectively reduces the flow rate of one of the streams while maintaining the other flow rate. For example, valve A can fully open while valve B only opens halfway, to create water that is only lightly carbonated. Alternatively, Valve B could fully open while Valve A only opens halfway, to create water that is more strongly carbonated. The generation of the selected carbonation level in the water therefore could be done with proportionally controlled solenoid valves, using either DC voltage or a pulse-width modulated signal.

In some cases, the carbonation level of the water could be controlled by changing the pressure of the CO2 gas that is released into the water in Tank B, instead of by changing the ratio of non-carbonated to carbonated water. When a user sets the carbonation setting to the highest possible setting, the control board 36 could adjust the digital pressure regulator to increase its pressure to its maximum pressure of 110 PSI. When a user sets the carbonation setting to the lowest possible setting, the control board 36 could cause the pressure regulator to decrease its pressure to the lowest possible level of 0 PSI. When a user selects a carbonation level in between, the control board 36 could set the regulator to achieve a corresponding value.

In some embodiments, data is collected during and after each dispense cycle, and at other times.

For example, after the beverage dispenser dispenses a beverage, data such as the carbonation level setting and how long the user held her finger on an icon on the touchscreen (which corresponds to how long the still or carbonated water was dispensed) is recorded locally in the data storage of the beverage dispenser to which the control board 36 has access. In addition, every instance of a solenoid valve being opened or closed is recorded. The weight of the CO2 container, based on signals from the load sensor to the control board 36, is also measured and recorded, before and after dispensing.

In some implementations, a digital flow meter is placed between tube C and the "T" connector to capture the flow rate at which the beverage being dispensed exits the "T" connector and enters the nozzle. The flow rate is recorded by the control board 36 in a database maintained in the local storage.

The data from the local database are sent frequently, for example, every five seconds by the tablet microprocessor to a cloud database through a wireless connection. The cloud database is maintained by the central server 46.

Figure 17:
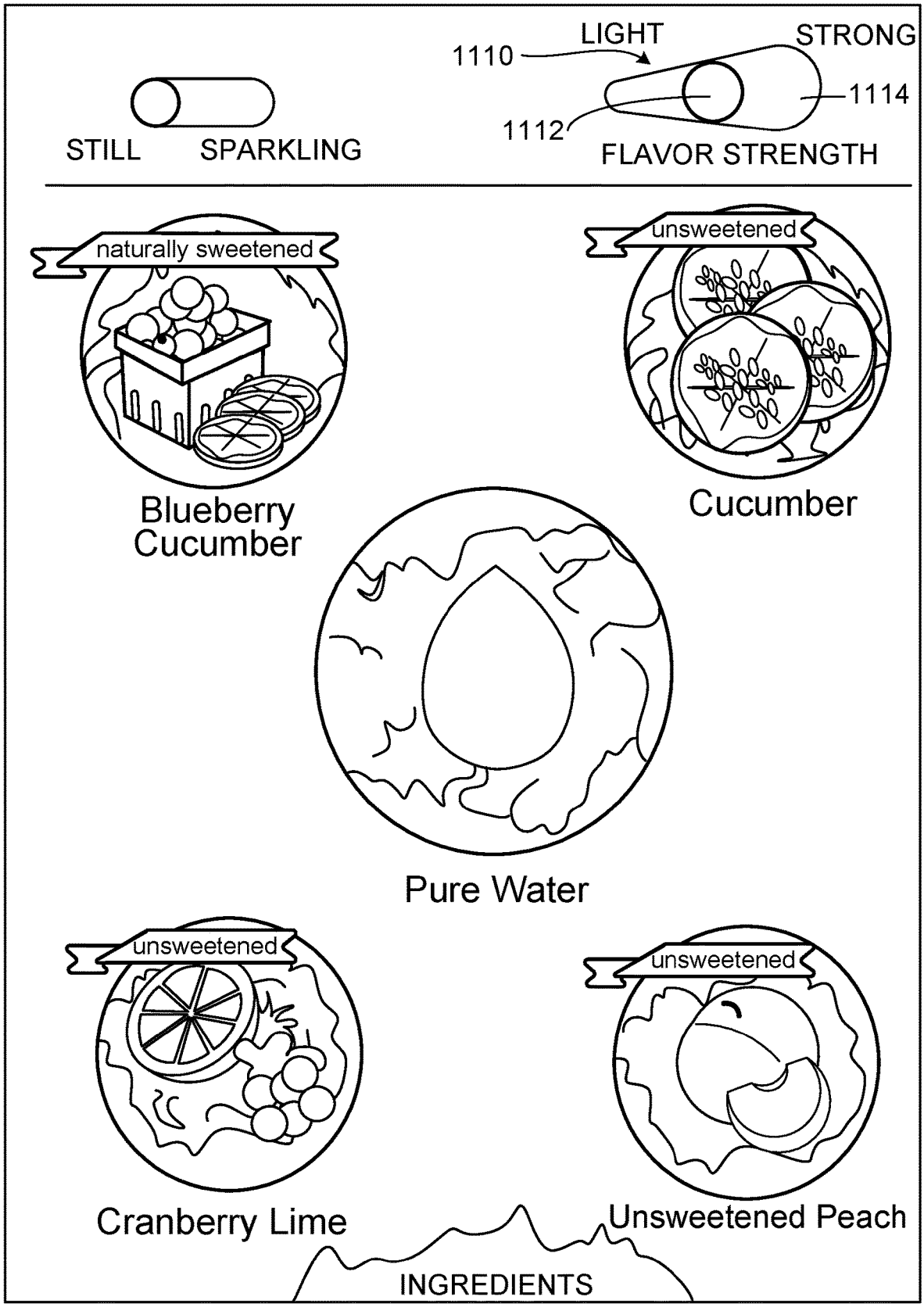
Figure 18:
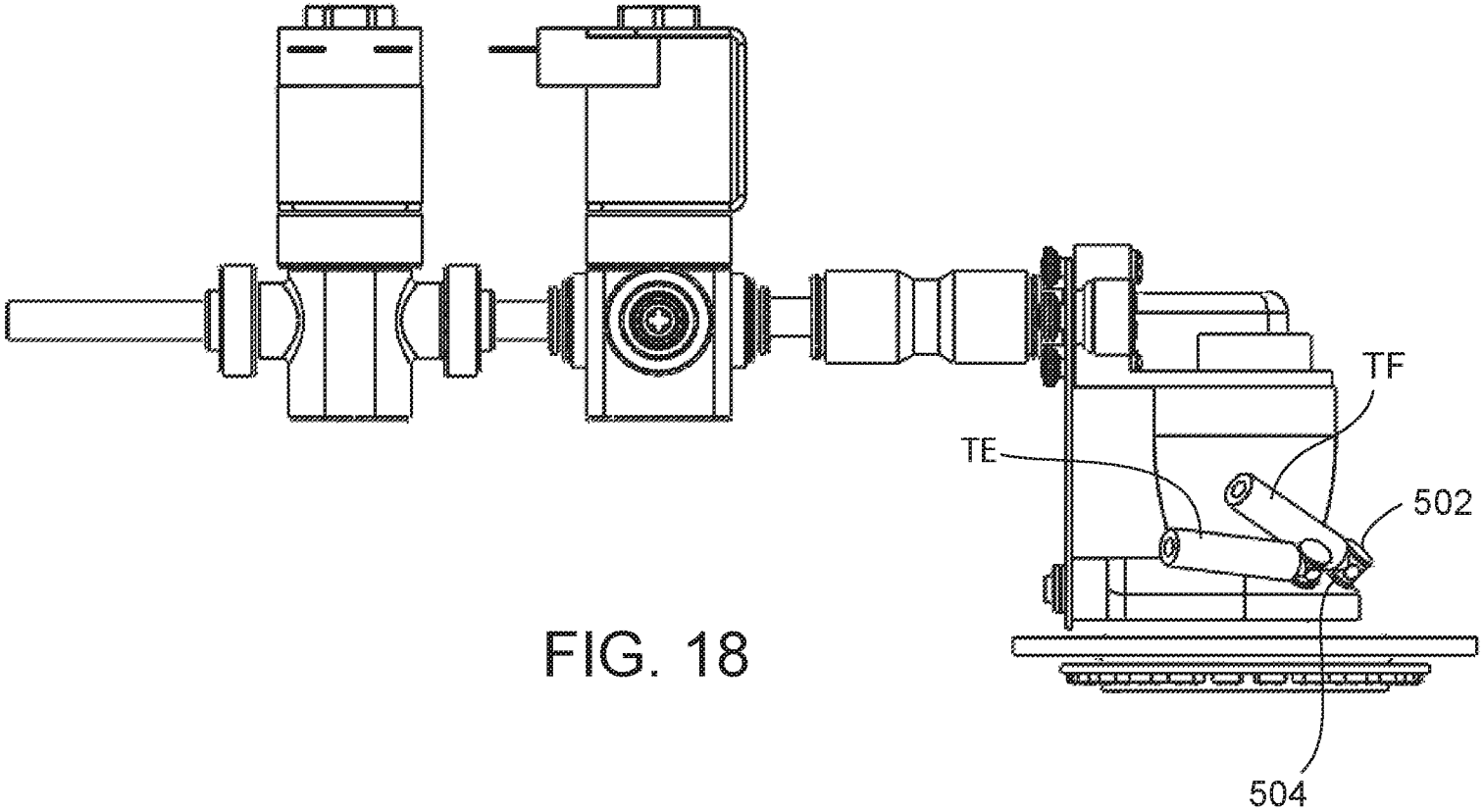
Figure 19:
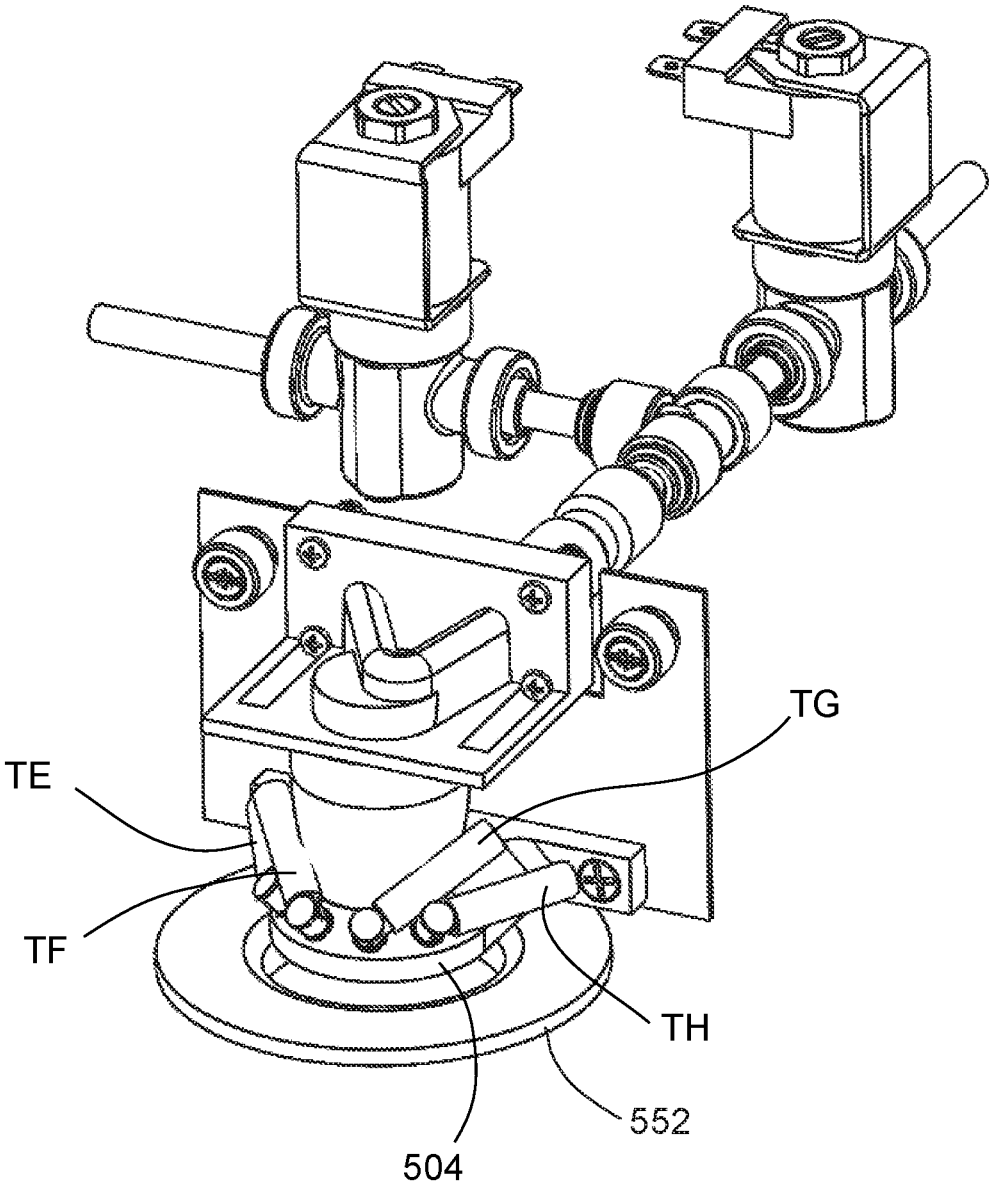
Figure 20:
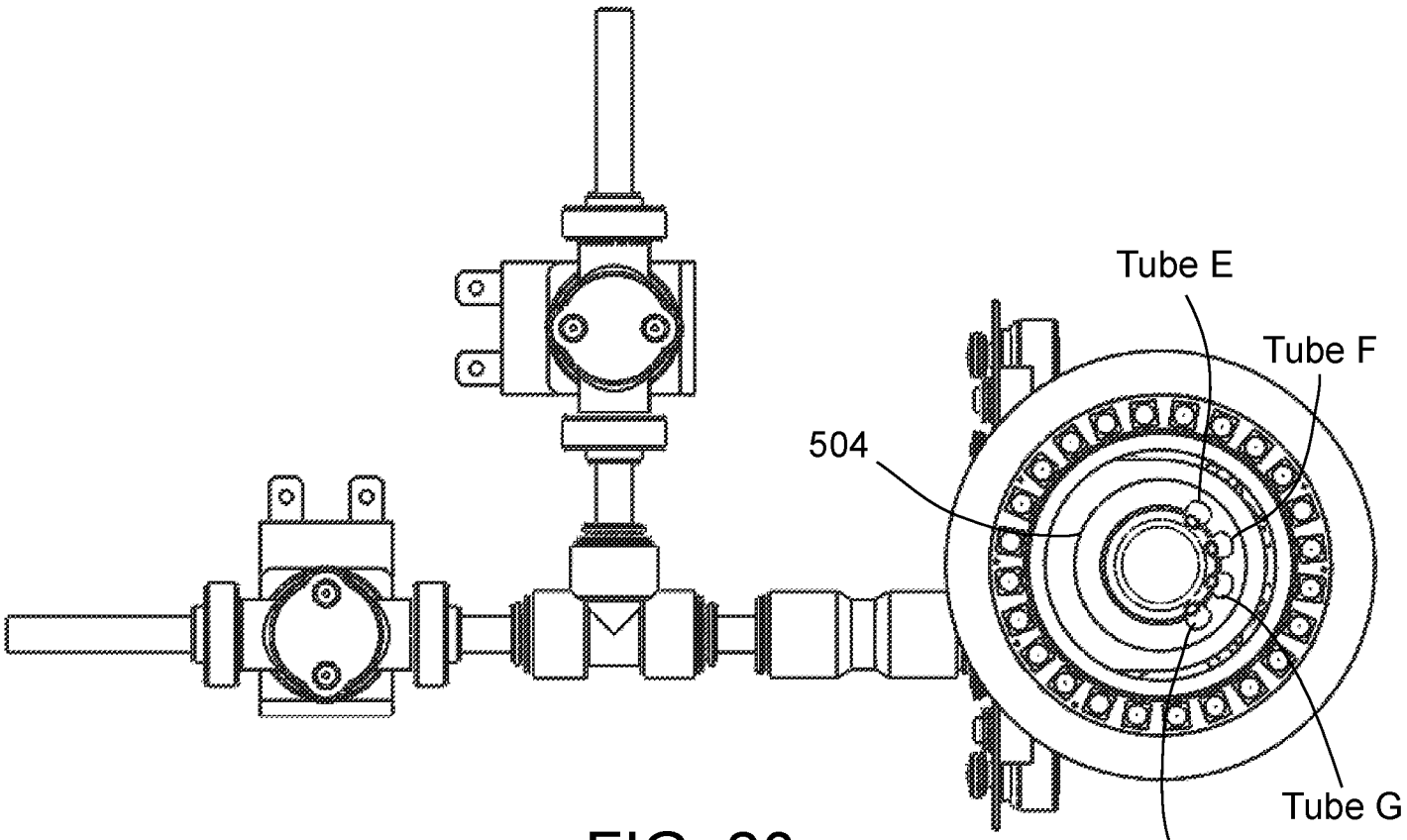
Figure 21:
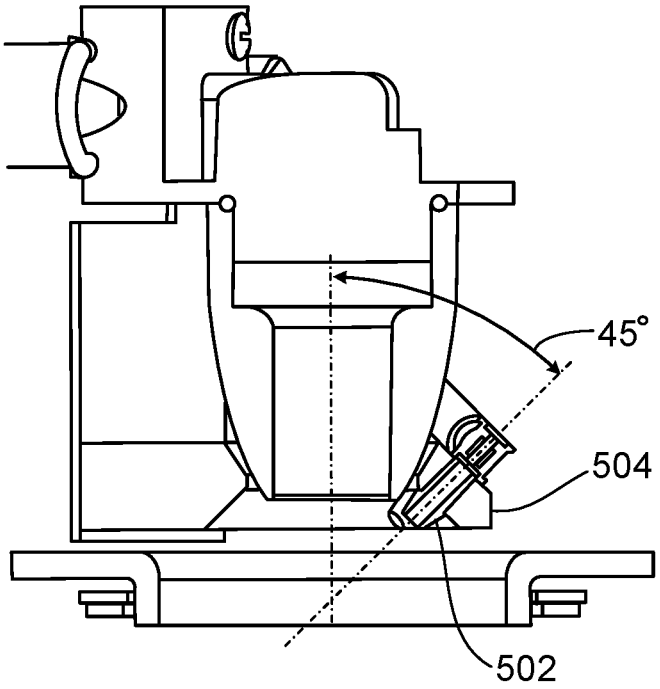
Figure 22:
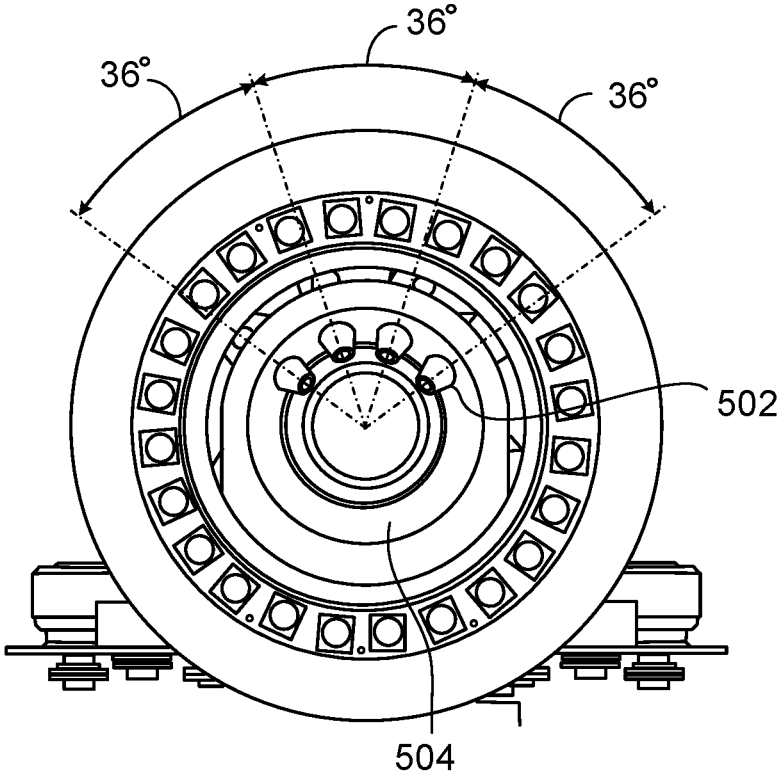
Figure 23:
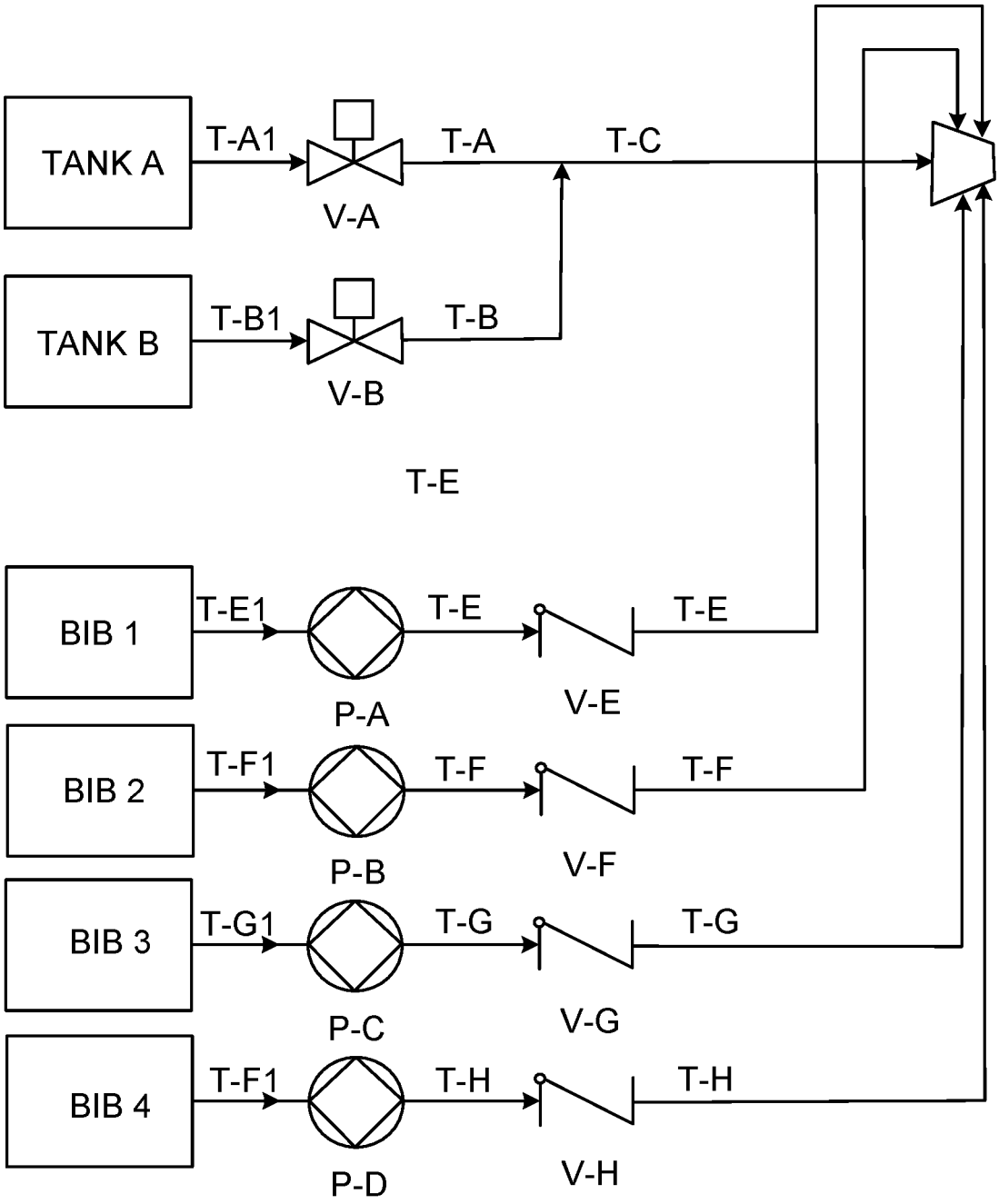
Figure 24:
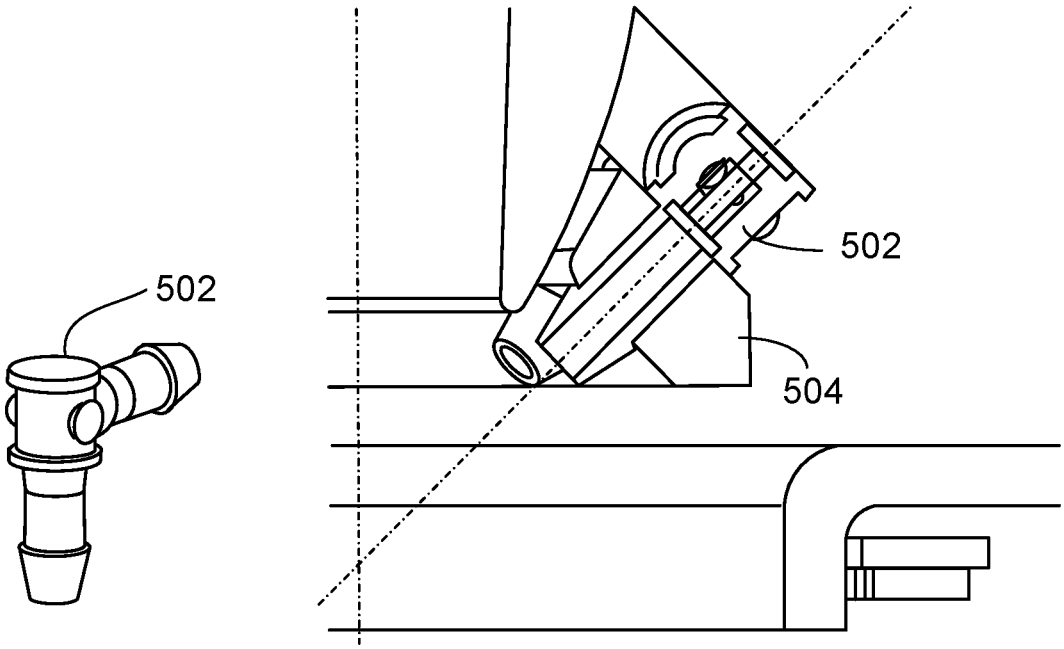

In some implementations, one of the beverage characteristics that can be controlled by the user by finger touches to the touch display of the tablet is the flavor strength imparted by the concentrated additive to the base liquid for a mixed beverage that is being dispensed. As shown in FIG. 17, for example, at the top of the touchscreen, there is a toggle or switch symbol 1110, in which a small circle 1112 occupies a position at one side or the other or along the middle of a modified ellipse 1114. There is a word on each side of the toggle symbol. On the left side of the toggle, there is the word "light"; on the right side, "strong". When a user taps his finger on either the left side of the toggle or the word "light," the circle moves to the left of the ellipse. When a user taps the right side of the toggle or the word "strong," the circle moves to the right of the ellipse. When a user taps in the middle of the two words, the circle moves to the center of the ellipse.

The location of the circle on the ellipse corresponds to a flavor strength, i.e., to a ratio of a liquid concentrate (or syrup) or other additive in a BIB to water or another base liquid. For example, in the central "medium" setting, liquid concentrate from the BIB is set to mix with water at a ratio of 1:11, by volume (1 part concentrate to 11 parts water). In the "strong" setting, liquid concentrate is set to mix with water at a ratio of 1:5 (the concentrate is less diluted by water). In the "light" setting, liquid concentrate is set to mix with water at a ratio of 1:20 (the concentrate is more diluted by water). Each of the strength settings corresponds to a speed setting on a digital peristaltic pump that is controlled by the control board 36 based on the user's input.

As shown in FIGS. 25A, 25B, and 25C, the electric signal to each peristaltic pump may be an alternating signal, and the modulation may be provided by limiting the duty cycle of each signal. For example, the signal 1300 in FIG. 25A may provide a small amount of concentrate, the signal 1302 in FIG. 25B may provide more concentrate, and the signal 1304 in FIG. 25C may provide the most amount of concentrate. This permits the central controller to control the amount of concentrate that is dispensed at one or more locations based on feedback (a concentrate is too strong or too weak) that has been received from a different location.

In some implementations, instead of having three flavor strength settings (low, medium, and high), other numbers of strength settings can be used (from two different strength settings to a large number such as 200). In some cases, there is a continuum of 200 flavor strengths each corresponding to a precise ratio of concentrate to water, beginning at a ratio of 1:1, and increasing to a ratio of 1:200. The local database in the beverage dispenser associates flavor strengths with settings provided by the user and also associates flavor strengths with corresponding peristaltic pump speeds. The ellipse 1114 is presented with a wider section on the right, corresponding to a higher level of concentration, to provide the user with an intuitive sense for how to control the dispensing to achieve a desired level of concentration.

In some instances, the beverage dispenser holds four containers (BIBs) of liquid concentrate (e.g., lemon concentrate, lime concentrate, and two others). In some cases, there could be fewer or more different containers. The plastic bags inside the BIBs contain couplers that enable the concentrate to flow out when a specific tube with a corresponding opening has been attached to that coupler. For each of the containers a ½" outer diameter plastic tube is attached to the coupler, leading to a peristaltic pump mounted on an interior wall of the housing of the beverage dispenser next to the corresponding concentrate container. These plastic tubes serve as inputs into the peristaltic pumps. A peristaltic pump, when activated by the control board 36 draws the concentrate out of the corresponding container through the tube and into the pump.

Concentrate exits a pump through a separate, much narrower tube, of ⅛" to ¼" outer diameter. As shown in FIGS. 18, 19, 20, 21, 22, 23, 24, and 33, in some implementations the concentrated additives and the base liquid do not need to be mixed upstream of the dispensing orifice and can be mixed within or even downstream of the orifice. In some examples, the narrow tubes TE, TF, TG, TH from all of the peristaltic pumps that serve respective BIBs are connected to the dispensing nozzle through four corresponding small nozzles 502. That is, instead of a manifold that connects the four flavor options on the dispenser into one tube, there are four separate tubes that individually deliver flavor into the water stream at the exit of the main nozzle (dispensing orifice), The small nozzles are mounted on a ring 504 with the dispensing end of the small nozzle projecting into the space within the dispensing orifice. Each nozzle is mounted at a 45-degree angle to the central axis of the dispensing orifice.

The dispensing orifice (main nozzle) has a cylindrical inner wall with an inner diameter of 0.59". Concentric to the main nozzle is the ring 504 that has a diameter of about 0.65". The four smaller nozzles are located 36 degrees apart (radially from the main nozzle) from each other, in a symmetric arrangement left and right of the centerline of the nozzle from the front of the machine. The inner diameter of these smaller nozzles is 0.10". The additive tubes are connected to the four smaller nozzles, and through these four nozzles, the additive stream is injected into the water stream.

The angle of the four smaller nozzles in relation to the main nozzle can vary anywhere from 30 degrees to 50 degrees, which assures a good intersection between the additive stream and water stream for good mixing. If the additive stream does not intersect with the water stream as it flows into a container, it may create a visual effect of having a separate colored flavor stream in the water, which may be less desirable. The inner diameter of each of the smaller nozzles can range from 0.10" to 0.17".

Under pressure from the corresponding pump, concentrate is dispensed by the small nozzle and directly into the air within the larger dispensing orifice. At the same time water or another base liquid is also dispensed vertically along the central axis of the dispensing orifice. The four small nozzles open into the bottom end of the dispensing orifice and deliver diluted or undiluted additives while the water or other base liquid is ejected into the top of the dispensing orifice. The (in our example) four small nozzles for the four concentrates are angled at 45 degrees so that the concentrate or concentrates and the water or other base liquid mix in air, about half an inch below the lower end of the dispensing orifice, to form the finished dispensed beverage. In other words, the concentrate is dispensed crosswise into the vertically ejected stream of water or other base liquid. Other orientation angles of the small nozzles may also work including angles in the range of 30 to 50 degrees.

In some cases, hot/cold beverages and vitamin-based drinks can be dispensed out of the same nozzle, in some cases, a dispensing cycle can be stopped when it is determined that a cup or bottled is full or has overflowed based on a visual sensor, a sound sensor, or a physical sensor or a combination of two or more of them.

As shown in FIGS. 20, 21, 22, and 33, in some versions, a lighting effect can be provided to illuminate the beverage stream as it is being dispensed from the dispensing orifice toward the consumption container. A set of LEDs 550 is mounted in a circle on a ring 552 that is mounted just below the downstream end of the dispensing orifice. The ring 552 has an inner circumference large enough to clear the bottom of the nozzle assembly. The LEDs are aimed in a direction toward the location where the consumption container is placed and parallel to the central axis of the nozzle assembly. In this arrangement the LEDs cast a cylinder of light that strikes the beverage stream and illuminates it in a desired color. The LEDs are controlled by the control board and can be of the kind that can produce two or more different colors also under control of the control board. The color of light and other effects (dimming, brightening, flashing) can be used to indicate to the user a characteristic of the beverage, such as its flavor, temperature, carbonation level, and others. Other arrangements of lights to achieve such effects are possible, including different numbers, positions, and types of lights, and the direction in which they are aimed, among other things.

In some embodiments, each peristaltic pump comprises a housing (attached to the wall of the machine) that holds a motor, control electronics, a pump head, and a triangular roller. The roller sits inside the pump head. The input tube from the concentrate BIB surrounds the roller. When the pump is activated, the roller rotates in place, pushing concentrate through the output tube.

When a user holds a finger on an icon on the touchscreen representing a flavored water (e.g., lemon water), valve A opens, and only water at first begins to be dispensed. Less than 0.1 seconds later, the peristaltic pump connected (by a tube) to the lemon concentrate BIB container is activated by control board 36. The peristaltic pump pulls concentrate from the larger input tube and pushes it through to the smaller output tube at a flow rate that will create the desired dilution ratio of concentrate to water.

For example, suppose the flow rate of water out of the dispensing orifice at a particular beverage dispenser is 1 liter per minute. If the user has selected a "medium" level of flavor strength, corresponding to a concentrate:water ratio of 1:11, then if the icon representing lemon is held, the peristaltic pump will pump lemon concentrate at a speed of 1/12 liters per minute. Both water and concentrate are dispensed at a steady flow rate, so whether the user dispenses lemon water for 4 seconds or for 200 seconds, the ratio of concentrate:water dispensed will stay constant at 1:11.

As another example, if the flow rate of water out of the nozzle is the same 1 liter per minute, and if the user selects a "high" level of flavor strength, corresponding to a concentrate:water ratio of 1:5, the peristaltic pump pushes concentrate at a speed of 1/6 liters per minute.

As for the choice between still water and carbonated water, in some implementations, when a user selects a concentration ratio on the touchscreen (which sets the dispenser in a dispensing mode corresponding to that ratio), the ratio applies to any flavored beverage selected from then until the strength mode is changed by a user through interaction with the touch screen. In the examples above, had a user selected "cucumber water" instead of "lemon water," the peristaltic pump that pulled from the container of cucumber concentrate would have operated at the same speed as the peristaltic pump that pulled from the container of lemon concentrate.

In some implementations, the flow rate at which peristaltic pumps pump concentrate is digitally controlled to an accuracy of 1.95 mL per activation. The flow rate ranges from 0.001 liters per minute to 5.000 liters per minute. In other words, the concentrate can be pumped at a highly stable, reliable rate over time. However, the flow rate of water or other base liquid that is to be mixed with the concentrate can vary based on a variety of factors, such as incoming water pressure and incoming flow rate from the tap, and the level of pressure loss caused by a water filter. In addition, for beverages for which the ratio of concentrate to base liquid is low (for example, in flavored waters), even small variations in the ratio can be noticed by users and perceived as a quality or uniformity issue. Furthermore, the flow rates of the water of other base liquid at different machines can differ significantly yet the user may expect that a given beverage dispensed from different beverage dispensers will taste the same in terms of strength of flavor (and strength of carbonation).

In some examples, therefore, the flow rate of fluid from the peristaltic pump can be carefully controlled to compensate for changes in the flow rate of the base liquid or differences in the flow rates of different beverage dispensers. To enable control of the pump in this way, data on the flow rate of water out of the dispensing orifice can be collected manually from time to time or automatically and continually through a flow meter on tube C, or a combination of the two. The collected data is stored both locally at the beverage dispenser and in the database maintained by the central server. The speed of the peristaltic pump then can be varied to maintain constant ratios of concentrates to base liquids as flow rates of the base liquid fluctuate.

For example, suppose a user desires a 12-oz. beverage at a concentrate:water ratio of 1:11. If the actual flow rate of water is 11-oz. per 5 seconds, then 1 oz. of concentrate must be dispensed over 5 seconds. The control board in the dispenser uses the data stored on the flow rate of water to calculate the correct speed of the pump, in this case 0.2 ounces per second. If alternatively the user desires the same 12-oz. beverage at exactly the same concentration ratio, but the water flows at a rate of 11-oz. per 10 seconds, then the control board uses the data stored on the flow rate of water to calculate a different speed for the pump, in this case, 0.1 ounces per second.

Carbonated water typically is dispensed at a higher flow rate than non-carbonated water, due to extra pressure from the CO2. Data on the flow rate of carbonated water as well as non-carbonated water are stored in both the machine's local database and in the cloud database managed by the central server. The speed at which a peristaltic pump operates is controlled to match the recorded flow rate of whichever kind of water is dispensed—carbonated, non-carbonated, or a mix.

In some implementations, after flavored water (e.g., carbonated or still water with a relatively small ratio of additive) is dispensed, information such as the flavor setting, the corresponding concentration ratio, the speed at which the peristaltic pump operated, and the length of time that the peristaltic pump was active is recorded in a local database. The volume of concentrate removed from the concentrate container is calculated in two ways, for cross-checking: by multiplying the flow rate of the peristaltic pump (in terms of liters of concentrate per second) by the time that a user held his finger on the touchscreen, and by timing the activation period of the pump and multiplying by the flow rate known from checking the calibration of the pump. In some examples, every 5 seconds, the data from the local database are sent to a cloud database through a wireless connection (wired Ethernet connection is also available). The data can be used for a wide variety of purposes by a wide range of users.

For example, by giving users the freedom to specify the characteristics of drinks that are dispensed to them, it is possible for the database to include information on customer preferences. Data may be collected, analyzed, and distributed at the level of a given dispenser, at the level of an office or building, and at the level of multiple locations, for example. When data that identifies individual users over time, such as mobile payment information that identifies users, the data of the database can also be accumulated, analyzed, and distributed at the level of a particular time, or at the level of a period of time, or at the level of comparisons at selected different times. This enables tracking of an individual user's preferences over time and across locations. The data in the database can provide useful information on multiple sources of beverage (such as different beverage companies) including (a) identifying market trends to guide creation of new flavors, (b) creating brand loyalty by offering people their favorite drinks everywhere, and (c) inventory management, by recognizing the right locations for the right drinks. By giving users free reign to select the characteristics of the drinks that they select, valuable data is developed. In some implementations, the beverage dispensing system and individual beverage dispensers can alter beverage characteristics based on the location of a beverage dispenser and other factors. For example, in the touchscreen interface, when a user selects a flavor strength, the selected flavor strength corresponds to a recipe of a preset ratio of concentrate:water. The ratio (the recipe) is stored both locally in the data storage of the dispenser and in the cloud database. The ratio is associated with, and particular to, the specific dispenser. For example, on a given machine, when a user sets the flavor strength on the touchscreen to "medium," this may correspond to a concentrate:water ratio of 1:11. On another machine, "medium" may correspond to a ratio of 1:15. The recipe for an expected strength of a given beverage at a given dispenser will depend on the actual recipe strengths that users of a given dispenser prefer corresponding to strengths implied in the user interface controls. These recipe strengths change over time, based on stored data about beverages dispensed to users of the dispenser.

Every time a user selects a flavor strength (e.g. "medium" or "strong"), her selection is recorded. The corresponding actual ratio of concentrate:water dispensed is also recorded. The ratios corresponding to flavor strength selections are altered over time, based on statistics about dispensed beverages at the dispenser. In particular, the ratio of concentrate to water for a given beverage strength identified on the user interface (say "medium") can be adjusted to be either more or less concentrated based on the overall flavor strength preferences of a particular dispenser's user base.

For example, suppose that at a given time a machine's flavor strength settings correspond to the following ratios of concentrate to water:

Light—1:20
Medium—1:11
Strong—1:6

Now suppose that over the course of a 24-hour period, the majority of selections are for "strong" flavor strength, suggesting that users of that dispenser prefer stronger beverages. Then the concentrate:water ratio corresponding to a "medium" flavor setting can be changed from 1:11 to 1:10, and the ratio corresponding to a "strong" flavor settings can be changed from 1:6 to 1:5.

In another example, suppose that, at a given time, a dispenser's flavor strength settings match the following ratios of concentrate to water:

Light—1:100
Medium—1:50
Strong—1:10

When over the course of a 1-hour period, the majority of selections are for "light" flavor strength, the concentrate: water ratio corresponding to a "medium" flavor setting is changed from 1:50 to 1:51, and the ratio corresponding to a "light" flavor settings is changed from 1:100 to 1:101.

The revised ratios corresponding to flavor settings, and the specific time at which they change, are recorded in a time-series database in the cloud.

In some implementations, one or more of the beverage characteristics such as flavor strength can be adapted to information about uses by an individual user. For this purpose, the user interface can be set up to be able to identify the user (e.g. by facial recognition using a camera on the user interface, or a wide variety of other techniques). Every time that user selects a flavor strength (e.g. "medium" or "strong"), his selection is recorded. The corresponding ratio of concentrate:water dispensed is also recorded, and associated with that user. In other words, the recipe for a beverage to be dispensed can be varied depending on the identity of the user. The ratios (recipes) corresponding, for example, to flavor strength selections can then be adapted over time, based on his statistical information about that user's usage.

For example, suppose at a given time a user's flavor strength settings (as selected through the user interface) match the following ratios of concentrate to water that are stored and associated with that user:

Light—1:20
Medium—1:11
Strong—1:6

When the user dispenses flavored waters with an average (mode) of "strong" flavor settings, it can be inferred that the user prefers lemon drinks strongly flavored and cucumber medium drinks. Then the concentrate:water ratio corresponding to a "medium" flavor setting can be changed in the databases from 1:11 to 1:10, and the ratio corresponding to a "strong" flavor settings can be changed from 1:6 to 1:5. As such, the dispenser adapts to a flavor profile that prefers stronger tastes.

The revised ratios corresponding to flavor settings for the associated user, and the specific time at which they change, are recorded in a time-series database in the cloud.

An essentially identical approach can be applied to a variety of other beverage characteristics including carbonation settings, for which the volumes of dissolved CO2 in water corresponding to settings of "light," "medium," and "strong" carbonation can be adapted to usage patterns of individuals or groups. For example, when users of a given dispenser tend to choose a "strong" carbonation setting, the quantity of dissolved CO2 in water at a "medium" or "strong" setting could be increased, based on the assumption that users of that machine preferred beverages with higher carbonation. Conversely, when users of a given dispenser tended to choose "light" carbonation, the quantity of dissolved CO2 in water at a "medium" or "light" setting would decrease, based on the assumption that users of that dispenser preferred beverages with lower carbonation.

In some instances, the "light," "medium," and "strong" flavor and carbonation settings are mapped to the following factors in a database, and vary in accordance with how individual and group user preferences are correlated to any one or a combination of any two or more of these factors:

Temperature
Time of day
Season
A recently completed activity identified by the user (e.g. running, swimming, sleeping)
Dietary restrictions
Health conditions For example, a correlation could be identified across all dispensers that on hot days people tend to set stronger flavor strengths. Actual current temperature data could be pulled into the database for each area code in which a dispenser could be placed. When the temperature was greater than 80 degrees Fahrenheit in the zip code in which a dispenser was located, flavor strength settings across all machines could increase, so that when someone selected a flavored beverage on a "medium" or "strong" setting, for example, the peristaltic pumps moved at a higher speed (delivered concentrate at a higher flow rate) than when someone chose the same setting on a day when the temperature was 50 degrees.

For a different example, a user could identify to a dispenser, by touching a symbol on the touchscreen interface, that he is diabetic. When he does this, the recipes for flavor strength settings of all flavors that contained sugar would be significantly turned down to safe levels for diabetics.

When a user maintains physical contact (e.g., using a finger) with an icon representing a beverage on the touchscreen for more than a predetermined threshold, say, 0.25 seconds, that beverage begins to be dispensed under the control of the control board. When a user maintains contact with an icon on the touchscreen for less than the threshold, say, 0.25 seconds, a message appears on the touchscreen after the user ceases contact. The message says "Hold to fill," and advises the user that in order to dispense a drink, the icon must be held longer. In addition, delaying the start of dispensing by a predetermined threshold, say, 0.25 seconds, avoids little spurts of fluid from being dispensed when the user does a short touch. This feature lets users know that all they need to do to dispense a beverage is to keep their finger on an icon (because many users tap an icon expecting the touchscreen to offer them further instructions or further choices). The tablet, which determines the amount of time the contact has continued, and the control board, which commands the devices in the dispenser to dispense the beverage, communicate with one another to effect this process.

In some implementations, the tablet could detect motions associated with cleaning the screen, such as rubbing a cloth in a consistent circular pattern, or up-and-down pattern and allow dispensing again after the cleaning activity ended.

Among other ways, non-human touches can be identified are as follows:

1) the detection of 70 touches (for example) within a five-minute period (the range could be changed).
2) A single touch that goes on for more than 70 seconds (for example). This could be caused by dirt or oil getting stuck to the touchscreen (transmitted from someone's finger).
3) ten or more, for example, touches in the same square inch (or similar area) of the touchscreen in less than 1 second, for example. These touches do not necessarily have to be on the same pixel, but they all have to be within a square inch. The range of touches that would be detected as non-human could be five or more touches. This would indicate that the touches probably did not correspond to a person trying to dispense a single drink, as the user interface is intended to do.
4) ten or more, for example, touches in ten places, for example, on the touchscreen, in which no touch is on the same pixel, in less than, for example, two seconds. This would indicate that multiple drops of water were splashed on the touchscreen. The range of touches could be programmed to any number five or higher, based on what is considered to be an erratic, irrational pattern.

Touches on the entire touchscreen can be analyzed, not just the area where icons are displayed, because when water or dirt get on other areas of the touchscreen, there is also the risk that they will get on the icons.

Although many kinds of touchscreens would be suitable for use in the dispenser, one appropriate example would be a 10.1" (corner to corner) touchscreen manufactured by ASUS Computer International. The resolution is 1280×800. It is a capacitive pressure-sensitive touchscreen with the ability to pick up on over 200 different pressure levels. In some cases, the touchscreen can be integrated in a tablet. In some implementations, the touchscreen and computer can be decoupled, such that the touchscreen would be a separate component that is connect to a computer through a cable.

As mentioned earlier, the beverage dispenser has a carbon block (charcoal) filter, with pores that are 0.5 microns in size, meaning that particles in the water with a diameter of greater than 0.5 microns are captured by the charcoal. Chlorine, sediments, as well as many organic contaminants are captured by the filter. H2O molecules pass through the pores. Filters need to be changed when contaminants physically create too many clogs in the pores, and when water can no longer pass through at an adequate flow rate. A person (typically a technician) changes the filter when this happens. By the approach described here, it is possible to determine at a location remote from the dispenser that a filter in a beverage dispenser needs to be changed or is approaching a time when it will need to be changed. More generally, it is possible to determine the state of clogging of the filter over time.

Within the database managed by the central server in the cloud, each dispenser has a globally unique identifier that can be associated with data related to that dispenser. Every filter change in a machine is recorded and stored and is associated with a specific dispenser. The type of filter (brand and serial number) is manually entered in the database. The specific locations of the dispensers (latitude & longitude coordinates) are also stored in the database. In this database, there is also a recommended date at which the particular filter in each of the dispensers next needs to be changed. In some instances, the database also stored a recommended number of gallons after which the filter needs to replaced. The actual gallons passed through the filter, together with an estimate of gallons/day yields a date at which the filter needs replacement. Initially, a default number of days after the date of installation before a particular brand or model of filter needs to be changed is estimated based on the manufacturer's suggestion of how much volume of water the filter can handle before clogging and the expected usage of the filter in a given dispenser. This number of days in which the filter needs to be changed is updated in real-time from its initial default value by subtracting the total volume of water that has actually passed through the current filter from the total volume of water expected to pass through the filter before it clogs, and dividing the difference by the daily expected level of volume.

The volume of water to be dispensed between filter changes varies based on the rate at which a filter in that given dispenser is expected to clog with sediment. The rate at which a filter clogs and needs to be replaced depends on factors such as the turbidity of the input (source) water, the water pressure of the water entering the filter, and the types of sediments in the source water. These factors vary from location to location.

When the dispenser has operated for long enough to undergo two filter changes, the total volume of water the filter is expected to handle is calculated as follows:

The average volume of water that passed through the past 1-5 filters (for example, two) in the past at that location, before the filter experienced a significant decrease in flow rate of exiting water (e.g., a decrease in the flow of water exiting the filter of more than 10%, compared to the date the filter was first installed). The decrease in flow rate at which a filter needed to be replaced could be set in a range between 1-50% from when it was first installed.

In some implementations, in locations that lack the sufficient history of water filter changes, the total volume of water the filter is expected to handle is calculated as follows, for example:

1) If other dispensers in the same building have undergone a combined total of at least two filter changes, the average volume of water that passed through the past two filters in all of the machines in the building
2) If no other dispensers have been installed in the same building, but if other dispensers within a 0.3-mile radius have undergone a combined total of at least two filter changes, the average volume of water that passed through the past two filters in all of the dispensers in that radius. The radius is selected to encompass, for example, dispensers on the same city block, sharing the same water mains, because they are likely to have the same types of sediment from the water main pipes. A range up to a 1-mile radius could also be used.
3) If no other dispensers meet the above criteria, the radius is increased by 0.3 miles, repeatedly, until a dispenser within the radius has been found.

In variations of this method, the total volume of water that a filter is expected to handle depends on both the averages described above, as well as various coefficients. These coefficients indicate the percentage of volume that increases or decreases from the average based on the following, among others:

The level of lead in the water, measured by a person when the dispenser is installed, using a digital test kit.

The level of fluoride in the water, measured by a person using a drinking water test kit.

The turbidity in the water, measured by a person using a turbidity meter that measures total suspended solids.

The temperature of the input water, measured manually or by a digital thermometer attached to the input water.

The coefficients are determined empirically.

For example, an increase in the temperature of incoming water can be an indicator of more turbid water. More turbid water will clog a filter faster than less turbid water. If a sensor that senses the incoming water temperature identifies that the temperature has increased, then a liter of water that passes through the filter at that higher temperature can be expected to clog the filter more than a liter of water at a lower temperature.

This would be reflected in the predictive filter change model as follows:

Additional volume of water that a filter can process=Total volume that (Volume of water on Day 1)

X=volume of additional water that the filter can process before it clogs

V=total volume of water that a filter is expected to process (based on historical average)

$D_1$=total volume of water that a filter processed on day 1 of operation $D_2$=total volume of water that a filter process on day 2 of operation $D_3$=total volume of water that a filter process on day 3 of operation Etc. for days 4+ z=1.05=coefficient for above-average temperature

In the following example, days 3 and 5 have warmer temperatures, and the model assumes that turbidity is higher on these days and that consequently there will be additional wear and tear on the filter, requiring an earlier filter change:

$$X=V-D_1-D_2-zD_3-D_4-zD_5-D_6 \ldots$$

The same formula could be calculated using a different parameter, or a combination of parameters. For example, a technician, when visiting a dispenser, might use a lead testing kit to measure the presence of lead in tap water every day. Based on empirical study, lead could decrease the number of days within which a filter needs to be changed by 50%.

$$X=V-1D_1-1D_2-1zD_3-1D_4-1zD_5-1D_6 \ldots$$

In some implementations, measurements of the state of the incoming tap water (e.g. lead levels, temperature, rates of required filter changes, etc.) could be shared with a governmental water authority or other government agencies, an environmental protection organization, and/or building owners or developers.

When a water filter becomes fully clogged, not only does it stop filtering water correctly, but it can also cause dispenser breakdowns, because the dispenser's chiller can overheat trying unsuccessfully to pump water from the filter. Typical water coolers with filters, as well as hand-held filters like Brita and Pur are replaced based on either (a) a standard interval of time, or (b) a standard volume of liters of water that have passed through the filter. The standards are typically set by a manufacturer. However, depending on local water quality, affected by the age and quality of building pipes, for example, the actual volume of water after which filters need to be changed varies significantly from location to location.

In some cases, recognizing when a filter needs changing can be done as follows, without an Internet-connected flow meter:

(1) Take a measurement (or look up a known measurement) of the flow rate of water out of the nozzle in a given dispenser. The measurement could be taken manually by filling a 1-liter bottle of water directly from the dispenser and counting the number of seconds it took to fill the bottle to determine the flow rate in liters per second.

(2) In the first day after a filter has been changed (when flow rate is still expected to be unimpeded by clogs), calculate the average dispense time at a given location. Dispense time is measured directly from the touchscreen, by counting the number of seconds that a user holds a finger on an icon representing a beverage.

(3) Multiply the flow rate from (1) by the average dispense time in (2) to determine the volume of the average dispensed beverage (e.g. 8 oz. or 12 oz).

(4) Maintaining the average volume of a beverage calculated in (3), and assuming that the average volume of beverages dispensed will remain constant at that particular location, each day, divide the average volume by the average dispense time of beverages poured that day.

(5) When the daily average dispense time has increased by a predetermined percentage from the initial average dispense time calculated in (2)—e.g., when the average dispensed time has increased by 10% from the day after the filter was changed, assume that the filter has become significantly clogged and that the filter needs changing. The decrease in time that justifies a filter change could vary from 1-50%.

(6) Send an automated email alert to an operations team or distributor that manages the dispenser that the filter needs changing.

In some examples, instead of estimating the average dispense volume for all beverages in (3), the average is taken only for beverages dispensed for a particular user or set of users, e.g., all users who identify themselves as having a particularly sized cup.

In some instances, if there were an Internet-connected flow meter attached to tube C of the dispenser, the decrease in flow rate of water exiting the dispenser could be measured directly, instead of being estimated based on the length of time that someone held an icon on the touchscreen. Once the flow rate decreased by a predetermined percentage from when the filter was last changed (e.g., 1-50% slower), an alert would go out that the filter needed to be changed.

Figure 27:
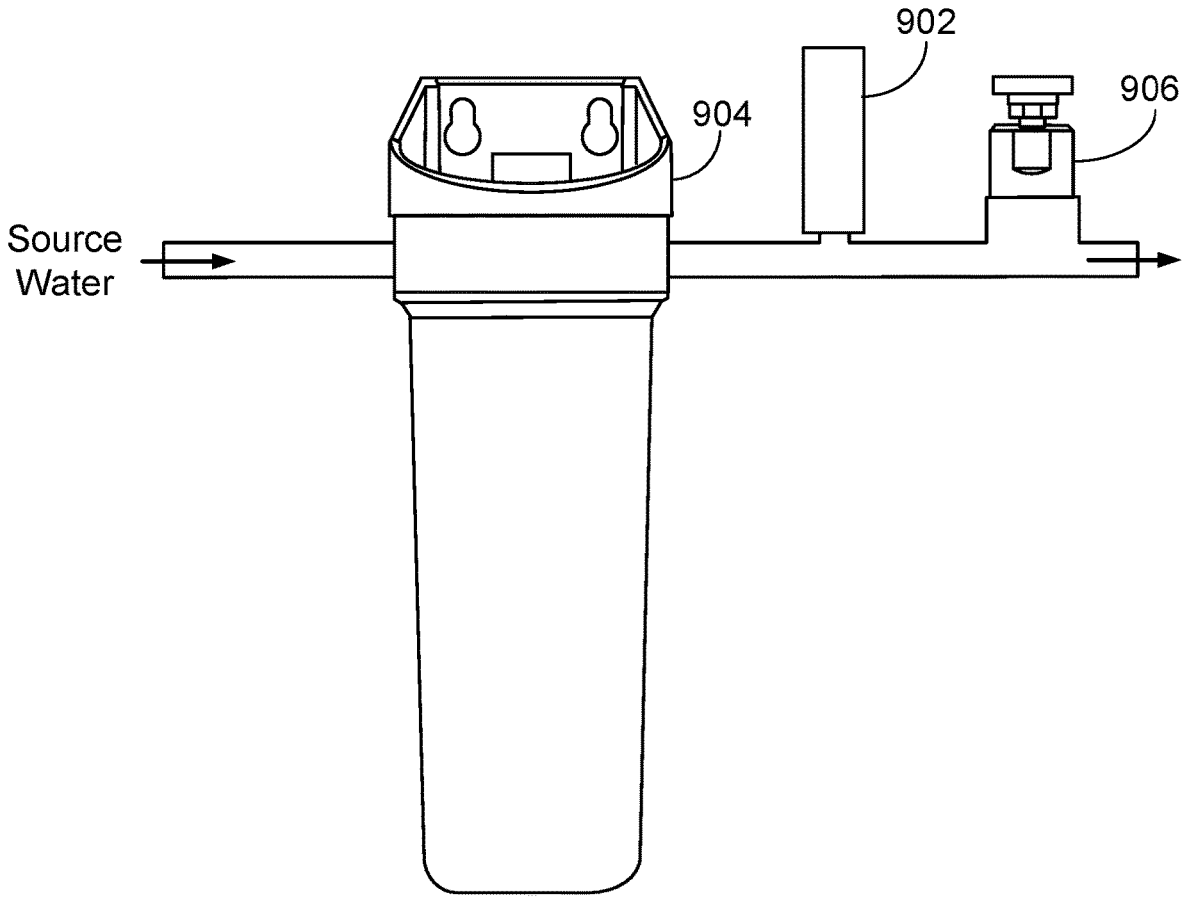
Figure 28:
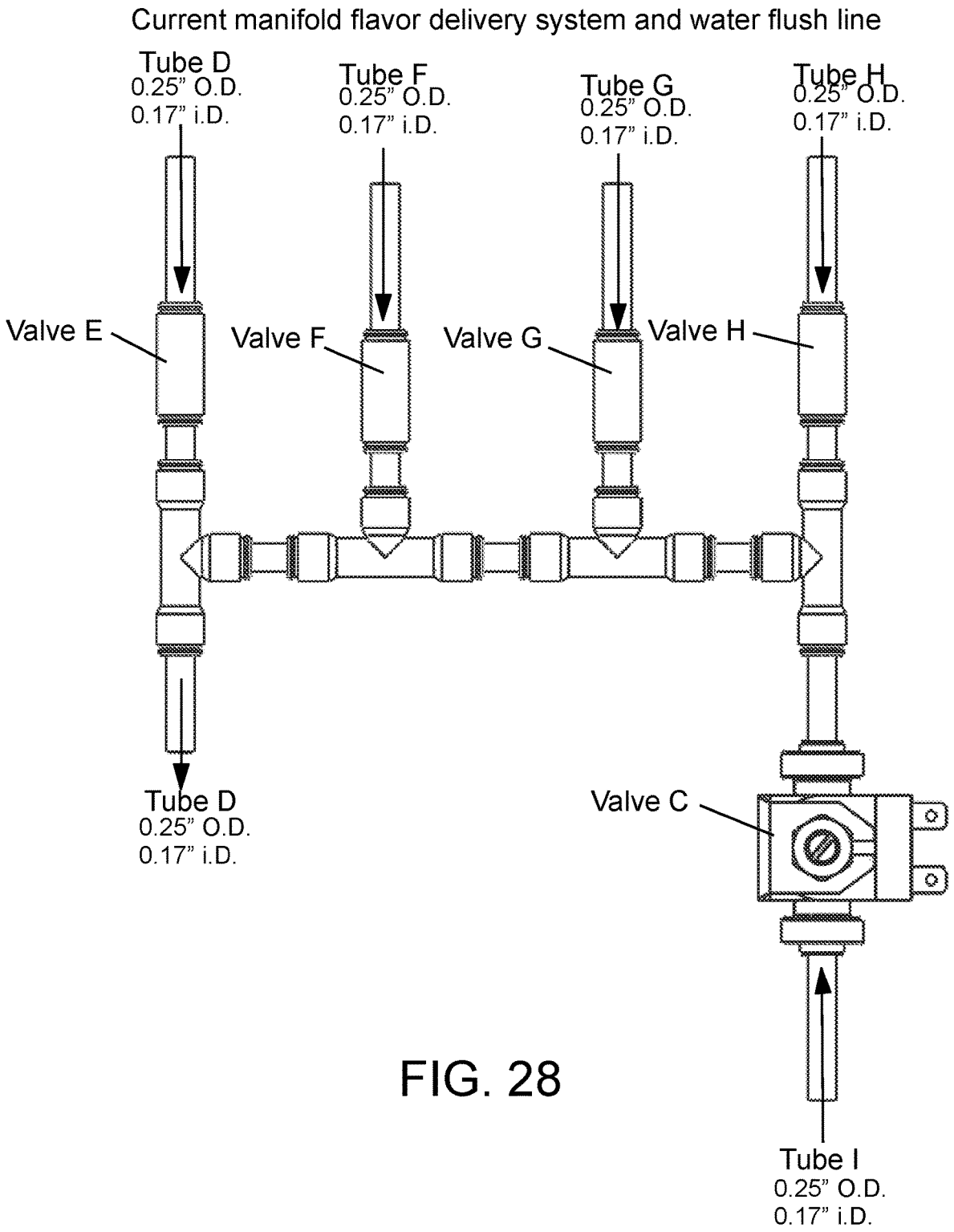

In some embodiments of the water and CO2 delivery system, as shown in FIG. 27, a pressure transducer 902 is used to monitor water pressure at the outlet side of the water filter 904 and ahead of the pressure regulator 906 on the outlet water line. By monitoring the pressure at the outlet of the water filter, a correlation between the convergence of the water pressure and pressure regulator setting will indicate that the water filter differential pressure has sufficiently increased due to filter clogging, to a point where water flow will no longer be adequate in the dispenser downstream of the water filter and pressure regulator. Information on the pressure at which flow rate will be too weak is stored in the database in the cloud and on the machine's storage device; this information is determined empirically. This data can then be used to signal when the dispenser requires service through the control system. The signal can be programmed such that it can automatically contact someone in real-time over the Internet to service the dispenser, or can be programmed to create an indicator on the user interface notifying the user that the water filter requires replacement. If Internet-connectivity is lost, the indicator could still appear on the user interface, but would not be sent to the cloud until connectivity was reestablished.

In some implementations of the water and CO2 delivery system, a digital scale that sits on a shelf inside the machine, directly underneath the CO2 tank, is calibrated annually and is polled every hour. The resulting data is used to monitor the weight of the CO2 tank in the dispenser. As carbonated water is dispensed from the machine, CO2 is consumed, gradually decreasing the weight of the tank. An "end" weight value is programmed into the control board in the dispenser, which is typically a fixed value (the weight of a specific type of CO2 tank with 0-10% of known mass put into CO2 tank), e.g., a CO2 tank which weighs 5 lbs empty+1 lb (10% of 10 lbs CO2)=6 lbs. A percentage of remaining CO2 that is used to represent the end value can vary from anywhere from 0-10%, depending on the quality of the scale. 10% is a safe buffer in case the scale has inaccuracies. The CO2 tank weight is stored in the dispenser and periodically (every 5 secs) communicated over the Internet to the central server. When the CO2 tanks weight decreases to a programmable set of thresholds, a series of warnings can be transmitted to service personnel indicating that a CO2 tank is nearing a point at which it requires replacement, or in fact requires replacement. This same set of indicators can also be used to disable "carbonated" water on a machine until the CO2 tank is replaced. Disabling the "carbonated" water prevents a user from shifting the toggle on the touchscreen interface from "still" to "carbonated." (Similar disabling can be used to prevent a user from causing a beverage to be dispensed of a particular flavor if the flavor concentrate container is depleted.) The first warning in the series can be programmed to be sent out when the CO2 tank is estimated to be in a range from 11-15% full. The next warning in the series can be programmed to be sent out when the CO2 tank is estimated to be in a range from 6-10% full, and so on, until the CO2 tank is estimated to be empty.

When the dispenser has not been used for a prolonged period of time (i.e., when no one has dispensed a drink in a period of greater than, for example, 6 hours), the temperature of carbonated water that has exited the chiller and is sitting in tubes B and B1 will get closer to the ambient air temperature. For example, in an office setting, where beverages are typically not dispensed over the weekend, the first one or two beverages dispensed on Monday morning will likely be at an ambient temperature, instead of chilled. Ambient or warm water does not retain as much dissolved CO2 as cold water, so if a user selects a carbonated drink for the first or second dispense cycles after a prolonged inactive period, a poorly carbonated drink will be dispensed.

Figure 29:
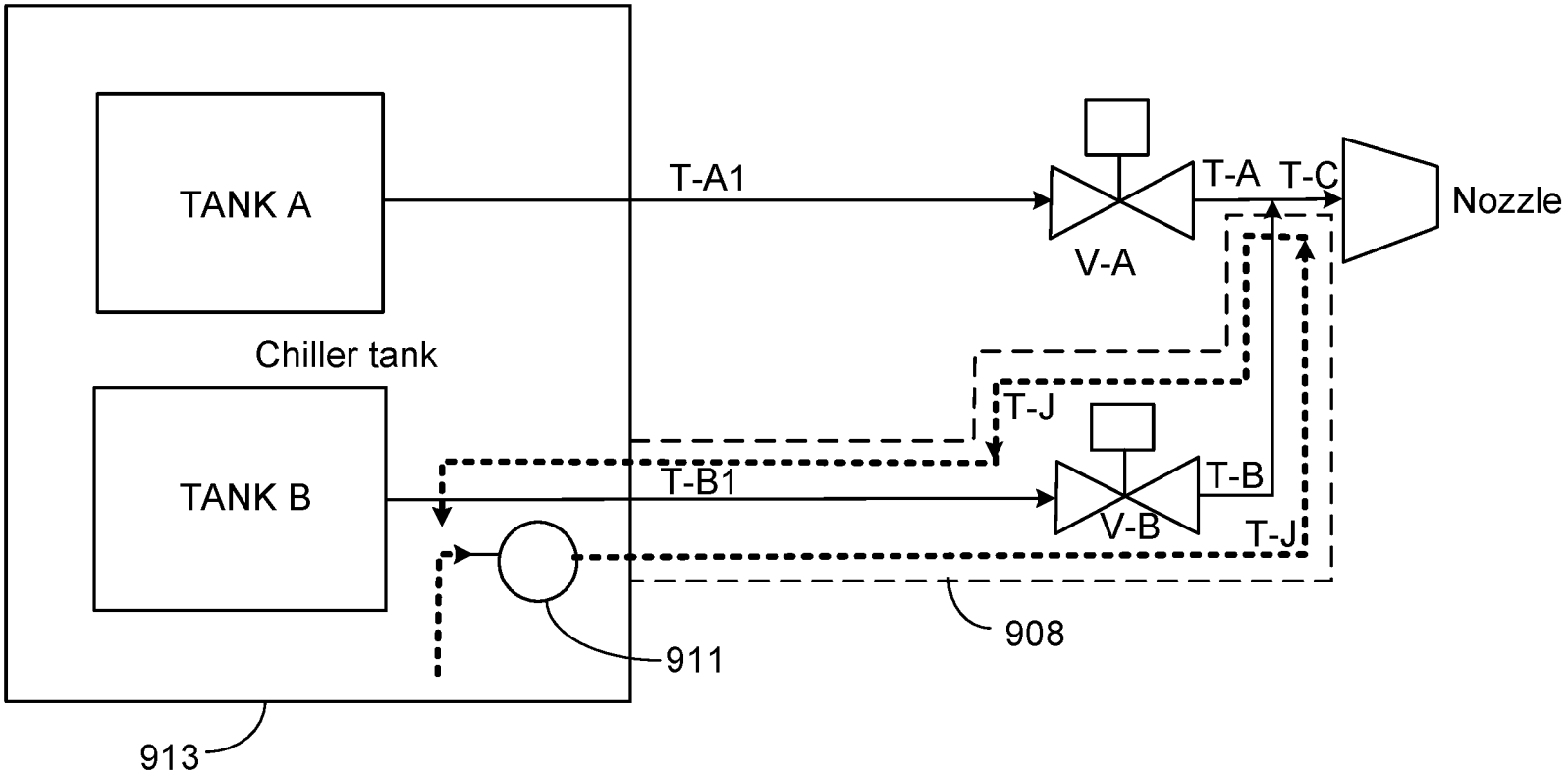
Figure 30:
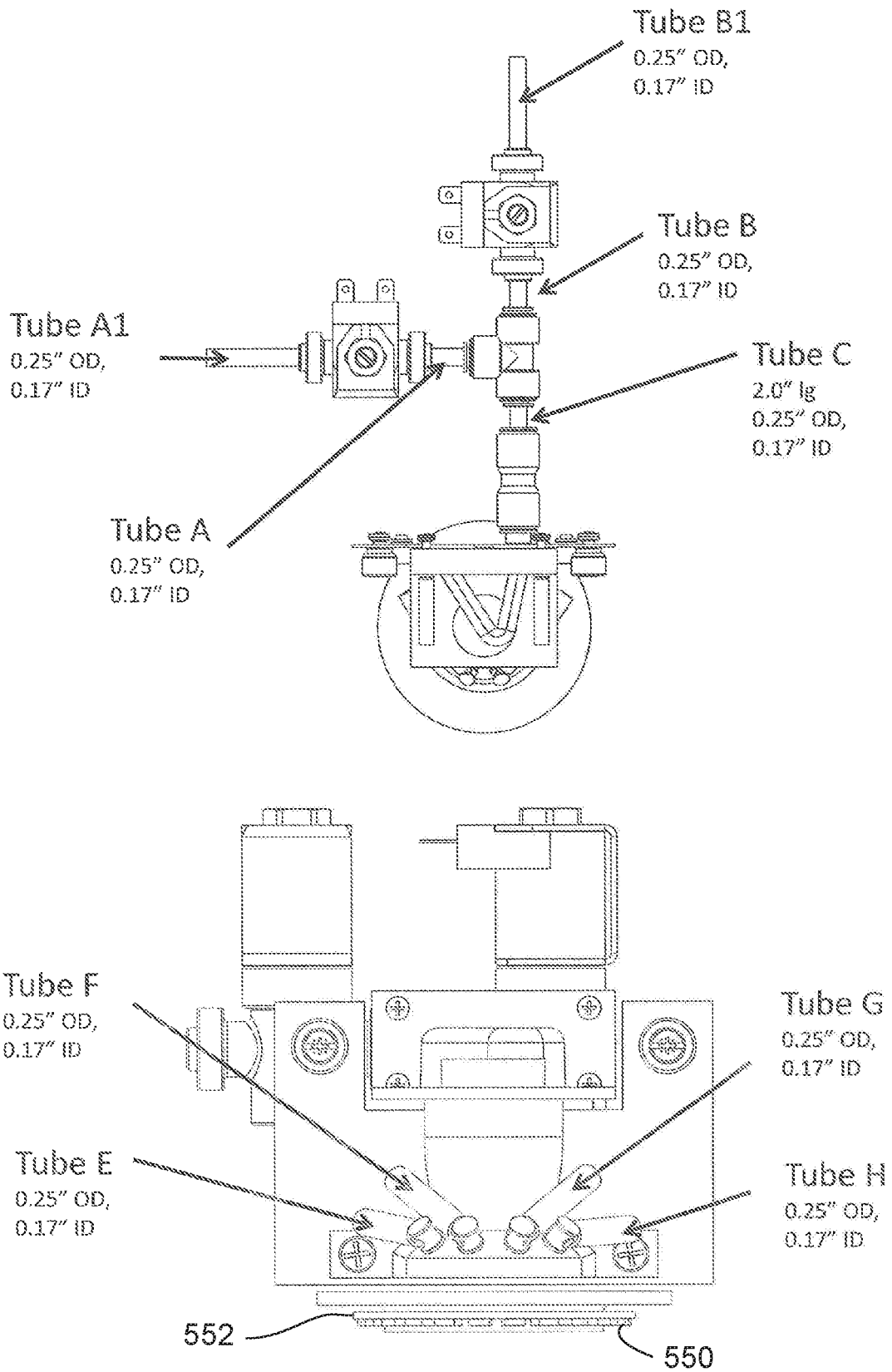
Figure 31:
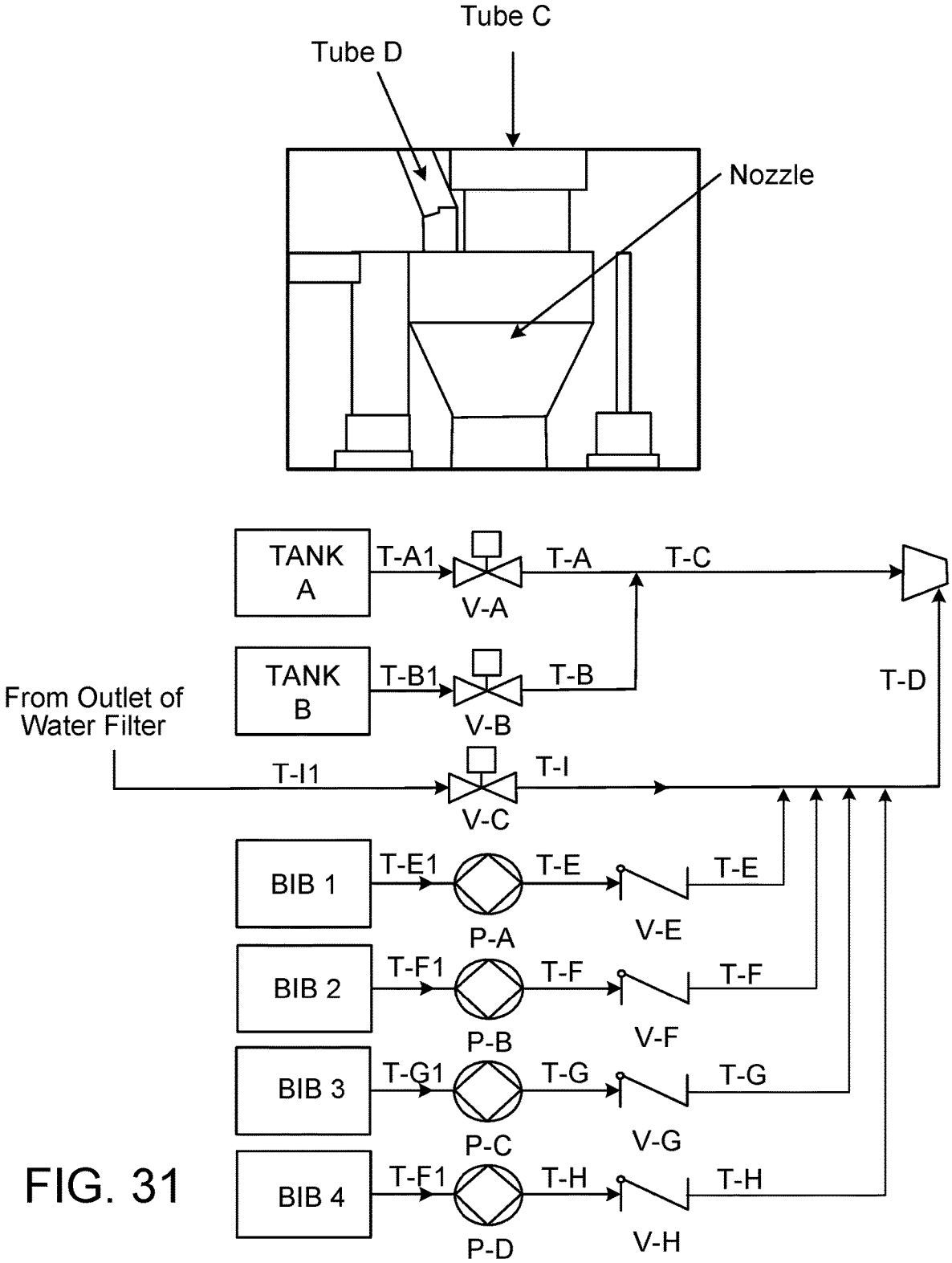
Figure 32:
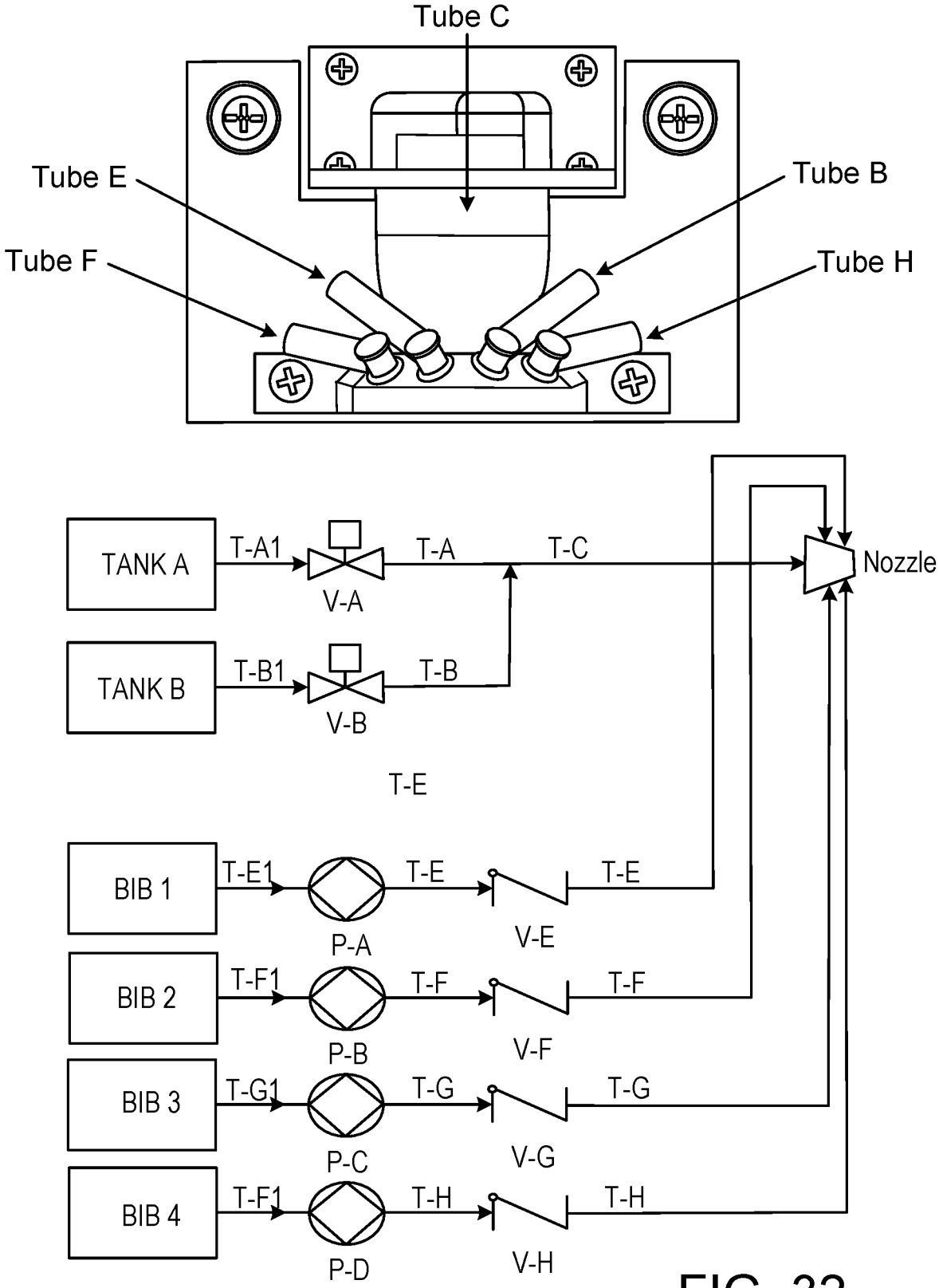
Figure 33:
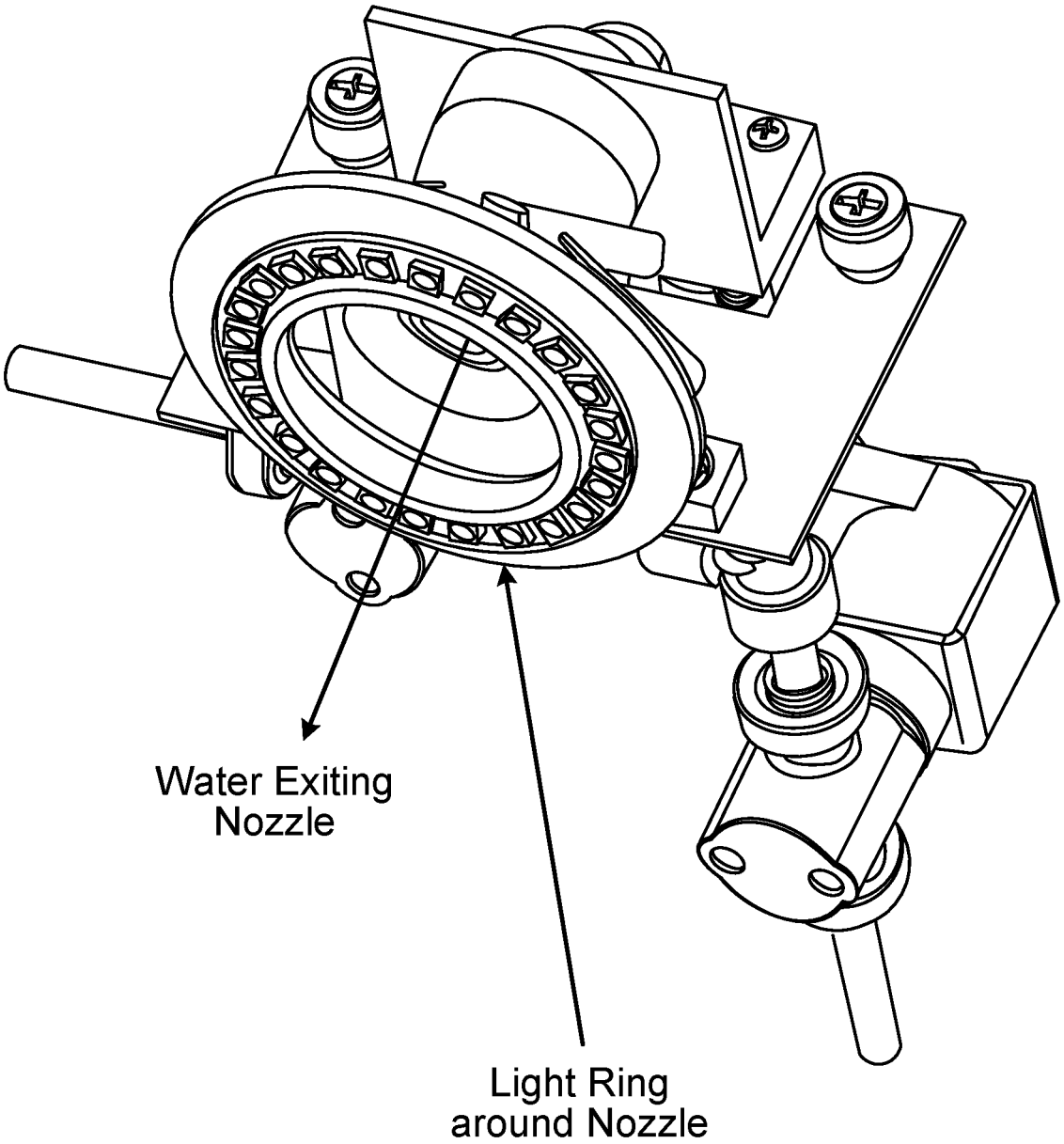

As shown in FIG. 29, to ensure that water is well carbonated even after the dispenser has not been used for a prolonged period of time, it is important to keep water in tubes B and B1 cold. In some implementations, a way to do this is to provide a circulator pump 911, which takes cold water out of a chilling tank, and runs it in a tube (tube J).

In some cases, tank A and tank B both sit inside a chilling tank 913, which, when a dispenser is first installed at a location, is filled with water. This water is in constant contact with a heat exchanger that keeps the water in the chilling tank cold. A small agitator inside the chilling tank keeps water in motion to stop ice from forming throughout the chilling tank, because that would risk icing the water inside tanks A and B.

Tube J is approximately five feet long. It runs alongside tube B1, valve B, and tube B, physically touching them; then it bends and carries water back into the chilling tank. Tube J physically touches tubes B and tubes B1 for over two feet of length. Heat transfers from the water in tube B and tube B1 into the chilled water of tube J, ensuring that the water in tube B and tubes B1 remains cold (approximately 38 degrees Fahrenheit), and retains CO2.

In some implementations, the temperature inside the chilling tank is not measured in real-time; and the temperature is controlled in an open loop mode. In some implementations, a digital thermometer could be used to measure the temperature inside tank A and tank B. The tanks could be maintained at their target temperature (a specific temperature between 32 and 50 degrees Fahrenheit) and the setting of the heat exchanged could be set to automatically adapt.

To reduce the amount of heat that escapes tube B1 and goes into the air, tubes B, B1 and J are wrapped in foam for insulation 908.

In some embodiments, each dispenser contains four concentrate containers in BIBs. BIBs, which are a standard packaging format for syrups and concentrates in the soda fountain industry. A BIB comprises a plastic bag of liquid concentrate inside a cardboard box. The plastic bag has an opening that attaches to a tube. To optimize operations of the beverage dispensing system the remaining weight of each concentrate in each dispenser is tracked and, based on consumption rates at those dispensers, the date on which each concentrate is expected to run out is estimated.

Each container has a default weight associated with it, which typically falls within a range of 25-35 lbs. for a 3-gallon container. When a technician puts a new container into a dispenser, he uses a special service interface on the touchscreen to enter which of a list of potential concentrate containers has been installed (for example—unsweetened lemon, unsweetened raspberry, preservative-free lemon, etc.). Each of the concentrate containers that could be installed has a default weight associated with it, stored in the local data storage in the dispenser and in the database managed by the central server. This is assumed to be the starting weight of the new concentrate container that has been installed.

If the technician is inserting a concentrate container into the dispenser that was previously opened and used, and therefore weighs less than the typical starting weight of a container, he can check a checkbox on the touchscreen that says "Not a new BIB." When this is checked, the technician is prompted to enter the weight of the container directly on the touchscreen.

In some implementations, the inventory model process that runs on the central processor predicts the current inventory status based on:

- full and empty bag-in-box (BIB) weight.
- actual dispense times.
- actual duty settings and measurements of the pump for each dispensing cycle.
- empirically defined relation between duty cycle of the related pump and the amount of concentrate dispensed.

From these parameters, typical usage rates are extrapolated into the future to predict when BIBs will be depleted, based on, for example, the following formula:

$$W1=W0-\Sigma(s*r*t*a*b)$$

Variables are explained as follows:

- W0=The weight of a concentrate container at the last time of measurement in kg
- W1=The weight of a concentrate container at a defined time after W0, in kg
- s=speed of peristaltic pump (on a scale of 0 and 255) during a dispense cycle
- t=duration of a particular dispense cycle, in seconds
- r=rate (in kg per second per 1 degree of pump speed) at which concentrate is expected to flow through a peristaltic pump, based on that peristaltic pump's setting between 0 and 255; this variable is standard across all machines.
- a=coefficient for the particular peristaltic pump inside a particular machine, to account for slight variations in performance of peristaltic pumps.
- b=coefficient for the particular type of concentrate being dispensed, to account for variations in r caused by properties of a particular liquid concentrate (e.g. density, viscosity).

Between t0 and the current time, the system computes loss of concentrate based on actual dispenses using this formula. For any time in the future, the system can use the same formula but based on average durations and strengths.

In words, the weight of the consumable concentrate at time t1 is the weight at time t0 minus the sum of a function over all dispense cycles that occur between t0 and t1. The function is a linear function that depends primarily on the flavor strength and duration of each dispense cycle, as well as on properties of the peristaltic pump doing the dispensing, and the particular liquid concentrate.

Coefficients a and b start off as "1," but are continuously adjusted based on actual measurements of concentrate depletion across all dispensers in the system. The goal is to improve the weight prediction over time, using information from all dispensers. The coefficients can be adjusted through the following feedback loops:

- Measurements of concentrate weights using digital load sensors or scales. Because load sensors add to cost, in some implementations they are not included in every machine, but could be included, for example, in approximately 10% of machines for the purposes of improving the model by comparing forecasts to reality.
- Manual measurements of weights using scales, occasionally taken by technicians when visiting dispensers.

The following calculations are performed using empirical examples of the weights calculated, to create a rolling average of the measurements of "a" and "b." The coefficients are revised according to the rolling average:

1. Revising coefficient a $$a=(W0-W1)/(s*r*t*b)$$

2. Revising coefficient b $$b=(W0-W1)/(s*r*t*a)$$

As mentioned above, the beverage dispensing system includes potentially a very large number of beverage dispensers at the same and different locations, all communicating data and instructions back and forth with central servers. Data is stored locally in the dispensers and also centrally in the cloud database. The data can be used in connection with operation of the dispensers and also to provide information to owners of the dispensers, owners of buildings where the dispensers are located, distributors, technicians, and service people, manufacturers of concentrates, CO2 containers, and other items used in the dispensers, marketers, and a wide variety of other parties. Among the kinds of data stored in the dispensers and in the cloud database and made available to users and others can be the following:

- A visual time-series display of daily dispense cycles, in which the total number of dispense cycles of each beverage are shown. The flavor selection, the strength of each flavor, the carbonation level, and the duration of each dispense are recorded in a database. In some instances, the visual time series does not display the strength of flavor or level of carbonation but only shows the total number of dispense cycles for each flavor selection by dispenser and any grouping of dispensers.
- A visual time-series display of daily dispense cycles, in which the duration (in seconds) of total dispense cycles of every beverage is shown.
- Real-time levels of CO2 and concentrates left in each dispenser.
- Forecast date when each concentrate will run out for each dispenser.
- Forecast date when CO2 will run out for each dispenser.
- Forecast date when a filter needs to be changed in each dispenser.
- Status of the battery in the tablet in each of the dispensers.
- Recorded dates of servicing activity for each dispenser.
- A history of alerts of problems (e.g. loss of water pressure, loss of Wi-Fi connection, etc.).
- Location of the dispenser.
- Version of the hardware & software in the dispenser.
- The identity of the distributor that manages the dispenser.
- The identity of the customer that controls the dispenser.

The cloud central server can be involved in the control of the operations of the dispensers in various ways, across all dispensers, a group of dispensers, or for a specific dispenser: e.g.:

- Turning the machines on or off
- Resetting the tablets
- Upgrading the software
- Changing the text or graphics on the screen
- Changing the default speed of peristaltic pumps
- Changing the default "flush" time of water after a dispense cycle, or changing dispensing sequences in other ways
- Changing the characteristics by which non-human touches are inferred
- Changing the default CO2 strength
- Changing the description of the concentrates A wide variety of users can be given access to the data stored in the database in the cloud for a broad range of purposes. Login can be achieved using an email to authenticate a user. Distributors (companies that purchase or lease the dispensers, and then sell or service them to customers) can track and control their dispensers using the cloud data and services provided by software miming on the central server. Access is given through a web browser interface that is served by the central servers. The portions of the data that can be accessed by a given user can be controlled based on the identity of the user, the location of the dispensers, the category of user (owner, distributor, building manager, etc.).

The cloud platform (we sometimes refer to the central server, software running on it, and the central database together as the cloud platform) can link each dispenser (based on a globally unique identifier of the dispenser) to a particular distributor. The particular distributor, for example, would need to be able to see data related to dispensers for which it is the responsible distributor, but should not see data for any dispensers managed by other distributors, to protect confidentiality of other distributors and their clients. When an employee of the particular distributor logs into the cloud platform using a work email address (say, with the domain particulardistributor.com), she becomes authenticated, and she then has access to a filtered version of the platform, with the full ability to view data and issue control instructions for only the dispensers associated with the particular distributor's account.

The host of the cloud platform can control which data that a particular distributor can view, and can limit their ability to issue control instructions to their dispensers, for all dispensers managed by that particular distributor. For example, the host of the cloud platform can stop a particular distributor from having the ability to change the default flavor settings in dispensers. The central server can also stop the particular distributor from viewing information such as the number of beverages dispensed.

Figure 34:
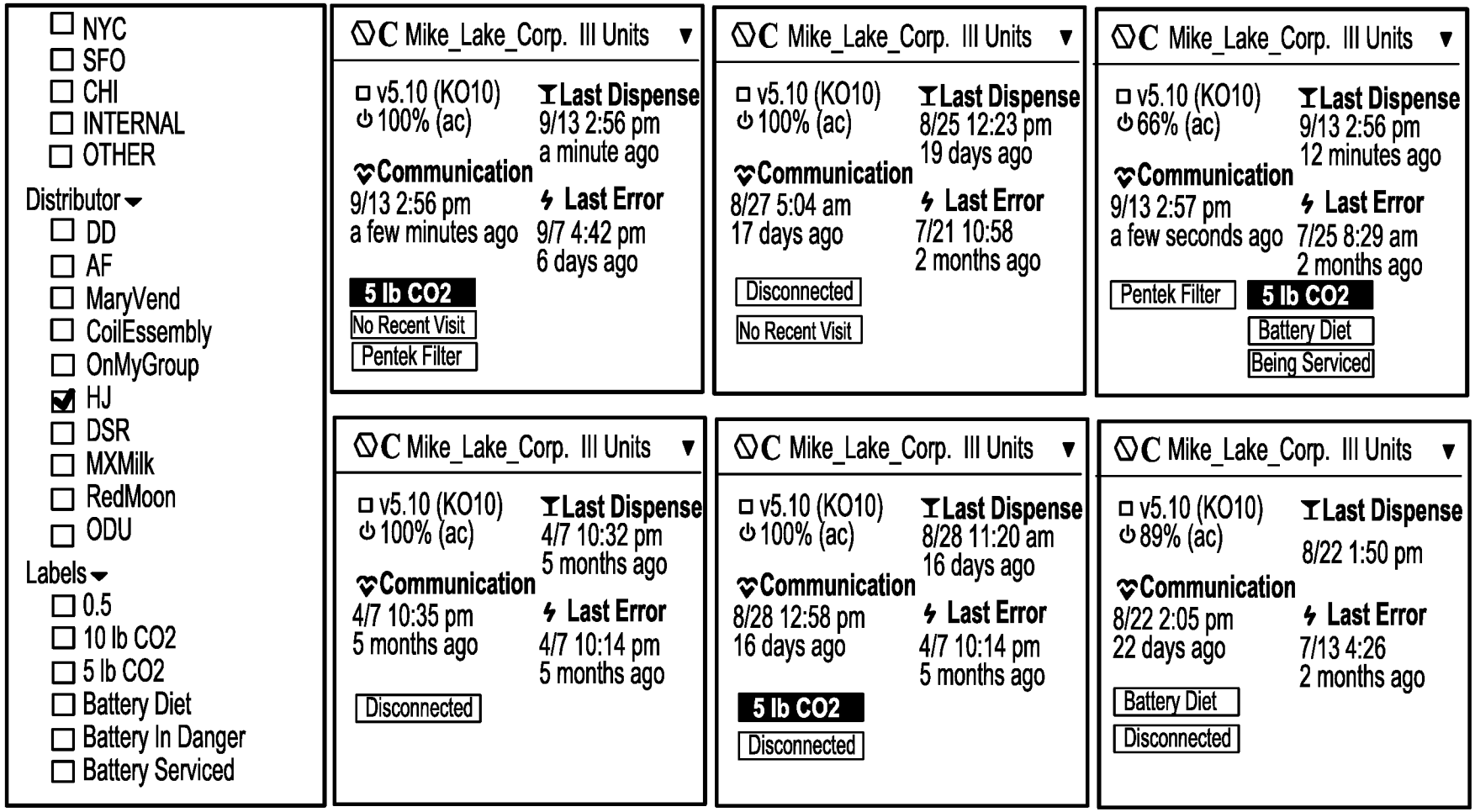

As shown in FIG. 34, a user interface 566 for a dashboard that can be exposed by the central server through a web browser to employees of a distributor can present a gallery of panels 560 each of which display information for a given beverage dispenser being managed by the distributor. The top ribbon of the panel identifies the dispenser, for example by identifying the company where the dispenser is located. As shown, the data displayed within the panel can include the version of the software running on the dispenser, the power state, the time and recency of the most recent dispensing cycle, the time and recency of the most recent communication between the central server and the dispenser, the most recently logged error and alerts 562 of various kinds.

As mentioned earlier, each of the beverage dispensers can have two processor units which can be implemented, in some examples, as: a lower level, Arduino-compatible processor to steer the hardware, which is an example of the control board 36, and a processor (which can be part of the tablet mentioned earlier) that runs Android and is responsible for the user interface, for commanding the Arduino-compatible processor, and for communicating with the cloud.

In some embodiments, the Android processor in cooperation with the tablet of each dispenser keeps a detailed log of all the notable events that occurred at, in, and with respect to the dispenser and its operation, and stores the events of the log in a time series database in the local data storage of the dispenser. This is a log in the sense that information is only added, not updated, and it provides a clear detailed history of the beverage dispenser including every touch to the touchscreen and information collected from digital controls and devices in the dispenser (e.g., the opening and closing of solenoid valves).

Tracking and analyzing of choices of flavor preferences can be used to optimize the experience of an individual user of the dispenser by making it easier to select his favorite flavor characteristics. On an aggregate level, across multiple dispensers, it improves the operation of each dispenser by optimizing the flavors and their characteristics.

All this event stored data is pushed from each of the dispensers to the cloud platform. The cloud platform is a web service endpoint on our servers. When an Internet connection is not available, the tablet will continuously try to reestablish a connection. When the Internet connection is restored, newly stored events are sent to the cloud platform beginning after the last event contained in the last successful transmission. In that way, no events will be missing from the comprehensive database stored in the cloud platform. This ability to not lose information when Internet connectivity is down is important.

The cloud servers continuously receive a stream of data from each dispenser that is Internet-connected. The data are stored persistently in the central database. Asynchronous tasks are launched automatically or manually as needed to analyze the data and provide support for various applications that rely on the data and are running on the central servers.

A wide variety of applications can be run on the servers of the cloud platform to receive and process event data, serve user interfaces, control features of dispensers, analyze data, communicate through the Internet, support distributors, order replacements of supplies and order service, support service technicians, model the operations and supplies of dispensers, predict usage of supplies, and perform other functions and combinations of them. In some implementations. the applications running on the cloud platform can include:

- Inventory model to predict the precise weight of concentrates and CO2 in a machine.
- An alert system that sends emails to distributors, owners, servicers, and others to signal potential problems or service requirements of a machine (e.g. CO2 or concentrates running low, a filter that needs changing, a water leak, a lack of water pressure, a broken solenoid valve, etc.).
- A dashboard to enable the cloud platform host and individual distributors to oversee and compare the performance and status of all machines
- A place for technicians to track their work restocking machines with concentrates and CO2, replacing filters, and documenting other issues.

In some implementations, the first (Arduino) processor (the control board) is responsible for controlling and receiving data from the following hardware, among other things:

- Solenoids that have a binary on/off state for opening/closing the fluid lines.
- Peristaltic pumps that control the fluid lines of each concentrate.
- A speed sensor associated with each peristaltic pump.
- A thermometer associated with the control board that records ambient air temperature around the electronics.
- The load sensor used to weigh the CO2 tank. The value represented by a current between 0 and 5000 mA. This raw data is recorded at the cloud platform and converted to pounds of CO2 based on an empirically determined translation function for each load sensor. Every load sensor has a different conversion rate to pounds.

The first processor (Arduino) and second Android processor (currently in a tablet) communicate via Bluetooth. The tablet is the initiator of the communications. A protocol of commands carried by the communications form a DSL (domain specific language). In some implementations, the following is a complete set of English language version of the commands (a wide variety of additional and different commands also could be useful):

Commands from the Arduino to the tablet include:

- Turn dispensing of water on or off
- Turn peristaltic pumps on or off
- Set speed of peristaltic pump
- Perform a load sensor measurement of CO2
- Change the value of a property or parameter such as how long water should run after concentrate stops being dispensed (i.e. the "flush")

Data sent back from the Arduino to the tablet:

- Acknowledgement that water has been dispensed (solenoid opens)
- Acknowledgement that a concentrate has been dispensed (peristaltic pump starts)
- Acknowledgement that a flush has been performed
- Acknowledgment that a dispensing cycle has ended (i.e. solenoid closes or pump stops)
- Acknowledgment of a load sensor measurement of CO2

In some examples, the Android tablet has at least two apps running at all times: a "dispense" app and a "watchdog" app.

Figure 35:
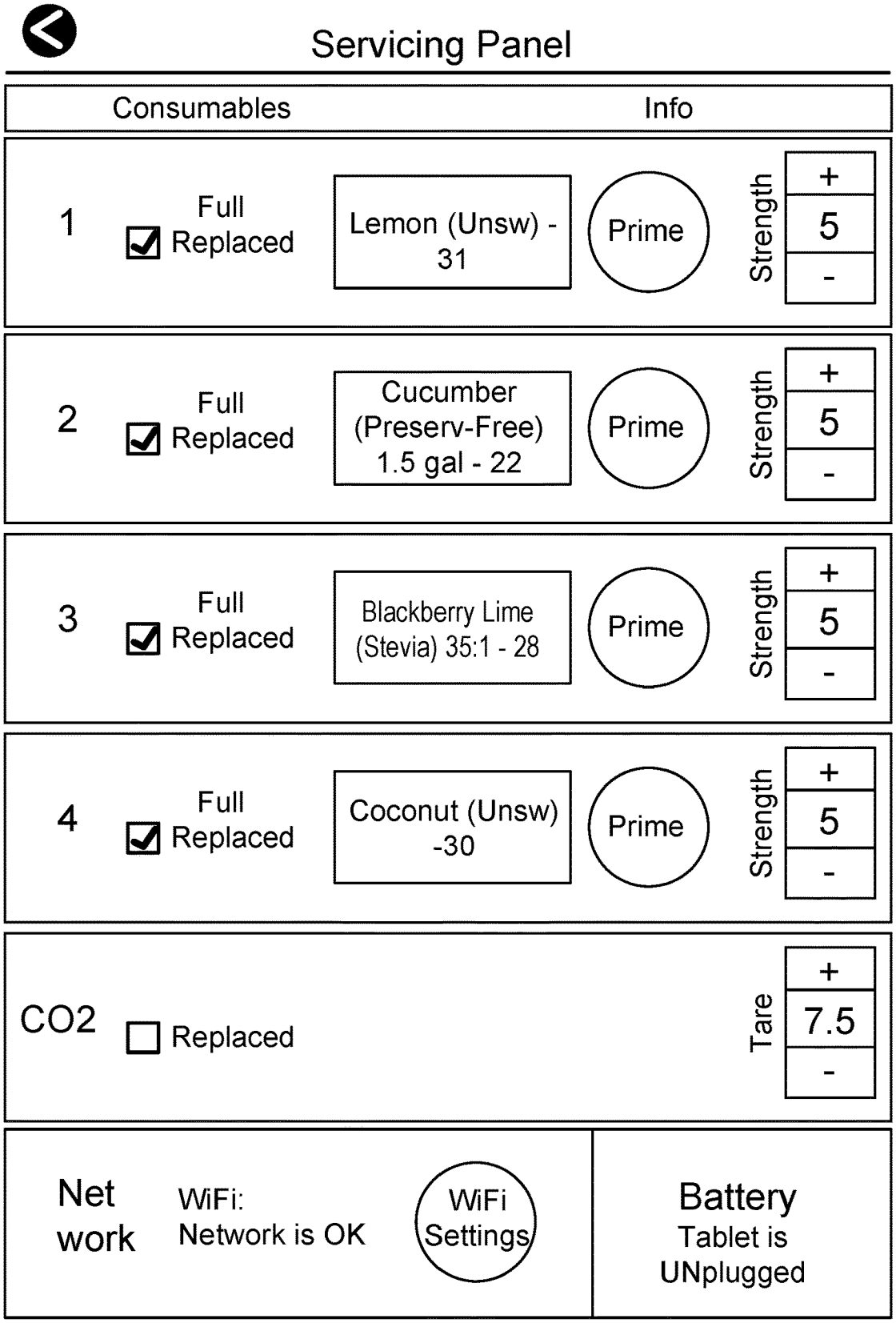

The dispense app is responsible, for example, for:

- Presenting and managing the user interface for selecting drinks and dispensing and for interacting with service technicians, such as the user interface shown in FIG. 35.
- Displaying ingredient and nutritional information on all the beverages in the dispenser, with a single touch to an identified place on the touchscreen.
- Showing animations, special custom messages, pictures, and videos. For example, when a particular customer reaches a milestone of a number of plastic bottles saved, a special video will celebrate the milestone.
- Communication with the Arduino over Bluetooth (or USB) using the protocol described above
- Gathering sensor data from the Arduino
- Gathering data from the tablet on every touch to the touchscreen (e.g. precise location of touch, length of time of touch, pressure of touch, etc.)
- Turning on a "battery diet" policy when battery is running low. The tablet runs on a battery and the tablet is constantly plugged into AC. However with heavy use, the battery can lose power faster than it can charge. This can cause the tablet to lose power and die. The tablet is responsible for battery control. A tablet on the "battery diet" will be less bright, communicate less frequently through the Internet, and do fewer animations.
- Temporarily block dispensing when strange or non-human-finger touch patterns occur.
- Present a service screen (such as the one shown in FIG. 35) that allows technicians to log service visits and consumable changes directly through the touchscreen. In the service screen, the current predicted inventory is shown on the tablet, together with information on the stability of the internet connection, and on the state of the battery. The technician can indicate as to each of the concentrate supplies and as to the CO2 supply whether she has replaced the supply.
- Communication with the cloud platform through the Internet using a specific URL. The dispenser can communicate to the Internet using the tablet through either Wi-Fi, Ethernet, or a cellular module, or a combination of them, for example, where alternate connection methods function as a fail-through when one connection method fails.
- React to and implement commands from the cloud platform. Some of the commands that can be issued from the cloud platform are: changing runtime configuration, changing a flavor, marking a flavor as out of stock, changing the animations, upgrading firmware, or taking a screenshot, among others.

The watchdog app is responsible for, among other things:

- Making sure the dispense app is always running and in the foreground
- Making sure that the dispense app starts immediately after a restart of the tablet Upgrading the dispense app (the dispense app cannot upgrade itself)

In some implementations, the cloud platform exposes a web service endpoint that enables at least the following functions:

tablets to post the events http://well.bevi.co/v1/tablets/<tablet-id>

The server to populate the web response to the tablets with commands that the tablet can interpret and act upon (e.g. to download a new version of the firmware)

To avoid the need for the tablets to open up ports for communication. Traffic is always initiated one way: from the tablet to the cloud platform, never the other way around. It's always the tablets that pushes and pulls data and instructions to and from the cloud platform.

The posted events to be saved persistently in the database.

For purposes of managing the data used by the system. the database is organized as a columnar time series database based on influxdb (https://influxdata.com/).

The database has a predefined semi-structured schema and contains a set of time series of data. Each series has a unique name and a list of associated events. Every event has a timestamp and a sequence number. The sequence number allows a process that uses the database to differentiate events that have the same timestamp. Additionally each event can have an unlimited set of key value pairs associated with it.

In some implementations, the schema of the event series of the database have at least the following fields:

time: long timestamp in nanoseconds of when the event happened sequence_number: long, this is, together with time, the primary key of the series unit: a string ID to identify a specific beverage dispenser Specific event series that originate on each of the dispensers:

static os_version: string of android codename, release, sdk_int board: string of android underling board bootloader: string of android bootloader version brand: string of brand of android device cpu_ab1: string of android device cpu instruction set cpu_ab2: string of android device second instruction set device: string of android industrial design display: string of android device meant to be shown to user build_fingerprint: string to uniquely identify the android build radio_version: string of the radio firmware number hardware: string name of hardware from the/proc host: string of android host build id: string of changelist number manufacturer: string of manufacture of build tablet_model: string of end user name of product product: string of overall product serial: string of hardware serial number build_tags: string of android tags describing build build_time: long of android build time build_type: string type of android build app_version: string version of dispense app app_last_install_time: String date of last time the app installed battery_technology: String of type of battery installed in tablet dispense action: String the reason for the dispense to stop dur: long the length of dispense in milliseconds flavor: int the button in dispense app being pressed flavor_name: String the flavor type being pressed intensity: String the type of flavor amount LOW, MEDIUM, HIGH motion_dur: String amount of time there is motion on touch motion_maxpressure: String the max pressure from all moment on touch screen motion_minpressure: String the min pressure from all moment on touch screen motion_pointers: String max amount of points from moment on touch screen motion_x: Double start x coordinate of the touch dispense motion_xdelta: Double amount of x moment from touch motion_y: Double start y coordinate of the touch dispense motion_ydelta: Double amount of ymoment from touch program_type: String type of dispense from touch. "DISPENSE_STILL, DISPENSE_CARBONATED, FLUSH, PRIME, BOOST"

carbonated: boolean if the dispense was sparking strength: String amount 0-10 of how much concentrate was being run through pump ghost—Used for tracking which event tripped ghostbuster dur: long the length of dispense in milliseconds flavor: int the button in dispense app being pressed flavor_name: String the flavor type being pressed intensity: String the type of flavor amount LOW, MEDIUM, HIGH motion_dur: String amount of time there is motion on touch motion_maxpressure: String the max pressure from all moment on touch screen motion_minpressure: String the min pressure from all moment on touch screen motion_pointers: String max amount of points from moment on touch screen motion_x: Double start x coordinate of the touch dispense motion_xdelta: Double amount of x moment from touch motion_y: Double start y coordinate of the touch dispense motion_ydelta: Double amount of ymoment from touch program_type: String type of dispense from touch. "DISPENSE_STILL, DISPENSE_CARBONATED, FLUSH, PRIME, BOOST"

carbonated: boolean if the dispense was sparking strength: String amount 0-10 of how much concentrate was being run through pump info flavor: String flavor_name: String message: String the type of state being change like carbonated or intensity prev_state: String previous state of type being change state: String new state of type being changed to.

load_sensor—computed from load sensor arduino readings value_lb: Double conversion based on load sensor coeff associated with dispenser (at time of conversion)

value_mv: String actual reading of load sensor error—error handling log content: String diff: String ghostbuster last time difference triggered detail: detail name of what caused error error_code: int error code from activity error exc_message: String exception message lastHandleMessageTs String last_event: String last event before ghostbuster trigger message: String type of error being logged msSinceLastSuccess: String previous_quit: String
reason: String used by ghostbuster for reason of trigger
stack_trace: String Exception stack trace
success: String
thread_name: String Exception thread name
touch—from tablet: every touch recorded by android
area: String where the touch occurred
dur: String length of touch in milliseconds
motion_dur: String amount of time there is motion on touch.
motion_maxpressure: String the max pressure from all moment on touch screen
motion_minpressure: String the min pressure from all moment on touch screen
motion_pointers: String max amount of points from moment on touch screen
motion_x: Double start x coordinate of the touch dispense
motion_xdelta: Double amount of x moment from touch
motion_y: Double start y coordinate of the touch dispense
motion_ydelta: Double amount of ymoment from touch In certain embodiments, the system may provide the ability for an individual user to save/store the touch-screen settings, and make those the new default for the future. On an overall "personal profile" screen, users should be able to set their desired ranges (minimum/maximum) for each category (temperature, vitamin-level, etc.), their desired temperature range, their choice of sweeteners, etc. This would then affect what options were available to them on the touchscreen. For each beverage "trait," certain beverage options might disappear if they fall outside a pre-determined range of what will taste good (determined by either a system's default settings, or the individual user). For example, certain tea options might disappear if the water falls below a certain temperature. For another example, certain beverage options might disappear if the vitamin content gets too high, since vitamins can negatively affect the taste of certain drinks.

The invention claimed is:

1. A beverage dispensing method comprising:

simultaneously displaying on a user interface a first manually operated switch that is actuable by a user to set only a carbonation level for a beverage to be dispensed and a plurality of second manually operated switches each corresponding to a different flavored beverage and actuable by the user to cause the corresponding flavored beverage to be dispensed;

receiving a first signal from the first manually operated switch indicating only a carbonation level set by the user for the beverage to be dispensed, the first signal not being representative of other characteristics of the beverage to be dispensed including a flavor of the beverage;

receiving a second signal from one of the second manually operated switches indicating the corresponding flavored beverage is to be dispensed, the second signal being received after the first signal;

in response to the first and second signals, controlling a pressure regulator associated with a supply of $CO_2$ or controlling a ratio of still water and carbonated water flowing to a dispensing orifice, or both, to dispense the flavored beverage corresponding to the second signal at the indicated carbonation level corresponding to the first signal; and adjusting a flow rate of a concentrate for the flavored beverage based on a second flow rate of a water source and the indicated carbonation level, wherein the second flow rate of the water source varies based on the indicated carbonation level;

determining an average dispense time for the beverage; and generating an alert that a filter needs to be changed based on the average dispense time increases beyond a predefined threshold.

2. The method of claim 1 in which the first and second manually operated switches comprise a portion of a touch screen.

3. The method of claim 1 in which the first signal from the first manually operated switch is indicative of a carbonation level on an arbitrary scale, and the method comprises mapping the carbonation level set by the user from the arbitrary scale to a parameter representing a pressure at the pressure regulator.

4. The method of claim 3 in which the mapping changes to reflect information about previous beverages dispensed, including updated information about preferences of consumers of dispensed beverages.

5. The method of claim 3 in which the first manually operated switch includes a portion of a touch screen.

6. The method of claim 1, further comprising disabling one of the plurality of second manually operated switches in response to information representing a sufficiency of a supply of a component included in the flavored beverage corresponding to the one of the plurality of second manually operated switches.

7. The method of claim 6 comprising receiving the information from a central server.

8. The method of claim 1 in which the first signal received from the first manually operated switch indicates the carbonation level based on a position of the first manually operated switch treated as a slider.

9. The method of claim 8 in which the position corresponds to a carbonation level on a scale of discrete potential carbonation levels each representing a different volume of $CO_2$ dissolved in water.

10. The method of claim 1 in which the first signal received from the first manually operated switch indicates the carbonation level based on a rotational position of the first manually operated switch.

11. The method of claim 1 comprising storing data representing the carbonation level of the beverage.

12. The method of claim 1 comprising indicating to a user the carbonation level of the beverage by a characteristic of light presented to the user.

13. The method of claim 12, in which the characteristic of light comprises changing a property of a visual effect that corresponds to the carbonation level of the beverage, the property comprising at least one of a color, dimming, brightening, flashing, number of lights, intensity of lights, or direction of aiming of a light.

14. The method of claim 1, further comprising storing data regarding the carbonation level set by the user and a volume of the flavored beverage dispensed.

15. The method of claim 1, further comprising displaying simultaneously with the first and second manually operated switches a third manually operated switch actuable by a user to set a flavor strength for the beverage to be dispensed, receiving a third signal from the third manually operated switch indicating a flavor strength of the beverage to be dispensed, the second signal being received after the third signal, and dispensing the flavored beverage having the flavor strength corresponding to the third signal.

16. The method of claim 15, wherein the third manually operated switch is actuatable to select two or more flavor strength levels.

17. The method of claim 1, wherein the first manually operated switch is actuable by the user to set a first carbonation level corresponding to a still beverage or to set a second carbonation level corresponding to a carbonated beverage; and wherein each of the plurality of second manually operated switches are actuable by the user to dispense the corresponding flavored beverage as either a still beverage or a carbonated beverage based on the carbonation level set using the first manually operated switch.

18. The method of claim 1, wherein one of the plurality of second manually operated switches corresponds to plain water.

19. The method of claim 1, further comprising:

receiving, via the control board, information from a load cell positioned beneath a tank corresponding to the supply of CO2; and in response to determining that the tank has reduced in weight past a threshold weight, determining that the tank needs to be replaced and generating a warning.

20. A beverage dispensing system, comprising:

a control board; and a computing device in communication with the control board, the computing device being configured to:

simultaneously displaying on a user interface a first manually operated switch that is actuable by a user to set only a carbonation level for a beverage to be dispensed and a plurality of second manually operated switches each corresponding to a different flavored beverage and actuable by the user to cause the corresponding flavored beverage to be dispensed;

receive a first signal from the first manually operated switch indicating only a carbonation level set by the user for the beverage to be dispensed, the first signal not being representative of other characteristics of the beverage to be dispensed including a flavor of the beverage;

receive a second signal from one of the second manually operated switches indicating the corresponding flavored beverage is to be dispensed, the second signal being received after the first signal;

in response to the first and second signals, transmit, via the control board, a control signal to a digital pressure regulator associated with a supply of CO2 to cause the digital pressure regulator to adjust the supply of CO2 to dispense the flavored beverage corresponding to the second signal at the indicated carbonation level corresponding to the first signal; and adjust a flow rate of a concentrate for the flavored beverage based on a second flow rate of a water source and the indicated carbonation level, wherein the second flow rate of the water source varies based on the indicated carbonation level;

determine an average dispense time for the beverage; and generate an alert that a filter needs to be changed based on the average dispense time increases beyond a predefined threshold.

* * * * *